US008764141B2

(12) United States Patent
Love et al.

(10) Patent No.: US 8,764,141 B2
(45) Date of Patent: Jul. 1, 2014

(54) SYSTEM FOR SHAPING MEDIA AT PRINTHEAD

(75) Inventors: John Christian Love, Vista, CA (US); Biagio Agostinelli, Vista, CA (US); Javier Escobedo, Vista, CA (US); Antoni Murcia, Vista, CA (US); David Tyvoll, San Diego, CA (US)

(73) Assignee: Zamtec Ltd, Dublin (IE)

( * ) Notice: Subject to any disclaimer, the term of this patent is extended or adjusted under 35 U.S.C. 154(b) by 305 days.

(21) Appl. No.: 13/108,832

(22) Filed: May 16, 2011

(65) Prior Publication Data

US 2011/0279618 A1 Nov. 17, 2011

Related U.S. Application Data

(60) Provisional application No. 61/345,559, filed on May 17, 2010.

(51) Int. Cl.
*B41J 25/308* (2006.01)
*B41J 2/01* (2006.01)

(52) U.S. Cl.
USPC ..... 347/8; 347/102; 347/104; 347/101

(58) Field of Classification Search
USPC ..... 347/104, 101
See application file for complete search history.

(56) References Cited

U.S. PATENT DOCUMENTS 3,975,590 A 8/1976 Nelson
5,157,421 A 10/1992 Kitahara
5,455,609 A 10/1995 Gast et al.
5,581,289 A * 12/1996 Firl et al. ..... 347/104
5,670,997 A 9/1997 Sugimoto et al.
5,831,647 A 11/1998 Kawakami et al.
5,966,157 A 10/1999 Dolan
6,336,699 B1 1/2002 Sarkissian et al.
6,416,146 B1 * 7/2002 Chua et al. ..... 347/8
6,460,967 B1 10/2002 Makita et al.
6,910,757 B2 6/2005 Kanamitsu
7,252,361 B2 8/2007 Nishikawa et al.
7,527,349 B2 5/2009 Jung et al.
7,543,899 B2 6/2009 Konno
2001/0012030 A1 8/2001 Midorikawa
2002/0015070 A1 * 2/2002 Taylor et al. ..... 347/32
2002/0060713 A1 5/2002 Katakura et al.

(Continued)

FOREIGN PATENT DOCUMENTS

EP 622199 A2 11/1994
WO WO 96/34754 A1 11/1996

*Primary Examiner* — Stephen Meier
*Assistant Examiner* — Sarah Al Hashimi
(74) *Attorney, Agent, or Firm* — Cooley LLP

(57) ABSTRACT

A system for shaping media for printing by a media width printhead is provided having a media width printhead of fluid ejection nozzles defining a media width print zone, input rollers disposed for transporting media into the print zone at an angle to a plane parallel with the print zone, output rollers for transporting media out of the print zone at an angle to a plane parallel with the print zone, and an elongate platen for supporting and shaping the media as the media is transported through the print zone. The platen has a series of ribs disposed upstream of the print zone and a series of ribs disposed downstream of the print zone. The ribs are configured so that the transported media adopts a constrained curved path past the nozzles through contact with the ribs in the print zone.

7 Claims, 71 Drawing Sheets

(56) References Cited

U.S. PATENT DOCUMENTS

| | | | | |
|---|---|---|---|---|
| 2002/0075348 | A1 | 6/2002 | Shindo et al. | |
| 2002/0130920 | A1 | 9/2002 | Saijo | |
| 2003/0007023 | A1* | 1/2003 | Barclay et al. | 347/8 |
| 2003/0030692 | A1* | 2/2003 | Uchida | 347/35 |
| 2004/0085427 | A1* | 5/2004 | Lee | 347/104 |
| 2004/0109056 | A1 | 6/2004 | Kang | |
| 2004/0165031 | A1 | 8/2004 | Nishi et al. | |
| 2004/0189767 | A1* | 9/2004 | Kodama et al. | 347/101 |
| 2004/0252157 | A1 | 12/2004 | Yamazaki et al. | |
| 2005/0157120 | A1* | 7/2005 | Silverbrook et al. | 347/86 |
| 2005/0243153 | A1 | 11/2005 | Takahashi | |
| 2006/0050104 | A1 | 3/2006 | Sakakitani | |
| 2007/0030303 | A1 | 2/2007 | Ha et al. | |
| 2007/0040864 | A1 | 2/2007 | Jung et al. | |
| 2007/0046724 | A1 | 3/2007 | Jung et al. | |
| 2007/0052782 | A1 | 3/2007 | Lee | |
| 2007/0081010 | A1 | 4/2007 | Morgan et al. | |
| 2007/0222816 | A1 | 9/2007 | Nishi et al. | |
| 2007/0279450 | A1 | 12/2007 | Matsuhashi et al. | |
| 2008/0012896 | A1 | 1/2008 | Murayama | |
| 2008/0198197 | A1 | 8/2008 | Morris et al. | |
| 2008/0266347 | A1 | 10/2008 | Kim | |
| 2008/0297546 | A1 | 12/2008 | Lee et al. | |
| 2009/0058973 | A1 | 3/2009 | Silverbrook | |
| 2009/0073223 | A1 | 3/2009 | Lim | |
| 2009/0122107 | A1 | 5/2009 | Ray et al. | |
| 2011/0279532 | A1 | 11/2011 | Love et al. | |

* cited by examiner

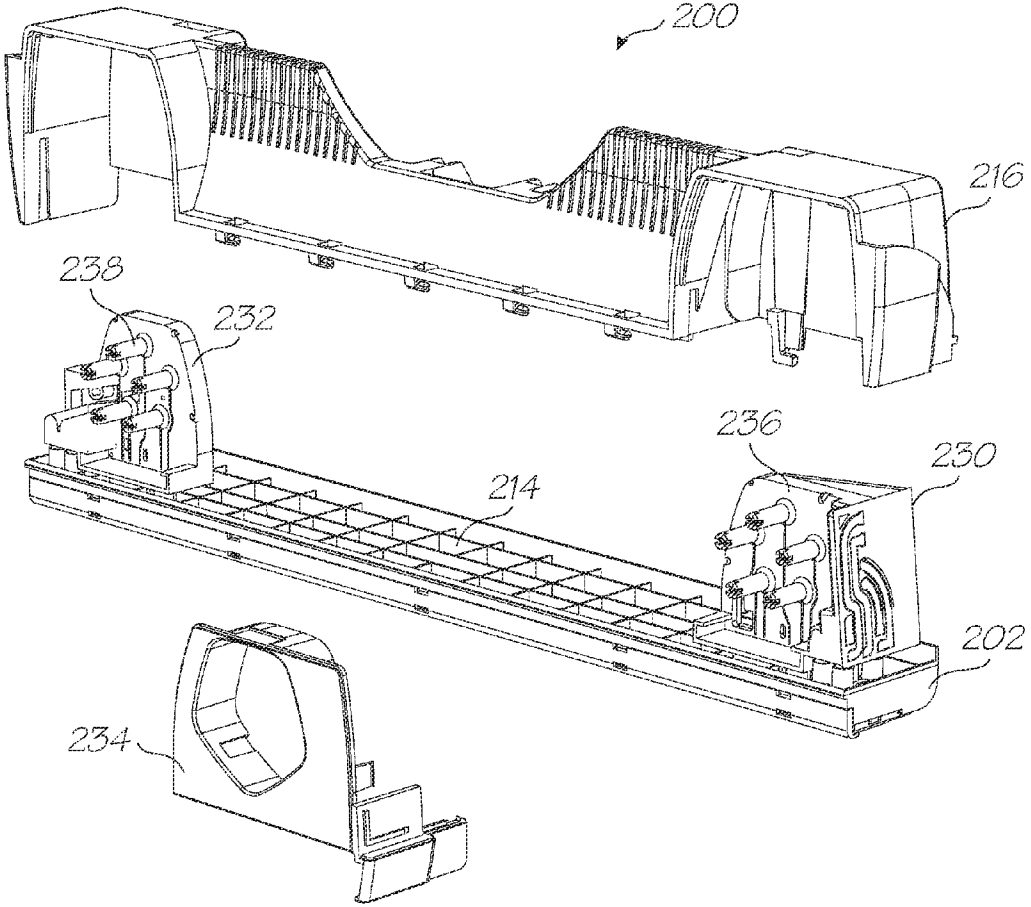
FIG. 4
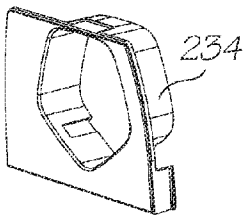

SYSTEM FOR SHAPING MEDIA AT PRINTHEAD

FIELD OF INVENTION

The invention relates to maintenance systems, apparatus and methods for maintaining a printhead and to the configuration and arrangement of the components of such systems and apparatus. In particular, maintenance of a fluid ejection printhead, such as an inkjet printhead, is provided. More particularly, maintenance of an inkjet media width printhead is provided.

CO-PENDING APPLICATIONS

The following applications have been filed by the Applicant simultaneously with the present application:

| | | | | |
|---|---|---|---|---|
| KPF001US | KPF002US | KPF003US | KPF004US | KPF005US |
| KPF006US | KPF007US | KPF008US | KPF009US | KPF010US |
| KPF011US | KPF012US | KPF013US | KPF014US | KPF015US |
| KPF016US | KPF017US | KPF018US | KPF019US | KPF020US |
| KPF021US | KPF022US | KPF023US | KPF024US | KPF025US |
| KPF026US | KPF027US | KPF028US | KPF029US | KPF030US |
| KPF031US | KPF032US | KPF033US | KPF034US | KPF035US |
| KPF036US | KPF037US | KPF038US | KPF039US | KPF040US |
| KPF041US | KPF042US | KPF043US | KPF044US | KPF045US |
| KPF046US | KPF047US | KPF048US | KPF049US | KPF050US |
| KPM001US | KPM002US | KPM003US | KPM004US | KPM005US |
| KPM006US | KPM008US | KPM009US | KPM010US | KPM011US |
| KPM012US | KPM013US | KPM014US | KPM015US | KPM016US |
| KPM017US | KPM018US | KPM019US | KPM020US | LNP001US |
| LNP002US | LNP003US | LNP004US | LNP005US | LNP006US |
| LNP007US | LNP008US | LNP009US | LNP010US | LNP011US |
| LNP012US | LNP013US | LNP014US | LNP015US | LNP016US |
| LNP017US | LNP018US | LNP019US | | |

The disclosures of these co-pending applications are incorporated herein by reference. The above applications have been identified by their filing docket number, which will be substituted with the corresponding application number, once assigned.

CROSS-REFERENCE TO OTHER APPLICATIONS

The following patents or patent applications filed by the applicant or assignee of the present invention are hereby incorporated by cross-reference.

| | | | | |
|---|---|---|---|---|
| 6,276,850 | 6,443,555 | 7,215,441 | 6,906,778 | 6,688,528 |
| 6,641,315 | 7,155,395 | 7,118,481 | 6,750,901 | 6,496,654 |
| 7,021,745 | 6,712,453 | 6,428,147 | 6,416,170 | 6,402,300 |
| 6,464,340 | 6,612,687 | 6,412,912 | 6,447,099 | 6,505,913 |
| 7,249,108 | 6,566,858 | 6,442,525 | 09/517,384 | 09/505,951 |
| 6,374,354 | 7,246,098 | 6,816,968 | 6,757,832 | 6,334,190 |
| 6,745,331 | 7,249,109 | 10/940,653 | 10/942,858 | 7,286,169 |
| 6,985,207 | 6,878,299 | 10/780,625 | 10/831,234 | 10/831,233 |
| 7,246,897 | 7,077,515 | 10/831,235 | 10/853,336 | 6,913,875 |
| 11/012,024 | 11/011,925 | 6,710,457 | 6,530,339 | 6,238,044 |
| 11/003,786 | 11/003,463 | 11/003,701 | 11/003,683 | 11/003,614 |
| 7,284,820 | 11/293,800 | 11/482,975 | 11/482,970 | 11/482,968 |
| 11/482,972 | 11/482,971 | 11/482,969 | 6,431,777 | 6,471,331 |
| 11/097,266 | 11/685,084 | 11/740,925 | 11/763,444 | 7,206,654 |
| 6,786,420 | 6,948,661 | 7,073,713 | 11/518,238 | 7,032,899 |
| 11/084,237 | 6,350,023 | 11/246,676 | 11/246,707 | 11/482,958 |
| 11/482,955 | 11/482,962 | 11/482,963 | 11/482,956 | 11/482,954 |
| 11/482,974 | 11/482,957 | 11/482,987 | 11/482,959 | 11/482,960 |
| 11/482,961 | 11/482,964 | 11/482,965 | 11/482,976 | 11/482,973 |
| 11/495,815 | 10/803,074 | 10/922,970 | 10/922,836 | 10/922,842 |
| 10/922,848 | 10/922,843 | 7,125,185 | 7,229,226 | 10/815,621 |

-continued

| | | | | |
|---|---|---|---|---|
| 7,243,835 | 10/815,630 | 10/815,638 | 10/815,635 | 10/815,647 |
| 10/815,636 | 11/041,650 | 11/041,556 | 10/815,609 | 6,227,652 |
| 6,588,882 | 6,742,873 | 6,918,655 | 6,547,371 | 6,938,989 |
| 6,598,964 | 6,923,526 | 6,273,544 | 6,425,654 | 6,623,101 |
| 6,406,129 | 6,505,916 | 6,457,809 | 6,550,895 | 6,457,812 |
| 7,152,962 | 6,428,133 | 11/607,976 | 11/685,074 | 11/696,650 |
| 11/763,446 | 6,224,780 | 6,665,094 | 7,072,076 | 6,851,782 |
| 10/636,211 | 11/305,274 | 6,231,148 | 7,006,143 | 6,412,993 |
| 7,204,941 | 7,278,727 | 7,148,345 | 11/172,816 | 11/831,961 |
| 10/407,212 | 11/482,980 | 11/482,967 | 11/124,158 | 11/124,197 |
| 11/124,163 | 7,236,271 | 11/124,201 | 11/124,188 | 11/124,170 |
| 11/124,187 | 11/124,189 | 11/124,190 | 11/124,180 | 11/124,178 |
| 11/124,148 | 11/124,168 | 11/124,167 | 11/124,179 | 11/187,976 |
| 11/188,011 | 11/188,014 | 11/482,979 | 11/228,540 | 11/228,502 |
| 11/228,484 | 11/228,489 | 11/228,518 | 11/228,488 | 11/228,523 |
| 11/228,520 | 11/228,498 | 11/228,479 | 6,238,115 | 6,087,638 |
| 10/868,866 | 11/242,916 | 11/198,235 | 11/861,282 | 7,152,972 |
| D529952 | 6,390,605 | 6,322,195 | 6,426,014 | 6,364,453 |
| 6,315,399 | 6,595,624 | 6,417,757 | 7,095,309 | 6,817,700 |
| 6,425,971 | 6,383,833 | 6,746,105 | 6,412,904 | 6,398,343 |
| 6,652,074 | 6,682,174 | 6,648,453 | 6,682,176 | 6,755,509 |
| 7,222,943 | 7,188,419 | 7,168,166 | 7,086,719 | 11/763,440 |
| 11/246,687 | 11/829,957 | 11/829,962 | 11/829,966 | 11/829,967 |
| 7,156,508 | 11/246,684 | 7,246,886 | 7,128,400 | 7,108,355 |
| 6,991,322 | 7,287,836 | 7,118,197 | 10/728,784 | 10/728,783 |
| 7,077,493 | 6,962,402 | 10/728,803 | 7,147,308 | 7,118,198 |
| 7,168,790 | 7,172,270 | 7,229,155 | 6,830,318 | 7,195,342 |
| 7,175,261 | 10/773,183 | 7,108,356 | 7,118,202 | 10/773,186 |
| 7,134,744 | 7,134,743 | 7,182,439 | 7,210,768 | 10/773,187 |
| 7,134,745 | 7,156,484 | 7,118,201 | 7,111,926 | 10/773,184 |
| 11/060,751 | 11/060,805 | 11/744,885 | 11/097,308 | 11/210,687 |
| 11/097,212 | 7,147,306 | 11/482,953 | 11/482,977 | 11/544,778 |
| 11/764,808 | 7,156,289 | 7,178,718 | 7,225,979 | 11/084,796 |
| 09/575,197 | 09/722,174 | 7,175,079 | 7,162,259 | 11/520,170 |
| 11/830,848 | 11/830,849 | 7,068,382 | 10/743,671 | 7,094,910 |
| 7,091,344 | 7,122,685 | 7,038,066 | 7,099,019 | 7,062,651 |
| 6,644,642 | 7,064,851 | 6,965,439 | 7,093,991 | 7,190,491 |
| 10/932,044 | 10/965,733 | 10/965,933 | 10/982,974 | 7,180,609 |
| 11/653,219 | 6,982,798 | 6,870,966 | 6,792,165 | 7,015,901 |
| 7,289,882 | 10/919,379 | 11/193,481 | 11/255,941 | 11/495,814 |
| 11/495,822 | 7,055,739 | 7,182,247 | 7,082,562 | 6,766,944 |
| 10/409,864 | 7,108,192 | 7,111,791 | 10/683,151 | 6,957,768 |
| 6,786,397 | 11/856,061 | 11/672,522 | 11/672,950 | 11/672,947 |
| 11/672,891 | 11/672,954 | 11/754,310 | 11/754,321 | 11/754,320 |
| 11/754,319 | 11/754,318 | 11/754,317 | 11/754,316 | 11/754,315 |
| 11/754,314 | 11/754,313 | 11/754,312 | 11/754,311 | 7,132,679 |
| 6,755,513 | 6,904,678 | 7,097,273 | 6,824,245 | 7,222,947 |
| 6,860,581 | 6,929,351 | 7,063,404 | 11/066,161 | 11/066,160 |
| 6,804,030 | 10/727,181 | 10/754,536 | 10/754,938 | 10/934,720 |
| 6,795,215 | 11/482,981 | 7,195,328 | 10/854,521 | 10/934,628 |
| 11/601,757 | 11/014,731 | D529081 | D528597 | 6,924,907 |
| 10/636,234 | 10/636,233 | 7,301,567 | 10/636,216 | 7,274,485 |
| 7,139,084 | 7,173,735 | 7,068,394 | 7,286,182 | 7,086,644 |
| 7,250,977 | 7,146,281 | 7,023,567 | 7,136,183 | 7,083,254 |
| 6,796,651 | 7,061,643 | 7,057,758 | 6,894,810 | 6,995,871 |
| 7,085,010 | 7,092,126 | 7,123,382 | 7,061,650 | 10/853,143 |
| 11/225,158 | 11/544,764 | 11/293,804 | 11/293,794 | 11/293,828 |
| 11/482,978 | 11/640,356 | 11/679,786 | 10/760,254 | 11/014,764 |
| 11/014,763 | 11/014,748 | 11/014,747 | 11/014,761 | 11/014,760 |
| 11/014,757 | 11/014,714 | 7,249,822 | 11/014,762 | 11/014,724 |
| 11/014,723 | 11/014,756 | 11/014,736 | 11/014,759 | 11/014,758 |
| 11/014,725 | 11/014,739 | 11/014,738 | 11/014,737 | 11/014,726 |
| 11/014,745 | 11/014,712 | 7,270,405 | 11/014,751 | 11/014,735 |
| 11/014,734 | 11/014,719 | 11/014,750 | 11/014,749 | 7,249,833 |
| 11/014,769 | 11/014,729 | 11/014,743 | 11/014,733 | 11/014,754 |
| 11/014,755 | 11/014,765 | 11/014,766 | 11/014,740 | 7,284,816 |
| 7,284,845 | 7,255,430 | 11/014,744 | 11/014,741 | 11/014,768 |
| 11/014,767 | 11/014,718 | 11/014,717 | 11/014,716 | 11/014,732 |
| 11/014,742 | 11/097,268 | 11/097,185 | 11/097,184 | 11/293,820 |
| 11/688,863 | 11/688,864 | 11/688,865 | 11/688,866 | 11/741,766 |
| 11/482,982 | 11/495,819 | 11/677,049 | 11/014,722 | D528156 |
| 10/760,180 | 6,364,451 | 7,093,494 | 6,454,482 | 11/014,728 |
| 11/014,727 | D536031 | 7,237,888 | 10/760,214 | 10/962,413 |
| 10/962,427 | 7,261,477 | 7,225,739 | 10/962,402 | 10/962,425 |
| 10/962,428 | 7,191,978 | 10/962,426 | 10/962,409 | 10/962,417 |
| 10/962,403 | 7,163,287 | 7,258,415 | 10/962,523 | 7,258,424 |
| 10/962,410 | 11/223,262 | 10/853,270 | 6,485,123 | 6,378,990 |
| 6,425,658 | 6,488,361 | 6,814,429 | 6,471,336 | 6,457,813 |
| 6,540,331 | 6,454,396 | 6,464,325 | 6,443,559 | 6,435,664 |

-continued

| | | | | |
|---|---|---|---|---|
| 6,412,914 | 6,488,360 | 6,550,896 | 6,439,695 | 6,447,100 |
| 09/900,160 | 6,488,359 | 7,044,589 | 6,416,154 | 6,547,364 |
| 6,644,771 | 6,565,181 | 6,857,719 | 6,702,417 | 6,918,654 |
| 6,652,078 | 6,623,108 | 6,625,874 | 6,921,153 | 6,536,874 |
| 6,425,651 | 6,435,667 | 6,527,374 | 6,582,059 | 6,513,908 |
| 6,540,332 | 6,547,368 | 6,679,584 | 6,857,724 | 6,652,052 |
| 6,672,706 | 6,588,886 | 7,207,654 | 6,935,724 | 6,927,786 |
| 6,916,082 | 6,978,990 | 7,285,170 | 7,066,580 | 6,984,023 |
| 7,059,706 | 7,185,971 | 7,090,335 | 6,739,701 | 7,008,503 |
| 10/636,274 | 6,792,754 | 6,860,107 | 6,786,043 | 6,866,369 |
| 6,886,918 | 6,827,427 | 6,918,542 | 7,007,852 | 6,988,840 |
| 6,984,080 | 6,863,365 | 7,524,016 | 12/014,772 | 11/246,687 |
| 12/062,514 | 12/062,517 | 12/062,518 | 7,819,515 | 7,891,794 |
| 12/062,522 | 7,891,788 | 12/062,524 | 7,878,635 | 12/062,526 |
| 7,874,662 | 12/062,528 | 7,878,639 | 7,891,795 | 7,878,640 |
| 12/192,116 | 7,883,189 | 12/192,118 | 12/192,119 | 7,887,148 |
| 7,887,170 | | | | |

BACKGROUND OF INVENTION

Most inkjet printers have a scanning or reciprocating printhead that is repeatedly scanned or reciprocated across the printing width as the media incrementally advances along the media feed path. This allows a compact and low cost printer arrangement. However, scanning printhead based printing systems are mechanically complex and slow in light of accurate control of the scanning motion and time delays from the incremental stopping and starting of the media with each scan.

Media width printheads resolve this issue by providing a stationary printhead spanning the media. Such media width printers offer high performance but the large array of inkjet nozzles in the media width printheads is difficult to maintain. For example, there is a need to maintain the printheads which becomes exceptionally difficult when the array of nozzles is as long as the media is wide. Further, the maintenance stations typically need to be located offset from the printheads so as not to interfere with media transport.

Some previous systems move the printheads to the servicing stations when not printing. However, when a printhead is returned to its operative position its alignment for correct printing is prone to drift until eventually visible artifacts demand hardware and/or software mechanisms to realign the printhead. In other previous systems, the service stations translate from their offset position to service the printheads while the printheads are raised sufficiently above the media path. Both of these system designs suffer from drawbacks of large printer width dimensions, complicated design and control, and difficulty in maintaining printhead alignment. Further, these systems add size to the printer. Thus, there is a need to have a media wide printhead maintenance solution that is simpler, more compact and more effective for media wide printing systems.

Further, the high media transport speeds used in such media width printers have typically lead to more complex media transport systems in the printers, due to the need to minimize media feed errors. Thus, there is a need to have a media transport solution that is simpler and more reliable for media wide printing systems.

SUMMARY OF INVENTION

In one aspect, the invention provides a maintenance system for a printhead, the system comprising:

a sled slidably arranged with respect to the printhead;

a media platen module supported by the sled;

a capper module supported by the sled;

a wiper module supported by the sled; and a selection mechanism for selectively sliding the sled to align one of the platen, capper and wiper modules with the printhead, and for moving the aligned module to a position in proximity of the printhead.

Optionally, the platen, capper and wiper modules are serially arranged on the sled.

Optionally, the printhead is a media width printhead and the platen, capper and wiper modules each have a length corresponding to the media width.

Optionally, the selection mechanism comprises a rack and pinion mechanism for the selective sliding of the sled.

Optionally, the rack and pinion mechanism comprises a rack on each end of the sled corresponding to each end of the platen, capper and wiper modules, and a pinion gear on each end of a shaft so as to each couple with a corresponding one of the racks and a motor.

Optionally, the selection mechanism further comprises a sensor for sensing a position of the platen, capper and wiper modules.

Optionally, the selection mechanism further comprises a controller connected to the sensor and motor.

Optionally, the controller controls operation of the motor in response to a sensing result output by the sensor.

Optionally, the selection mechanism comprises a lift mechanism for said movement of the aligned module, the lift mechanism comprising a lift arm for engaging with the aligned module and a motor for causing the lift arm to lift and lower the engaged module, the lifted position being in proximity of the printhead.

Optionally, the lift mechanism further comprises a cam engaged with the motor, the cam arranged to be engaged and disengaged with the lift arm to cause said lifting and lowering of the engaged module.

Optionally, the lift mechanism further comprises a spring attached to the lift arm for biasing the lift arm to the lowered position.

In another aspect, the invention provides a printer comprising:

a media width printhead;

a sled slidably arranged with respect to the printhead;

a media platen module supported by the sled;

a capper module supported by the sled;

a wiper module supported by the sled; and a selection mechanism for selectively sliding the sled to align one of the platen, capper and wiper modules with the printhead, and for moving the aligned module to a position in proximity of the printhead.

Optionally, the platen, capper and wiper modules are serially arranged on the sled.

Optionally, the printhead is a media width printhead and the platen, capper and wiper modules each have a length corresponding to the media width.

Optionally, the selection mechanism comprises a rack and pinion mechanism for the selective sliding of the sled.

Optionally, the rack and pinion mechanism comprises a rack on each end of the sled corresponding to each end of the platen, capper and wiper modules, and a pinion gear on each end of a shaft so as to each couple with a corresponding one of the racks and a motor.

Optionally, the selection mechanism further comprises a sensor for sensing a position of the platen, capper and wiper modules.

Optionally, the selection mechanism further comprises a controller connected to the sensor and motor.

Optionally, the controller controls operation of the motor in response to a sensing result output by the sensor.

Optionally, the selection mechanism comprises a lift mechanism for said movement of the aligned module, the lift mechanism comprising a lift arm for engaging with the aligned module and a motor for causing the lift arm to lift and lower the engaged module, the lifted position being in proximity of the printhead.

Optionally, the lift mechanism further comprises a cam engaged with the motor, the cam arranged to be engaged and disengaged with the lift arm to cause said lifting and lowering of the engaged module.

Optionally, the lift mechanism further comprises a spring attached to the lift arm for biasing the lift arm to the lowered position.

In another aspect, the invention provides method of maintaining a printhead, the method comprising:

when printing with the printhead, translating a modular sled relative to the printhead so as to align a media platen module supported by the sled with the printhead;

after printing with the printing, translating the sled relative to the printhead so as to align a wiper module supported by the sled with the printhead and operating a wiper roller of the wiper module so as to wipe a printing face of the printhead; and after said wiping and prior to commencement of printing with the printhead, translating the sled relative to the printhead so as to align a capper module supported by the sled with the printhead so as to cap the printing face of the printhead.

Optionally, the printhead is a media width printhead and the platen, capper and wiper modules each have a length corresponding to the media width.

Optionally, the sled is translated by operation of a pinion gear on a rack of the sled.

Optionally, the sled comprises a rack on each end of the sled corresponding to each end of the platen, capper and wiper modules, and a pinion gear on each end of a shaft so as to each couple with a corresponding one of the racks and a motor.

Optionally, the method further comprises sensing with a sensor a position of the platen, capper and wiper modules relative to the printhead.

Optionally, the method further comprises displacing each aligned module relative to the sled to place the aligned module in proximity of the printhead.

In another aspect, the invention provides a printing assistance apparatus for a printhead, the apparatus comprising:

a platen for supporting media during printing on the media by the printhead; and a wick element positioned within the platen, the wick element being formed of porous material so that fluid on said platen is transferred from the platen by wicking to the porous material.

Optionally, the printhead is a media width printhead and the platen and wick element each have a length greater than the media width.

Optionally, the platen comprises a slot having a longitudinal length along the media width, the wick element being located in the slot.

Optionally, the wick element is removably clipped within the slot.

Optionally, the platen comprises datum elements which contact the printhead so that a surface of the platen which supports the media is spaced from fluid ejection nozzles of the printhead by a first distance, the wick element being positioned within the platen so that wick element is spaced from the nozzles by a second distance greater than the first distance.

Optionally, the porous material of the wick element is hydrophilic polyethylene.

In another aspect, the invention provides a printing assistance apparatus for a media width printhead, the apparatus comprising:

an elongate platen having a surface for supporting media across the media width during printing on the media by fluid ejection nozzles of the printhead; and a wick element positioned within the platen for wicking fluid ejected by the nozzles from said supporting surface, the wick element having an elongate body positioned within the platen and a plurality of pads projecting from the body along the longitudinal length body toward the printhead, the pads being separated by notches.

Optionally, the wick element is formed of porous material.

Optionally, the platen comprises a slot having a longitudinal length along the media width, the wick element being located in the slot.

Optionally, the wick element is removably clipped within the slot.

Optionally, the platen comprises datum elements which contact the printhead so that the supporting surface is spaced from the nozzles by a first distance, the wick element being positioned within the platen so that wick element is spaced from the nozzles by a second distance greater than the first distance.

In another aspect, the invention provides a printing assistance apparatus for a media width printhead, the printhead having a plurality of rows of fluid ejection nozzles extending along the media width, the apparatus comprising:

an elongate platen having a surface for supporting media across the media width as the media travels past the printhead along a media travel direction, the platen having an elongate slot along the media width;

a wick element positioned within the slot for wicking fluid ejected by the nozzles from said supporting surface; and an alignment mechanism for aligning the platen with the printhead so that the opposed longitudinal edges of the slot are respectively positioned upstream and downstream of the media travel direction with respect to a centerline along the length the nozzle rows with the upstream edge being closer to the centerline than the downstream edge such that an upstream surface area of the wick element is less than a downstream surface area of the wick element Optionally, the wick element is formed of porous material.

Optionally, the wick element is removably clipped within the slot.

Optionally, the platen comprises datum elements which contact the printhead so that the supporting surface is spaced from the nozzles by a first distance, the wick element being positioned within the slot so that wick element is spaced from the nozzles by a second distance greater than the first distance.

In another aspect, the invention provides a system for shaping media for printing by a media width printhead, the system comprising:

a media width printhead having a plurality of fluid ejection nozzles defining a media width print zone;

input rollers disposed relative to the printhead so as to transport media into the print zone at an angle to a plane parallel with the print zone;

output rollers disposed relative to the printhead so as to transport media out of the print zone at an angle to a plane parallel with the print zone; and an elongate platen for supporting and shaping the media as the media is transported through the print zone, the platen having a series of upstream ribs disposed upstream of the print zone with respect to the media transport direction and a series of downstream ribs disposed downstream of the print zone with respect to the media transport direction, wherein the ribs are configured so that the transported media adopts a constrained curved path past the nozzles through contact with the ribs in the print zone.

Optionally, the platen comprises a slot having a longitudinal length along the media width, the upstream ribs being disposed on the upstream side of the slot and the downstream ribs being disposed on the downstream side of the slot.

Optionally, an outer surface of each of the upstream ribs is angled with respect to said parallel plane such that a portion of each of the upstream ribs closest to the slot is closer to the printhead than a portion of each of the upstream ribs furthest from the slot.

Optionally, an outer surface of each of the downstream ribs is angled with respect to said parallel plane such that a portion of each of the downstream ribs closest to the slot is closer to the printhead than a portion of each of the downstream ribs furthest from the slot.

Optionally, the input and output rollers are relatively disposed so that upstream and downstream angles to said parallel plane are about 10° to 12°.

Optionally, the platen comprises datum elements which contact the printhead so that the upstream and downstream ribs are spaced from the nozzles.

Optionally, the ribs are periodically positioned along the elongate length of the platen and are each aligned with the media transport direction along their respective length.

Optionally, the platen is formed of a molded plastics material body and the ribs are integrally molded in the body.

In another aspect, the invention provides a method of shaping media for printing by a media width printhead, the method comprising:

transporting media into a print zone defined by a plurality of fluid ejection nozzles of the printhead with input rollers at an angle to a plane parallel with the print zone;

transporting media out of the print zone with output rollers at an angle to said parallel plane; and supporting and shaping the media as the media is transported through the print zone with an elongate platen, the platen having a series of upstream ribs disposed upstream of the print zone with respect to the media transport direction and a series of downstream ribs disposed downstream of the print zone with respect to the media transport direction, wherein the ribs are configured so that the transported media is in contact with the ribs in the print zone and adopts a constrained curved path past the nozzles.

Optionally, the platen comprises a slot having a longitudinal length along the media width, the upstream ribs being disposed on the upstream side of the slot and the downstream ribs being disposed on the downstream side of the slot.

Optionally, an outer surface of each of the upstream ribs is angled with respect to said parallel plane such that a portion of each of the upstream ribs closest to the slot is closer to the printhead than a portion of each of the upstream ribs furthest from the slot.

Optionally, an outer surface of each of the downstream ribs is angled with respect to said parallel plane such that a portion of each of the downstream ribs closest to the slot is closer to the printhead than a portion of each of the downstream ribs furthest from the slot.

Optionally, the media is transported into the print zone so that a leading edge of the media contacts the outer surfaces of the upstream ribs, is guided towards the printhead along the outer surfaces, then passes over the slot and through the print zone of the nozzles, at which point the media bends in a cantilevered fashion such that only point-contact with said closest portions of the upstream ribs is made by the remaining portions of the media.

Optionally, the media is transported through the print zone so that the leading edge of the media then point-contacts said closest portions of the downstream ribs to bridge the slot and then leaves contact with the downstream ribs to be presented to the output rollers so that the media is stably cantilevered at its point-contact with the upstream ribs.

Optionally, the media is transported out of the print zone so that a trailing edge of the media leaves the input rollers, transitions from the upstream ribs to the downstream ribs, and the leaves the print zone.

In another aspect, the invention provides a maintenance apparatus for a printhead, the apparatus comprising:

a rotatable shaft;

a porous material about the shaft; and a mechanism for rotating the shaft so that the porous material rotates against the printhead, the porous material being configured to absorb fluid from the printhead during said rotation.

Optionally, the mechanism comprises a gear train rotatably mounted within a swing arm pivotally mounted to one end of the shaft.

Optionally, the apparatus further comprises a sled and a wiper module supported by the sled, the shaft being rotatably mounted in the wiper module.

Optionally, the apparatus further comprises a lift mechanism for lifting the wiper module from the sled to position the porous material in proximity of the printhead.

Optionally, the apparatus further comprises a media transport roller for transporting media past the printhead, the media transport roller having a gear which operatively contacts the gear train of the swing arm as the wiper module is lifted from the sled such that rotation of the media transport roller causes rotation of the shaft.

Optionally, the wiper module is arranged so that the gear train contacts the media transport roller gear to commence rotation of the shaft when the wiper module is remote from the printhead.

Optionally, the swing arm is configured to pivot relative to the wiper module so that the gear train remains in contact with the media transport roller gear independent of the lifted position of the wiper module.

Optionally, the apparatus further comprises a compressible core mounted to the shaft, the porous material being provided over the core, wherein the lift mechanism is configured to position the porous material against the printhead so as to compress the compressible core.

Optionally, the core is formed of extruded closed-cell foam.

Optionally, the porous material is formed of non-woven microfiber.

Optionally, the non-woven microfiber is wrapped about the core by a spiraling technique so that at least two layers of the microfiber are present about the core with an adhesive between the layers.

Optionally, the apparatus further comprises a hydrophobic film is disposed between the core and the porous material.

Optionally, the film is formed of a pressure sensitive adhesive.

In another aspect, the invention provides a maintenance system for a printhead, the system comprising:

a sled;

a wiper module supported by the sled, the wiper module comprising a rotatable shaft and a porous material about the shaft;

a lift mechanism for lifting the wiper module from the sled to position the porous material against the printhead;

a rotation mechanism for rotating the shaft so that the porous material rotates against the printhead, the porous material being configured to absorb fluid from the printhead during said rotation; and a sliding mechanism for sliding the sled relative to the printhead so that the rotating porous material is wiped across the printhead.

Optionally, the rotation mechanism comprises a gear train rotatably mounted within a swing arm pivotally mounted to one end of the shaft.

Optionally, the rotation mechanism further comprises a media transport roller for transporting media past the printhead, the media transport roller having a gear which operatively contacts the gear train of the swing arm as the wiper module is lifted from the sled by the lift mechanism such that rotation of the media transport roller causes rotation of the shaft.

Optionally, the swing arm is configured to pivot relative to the wiper module so that the gear train remains in contact with the media transport roller gear independent of the lifted position of the wiper module.

Optionally, the sliding mechanism comprises a rack on each end of the sled corresponding to each end of the wiper module, and a pinion gear on each end of a shaft so as to each couple with a corresponding one of the racks and a motor.

Optionally, the wiper module further comprises a compressible core mounted to the shaft, the porous material being provided over the core; and the lift mechanism is configured to position the porous material against the printhead so as to compress the compressible core.

Optionally, the core is formed of extruded closed-cell foam.

Optionally, the porous material is formed of non-woven microfiber.

Optionally, the non-woven microfiber is wrapped about the core by a spiraling technique so that at least two layers of the microfiber are present about the core with an adhesive between the layers.

Optionally, a hydrophobic film is disposed between the core and the porous material.

Optionally, the film is formed of a pressure sensitive adhesive.

In another aspect, the invention provides a method of wiping a printhead, the method comprising:

controlling a lift mechanism to lift a wiper module from a supporting sled to position a porous material of the wiper module against the printhead;

controlling a rotation mechanism to rotate a shaft of the wiper module about which the porous material is provided so that the porous material rotates against the printhead, the porous material being configured to absorb fluid from the printhead during said rotation; and controlling a sliding mechanism to slide the sled relative to the printhead so that the rotating porous material is wiped across the printhead.

Optionally, the rotation mechanism is controlled so that a gear train rotatably mounted within a swing arm pivotally mounted to one end of the shaft contacts a media transport roller for transporting media past the printhead, the media transport roller having a gear which operatively contacts the gear train of the swing arm as the wiper module is lifted from the sled by the lift mechanism such that rotation of the media transport roller causes rotation of the shaft.

Optionally, the swing arm is configured to pivot relative to the wiper module so that the gear train remains in contact with the media transport roller gear independent of the lifted position of the wiper module.

Optionally, the sliding mechanism is controlled by operating a motor to rotate a pinion gear on each end of a shaft along a rack on each end of the sled corresponding to each end of the wiper module.

Optionally, the lift mechanism is controlled to compress a compressible core to the shaft of the wiper module against the printhead.

In another aspect, the invention provides a maintenance apparatus for a printhead, the apparatus comprising:

a porous member for rotatably contacting the printhead to absorb particulates from the printhead; and a scraper for contacting the porous member to remove the absorbed particulates from the porous member during said rotation.

Optionally, the printhead is a media width printhead, and the porous member and the scraper are elongate with a longitudinal length of at least the media width.

Optionally, the porous member is rotatably mounted to a wiper module supported by a sled and the scraper is removably mounted to the wiper module.

Optionally, the scraper is clipped to the wiper module.

Optionally, the scraper is mounted to the wiper module so that the scraper contacts the porous member on a vertical circumferential region of the porous member below the upper circumferential region of the porous member which contacts the printhead.

Optionally, the scraper is disposed at a sloped angle relative to the porous member such that the sloped scraper contacts the porous member at a tangent to the circumference of the porous member.

Optionally, the wiper module comprises compressible core mounted to a rotatable shaft, the porous member being provided over the core.

Optionally, the porous member is formed of non-woven microfiber.

Optionally, the non-woven microfiber is wrapped about the core by a spiraling technique so that at least two layers of the microfiber are present about the core with an adhesive between the layers.

Optionally, the apparatus further comprises a hydrophobic film is disposed between the core and the porous material.

Optionally, the film is formed of a pressure sensitive adhesive.

Optionally, the scraper is mounted to the wiper module so that contact pressure is exerted on the compressible core.

Optionally, the scraper is resiliently flexible.

Optionally, the scraper is a resiliently flexible sheet of Mylar.

In another aspect, the invention provides a maintenance apparatus for a printhead, the apparatus comprising:

a seal for sealing against a surface of the printhead which has fluid ejection nozzles, the seal being configured to form a sealed space about said nozzles; and a porous material positioned within the seal to be in proximity of said nozzles in the sealed space, fluid egested by said nozzles contacting, and being transferred to, the porous material in the sealed space.

Optionally, the seal is formed of a resilient material.

Optionally, the apparatus further comprises a capper module having a body on which the seal is mounted and in which the porous material is disposed.

optionally, sidewalls of the seal have a wave profile with a lower section of the sidewalls defining a groove configured to be held over a ridge of the body of the capper module and an upper section of the sidewalls defining a cantilevered beam terminating at a free outer surface such that pressing contact of the outer surface against the surface of the printhead causes bending of the cantilevered beam Optionally, a base of the body has ribs on which a lower surface of the porous material is supported.

Optionally, the porous material is a hydrophilic polyethylene.

In another aspect, the invention provides a maintenance apparatus for a media width printhead, the printhead having a plurality of rows of fluid ejection nozzles extending along the media width for ejecting fluid onto media as the media travels past the printhead along a media travel direction, the apparatus comprising:

a seal for sealing against a surface of the printhead having the nozzle rows, the seal being configured to form a sealed space about the nozzle rows; and a wick element positioned within the seal for wicking fluid ejected by the nozzles from the sealed space, the wick element having an outer surface sloped in the media travel direction; and an alignment mechanism for aligning the seal with the printhead so that a portion of the sloped outer surface of the wick element closest to the printhead is positioned upstream of the media travel direction with respect to a centerline along the length the nozzle rows and a portion of the sloped outer surface of the wick element furthest from the printhead is positioned downstream of the media travel direction.

Optionally, the seal is formed of a resilient material.

Optionally, the apparatus further comprises a capper module having a body on which the seal is mounted and in which the porous material is disposed.

Optionally, sidewalls of the seal have a wave profile with a lower section of the sidewalls defining a groove configured to be held over a ridge of the body of the capper module and an upper section of the sidewalls defining a cantilevered beam terminating at a free outer surface such that pressing contact of the outer surface against the surface of the printhead causes bending of the cantilevered beam Optionally, a base of the body has ribs on which a lower surface of the porous material is supported.

Optionally, the porous material is a hydrophilic polyethylene.

In another aspect, the invention provides a method of maintaining a printhead comprising the steps of:

bringing a porous material within a predetermined distance from fluid ejection nozzles of the printhead at a non-printing phase of the printhead; and holding the porous material at said predetermined distance during said non-printing phase, wherein the predetermined distance is selected to allow a fluid flow path to form between the nozzles and porous material which causes transfer of fluid egested by the nozzles to the porous material and then induces the flow path to break off.

Optionally, the predetermined distance between the porous material and the nozzles is about 1.1 millimeters.

Optionally, the porous material is brought to said predetermined distance by a lift mechanism.

Optionally, the porous material is arranged in a capping mechanism for capping the printhead.

Optionally, the capping mechanism comprises a seal for sealing against a surface of the printhead having said nozzles, the porous material being surrounded by the seal so as to be at said predetermined distance during said sealing.

Optionally, the porous material is held at said predetermined distance by the lift mechanism.

In another aspect, the invention provides a maintenance apparatus for a printhead, the apparatus comprising:

a first porous member for contacting the printhead to absorb fluid from the printhead; and a second porous member for contacting the first porous member to absorb fluid from the first porous member.

Optionally, the apparatus further comprises a sled and a wiper module supported by the sled, the first porous member being mounted in the wiper module and the second porous member being mounted in the sled.

Optionally, the apparatus further comprises a lift mechanism for lifting the wiper module from the sled to position the first porous member in proximity of the printhead.

Optionally, the second porous member has a plurality of towers projecting from a pad held within a channel of the sled, the towers being arranged to contact the first porous member when the wiper module is in a non-lifted position within the sled.

Optionally, the towers are configured to project through windows in the wiper module when the wiper module is in the non-lifted position within in the sled.

Optionally, the first porous member is mounted on a compressible core and the towers are configured to compress the first porous member during said contact so that fluid held by the first porous member is wicked to the towers and into the pad.

Optionally, the compressible core is mounted on a rotatable shaft within the wiper module, the apparatus comprising a mechanism for rotating the shaft so that the first porous member rotates against the printhead when the wiper module is in the lifted position.

Optionally, the lift mechanism is configured to position the first porous member against the printhead so as to compress the compressible core.

In another aspect, the invention provides a maintenance system for a printhead, the system comprising:

an ingestion member for ingesting waste fluid from the printhead; and a container for containing said ingested waste fluid, the container being flexible so as to expand as an amount of contained waste fluid increases.

Optionally, the container is positioned within a body of a printer having the printhead between a media input area and a printed media output area.

Optionally, the container is a modular assembly of fluid containing modules.

Optionally, each module is formed of flexible, collapsible material so as to define expandable bags which are substantially flat when empty of fluid and are expanded otherwise.

Optionally, the ingestion member is an absorbent material which fills each module.

Optionally, the absorbent material is a polymer which is a powder when dry and a stiff gel when wet.

Optionally, the modules are linked to each other by a wick element which provides capillary wicking paths between the modules.

In another aspect, the invention provides a printer comprising:

a printhead having a plurality of fluid ejection nozzles;

an ingestion member for ingesting waste fluid from the printhead; and a container for containing said ingested waste fluid, the container being flexible so as to expand as an amount of contained waste fluid increases.

Optionally, the container is positioned within a body of a printer having the printhead between a media input area and a printed media output area.

Optionally, the container is a modular assembly of fluid containing modules.

Optionally, each module is formed of flexible, collapsible material so as to define expandable bags which are substantially flat when empty of fluid and are expanded otherwise.

Optionally, the ingestion member is an absorbent material which fills each module.

Optionally, the absorbent material is a polymer which is a powder when dry and a stiff gel when wet.

Optionally, the modules are linked to each other by a wick element which provides capillary wicking paths between the modules.

In another aspect, the invention provides a media clearance mechanism for a printer, the media clearance mechanism comprising:

a door hingedly mounted to a body of the printer which can be opened to expose a media width of a media path to a media width printhead of the printer;

a media diverter mounted to the door such that when the door is in a closed position the door and the diverter define guiding portions of the path, the diverter being pivotally mounted to the door so that the diverter pivots out of the way upon opening of the door; and a displacement mechanism configured to retract the diverter with the opening movement of the door and to reposition the diverter for media guiding with the closing movement of the door.

Optionally, the media path is a curved media path from a media input area to the printhead of the printer.

Optionally, the displacement mechanism comprises slots within sidewalls at either end of the door and tracking pins on arms at either end of the diverter, the slots having a serpentine form and the tracking pins engaging with the respective slots thereby connecting the diverter to the door Optionally, the serpentine form of each slot has two inflection points, with the inflection point which is directed towards the media path being upstream of the inflection point which is directed away from the media path with respect to a media travel direction along the media path.

Optionally, pivot pins project from each of the sidewalls of the door at the outer side of the downstream inflection points of each slot and the free end of each arm has a yoke which engages with the respective pivot pin as the diverter tracks along the slots.

In another aspect, the invention provides a printer comprising:

a media width printhead;

a media path from a media input area to the printhead;

a door hingedly mounted to a body of the printer which can be opened to expose the media path;

a media diverter mounted to the door such that when the door is in a closed position the door and the diverter define guiding portions of the path, the diverter being pivotally mounted to the door so that the diverter pivots out of the way upon opening of the door; and a displacement mechanism configured to retract the diverter with the opening movement of the door and to reposition the diverter for media guiding with the closing movement of the door.

Optionally, the media path is a curved media path.

Optionally, the displacement mechanism comprises slots within sidewalls at either end of the door and tracking pins on arms at either end of the diverter, the slots having a serpentine form and the tracking pins engaging with the respective slots thereby connecting the diverter to the door Optionally, the serpentine form of each slot has two inflection points, with the inflection point which is directed towards the media path being upstream of the inflection point which is directed away from the media path with respect to a media travel direction along the media path.

Optionally, pivot pins project from each of the sidewalls of the door at the outer side of the downstream inflection points of each slot and the free end of each arm has a yoke which engages with the respective pivot pin as the diverter tracks along the slots.

BRIEF DESCRIPTION OF DRAWINGS

The exemplary features, best mode and advantages of the invention will be understood by the description herein with reference to accompanying drawings, in which:

FIG. 4 is an exploded view of the printhead;

One of ordinary skill in the art will appreciate that the invention is not limited in its application to the details of construction, the arrangements of components, and the arrangement of steps set forth in the description herein and/or illustrated in the accompanying drawings. The invention is capable of other embodiments and of being practiced or being carried out in various other ways. Also, it is to be understood that the phraseology and terminology used herein is for the purpose of description and should not be regarded as limiting.

DETAILED DESCRIPTION OF EMBODIMENTS

Figure 1:
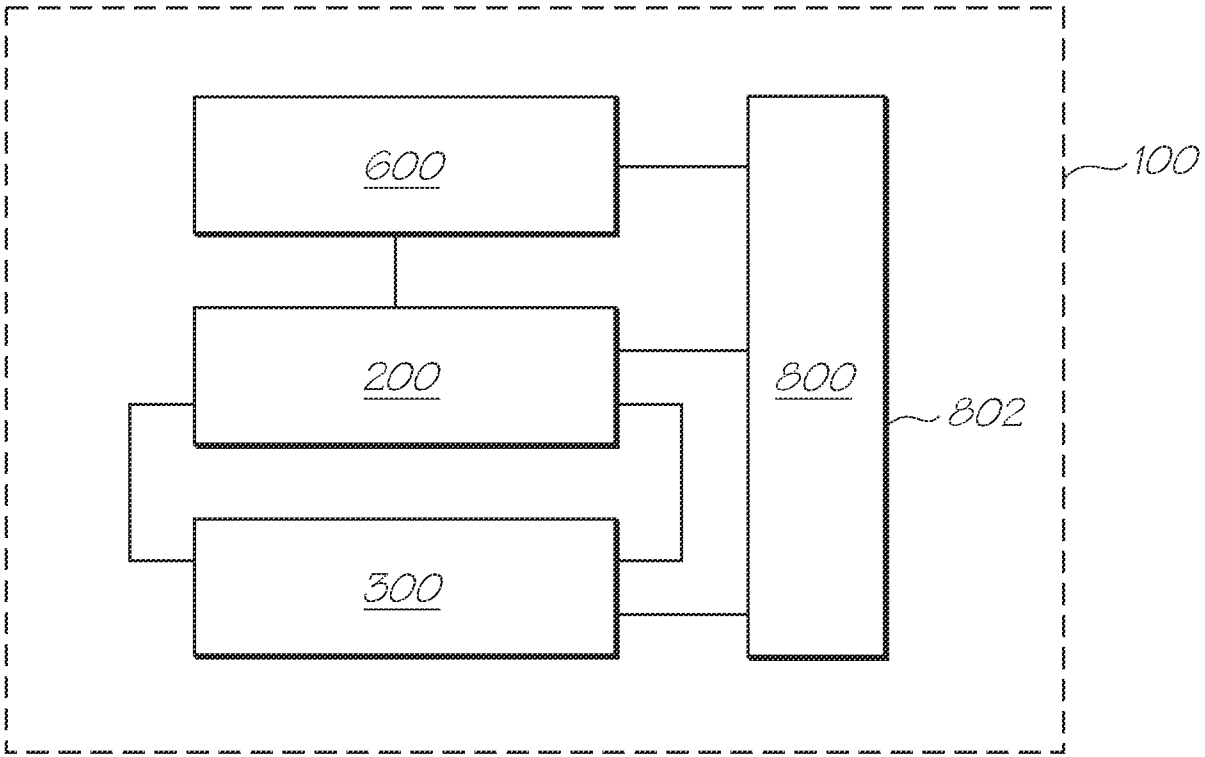
FIG. 1 is a block diagram of the main system components of a printer.
Figure 2:
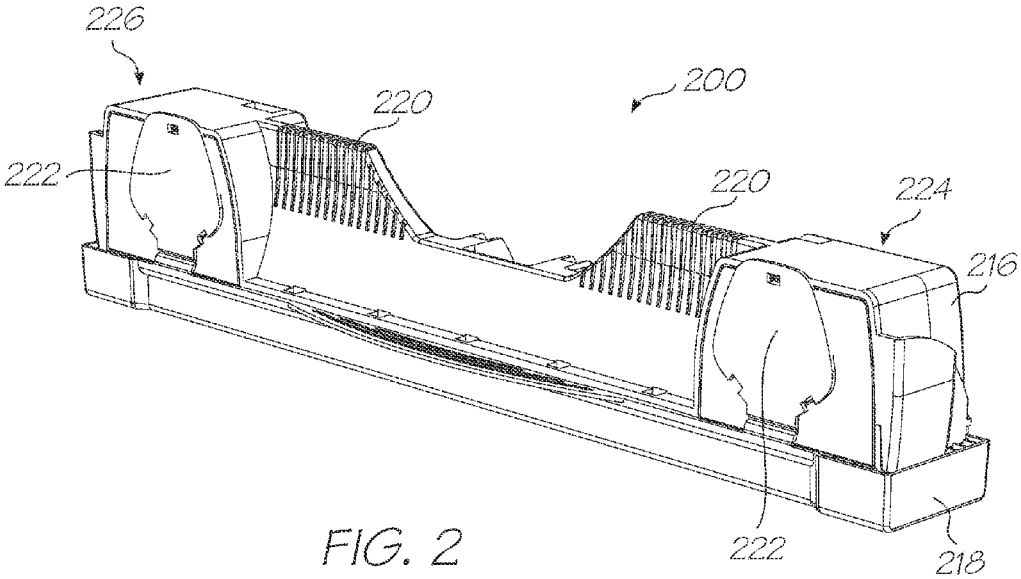
FIG. 2 is a perspective view of a printhead of the printer.

An exemplary block diagram of the main system components of a printer 100 is illustrated in FIG. 1. The printer 100 has a printhead 200, fluid distribution system 300, maintenance system 600 and electronics 800.

The printhead 200 has fluid ejection nozzles for ejecting printing fluid, such as ink, onto passing print media. The fluid distribution system 300 distributes ink and other fluids for ejection by the nozzles of the printhead 200. The maintenance system 600 maintains the nozzles of the printhead 200 so that reliable and accurate fluid ejection is provided.

The electronics 800 operatively interconnects the electrical components of the printer 100 to one another and to external components/systems. The electronics 800 has control electronics 802 for controlling operation of the connected components. An exemplary configuration of the control electronics 802 is described in US Patent Application Publication No. 20050157040, the contents of which are hereby incorporated by reference.

The printhead 200 may be provided as a media width printhead cartridge removable from the printer 100, as described in US Patent Application Publication No. 20090179940, the contents of which are hereby incorporated by reference. This exemplary printhead cartridge includes a liquid crystal polymer (LCP) molding 202 supporting a series of printhead ICs 204, as illustrated in FIGS. 2-5, which extends the width of media substrate to be printed. When mounted to the printer 100, the printhead 200 therefore constitutes a stationary, full media width printhead.

The printhead ICs 204 each comprise ejection nozzles for ejecting drops of ink and other printing fluids onto the passing media. The nozzles may be MEMS (micro electro-mechanical) structures printing at true 1600 dpi resolution (that is, a nozzle pitch of 1600 nozzles per inch), or greater. The fabrication and structure of suitable printhead ICs 204 are described in detail in US Patent Application Publication No. 20070081032, the contents of which are hereby incorporated by reference.

The LCP molding 202 has main channels 206 extending the length of the LCP molding 202 between associated inlet ports 208 and outlet ports 210. Each main channel 206 feeds a series of fine channels (not shown) extending to the other side of the LCP molding 202. The fine channels supply ink to the printhead ICs 204 through laser ablated holes in the die attach film via which the printhead ICs are mounted to the LCP molding, as discussed below.

Above the main channel 206 is a series of non-priming air cavities 214. These cavities 214 are designed to trap a pocket of air during printhead priming. The air pockets give the system some compliance to absorb and damp pressure spikes or hydraulic shocks in the printing fluid. The printers are high speed pagewidth or media width printers with a large number of nozzles firing rapidly. This consumes ink at a fast rate and suddenly ending a print job, or even just the end of a page, means that a column of ink moving towards (and through) the printhead 200 must be brought to rest almost instantaneously. Without the compliance provided by the air cavities 214, the momentum of the ink would flood the nozzles in the printhead ICs 204. Furthermore, the subsequent 'reflected wave' could otherwise generate sufficient negative pressure to erroneously deprime the nozzles.

The printhead cartridge has a top molding 216 and a removable protective cover 218. The top molding 216 has a central web for structural stiffness and to provide textured grip surfaces 220 for manipulating the printhead cartridge during insertion and removal with respect to the printer 100. Movable caps 222 are provided at a base of the cover and are movable to cover an inlet printhead coupling 224 and an outlet printhead coupling 226 of the printhead 200 prior to installation in the printer. The terms "inlet" and "outlet" are used to specify the usual direction of fluid flow through the printhead 200 during printing. However, the printhead 200 is configured so that fluid entry and exit can be achieved in either direction along the printhead 200.

Figure 3:
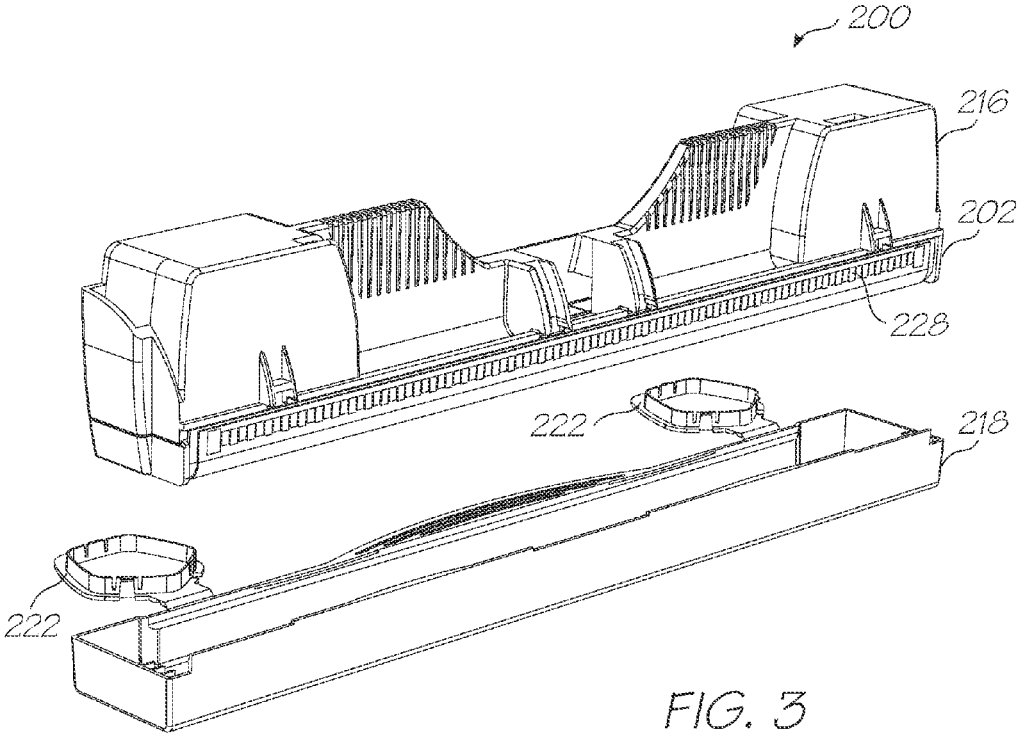
FIG. 3 illustrates the printhead with a cover removed.

The base of the cover 218 protects the printhead ICs 204 and electrical contacts 228 of the printhead prior to installation in the printer and is removable, as illustrated in FIG. 3, to expose the printhead ICs 204 and the contacts 228 for installation. The protective cover may be discarded or fitted to a printhead cartridge being replaced to contain leakage from residual ink therein.

The top molding 216 covers an inlet manifold 230 of the inlet coupling 224 and an outlet manifold 232 of the outlet coupling 226 together with shrouds 234, as illustrated in FIG. 4. The inlet and outlet manifolds 230,232 respectively have inlet and outlet spouts 236,238. Five each of the inlet and outlet ports or spouts 236,238 are shown in the illustrated embodiment of the printhead 200, which provide for five ink channels, e.g., CYMKK or CYMKIR. Other arrangements and numbers of the spouts are possible to provide different printing fluid channel configurations. For example, instead of a multi-channel printhead printing multiple ink colors, several printheads could be provided each printing one or more ink colors.

Each inlet spout 236 is fluidically connected to a corresponding one of the inlet ports 208 of the LCP molding 202. Each outlet spout 238 is fluidically connected to a corresponding one of the outlet ports 210 of the LCP molding 202. Thus, for each ink color, supplied ink is distributed between one of the inlet spouts 236 and a corresponding one of the outlet spouts 238 via a corresponding one of the main channels 206.

Figure 5:
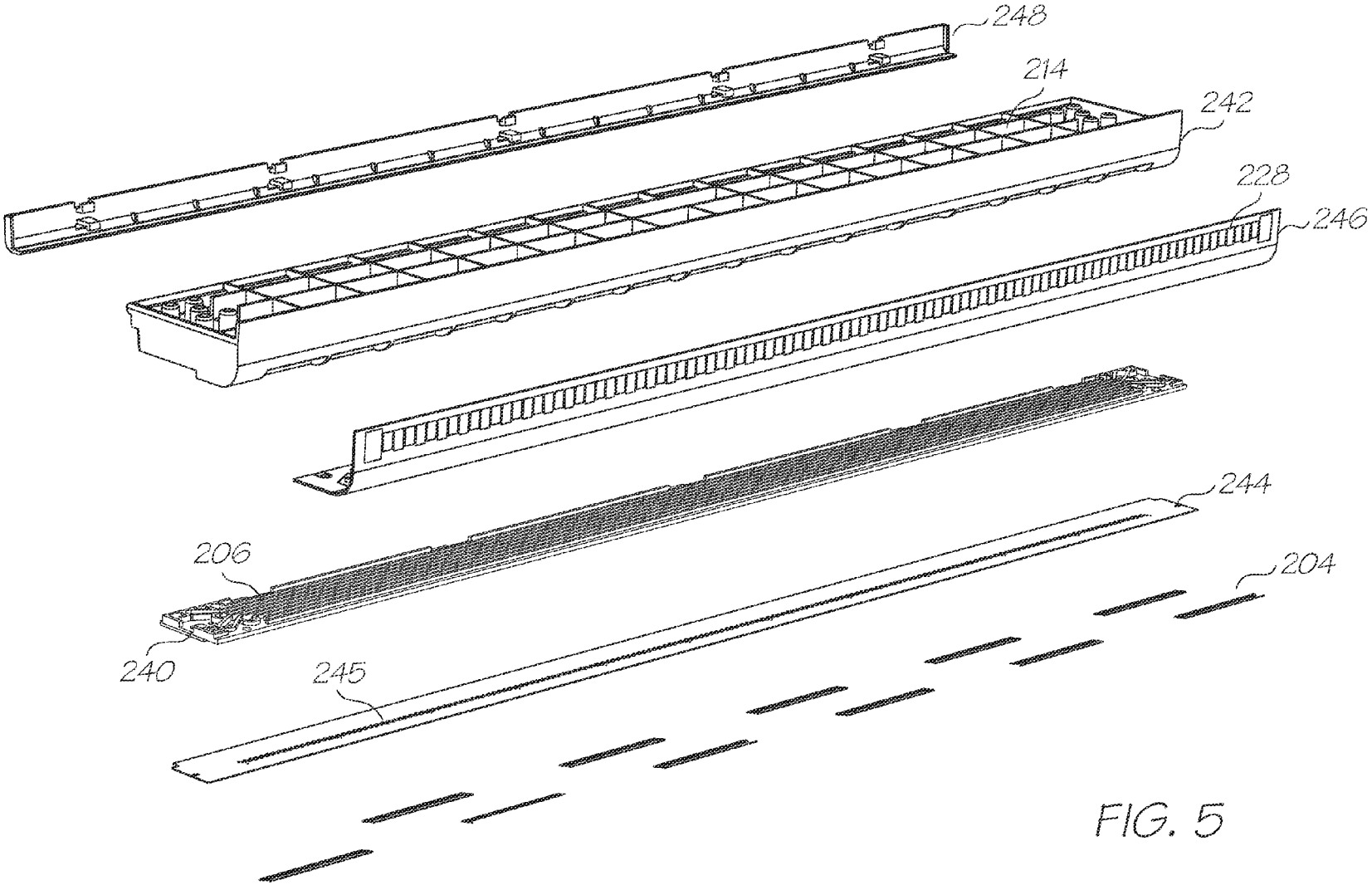
FIG. 5 is an exploded view of the printhead without inlet or outlet couplings.

From FIG. 5 it can be seen that the main channels 206 are formed in a channel molding 240 and the associated air cavities 214 are formed in a cavity molding 242. Adhered to the channel molding 240 is a die attach film 244. The die attach film 244 mounts the printhead ICs 204 to the channel molding 240 such that the fine channels, which are formed within the channel molding 240, are in fluid communication with the printhead ICs 204 via small laser ablated holes 245 through the film 244.

The channel and cavity moldings 240,244 are mounted together with a contact molding 246 containing the electrical contacts 228 for the printhead ICs and a clip molding 248 in order to form the LCP molding 202. The clip molding 248 is used to securely clip the LCP molding 202 to the top molding 216.

LCP is the preferred material of the molding 202 because of its stiffness, which retains structural integrity along the media width length of the molding, and its coefficient of thermal expansion which closely matches that of silicon used in the printhead ICs, which ensures good registration between the fine channels of the LCP molding 202 and the nozzles of the printhead ICs 204 throughout operation of the printhead 200. However, other materials are possible so long as these criteria are met.

The fluid distribution system 300 may be configured as described in the Applicant's U.S. Provisional Patent Application No. 61/345,552.

Figure 6:
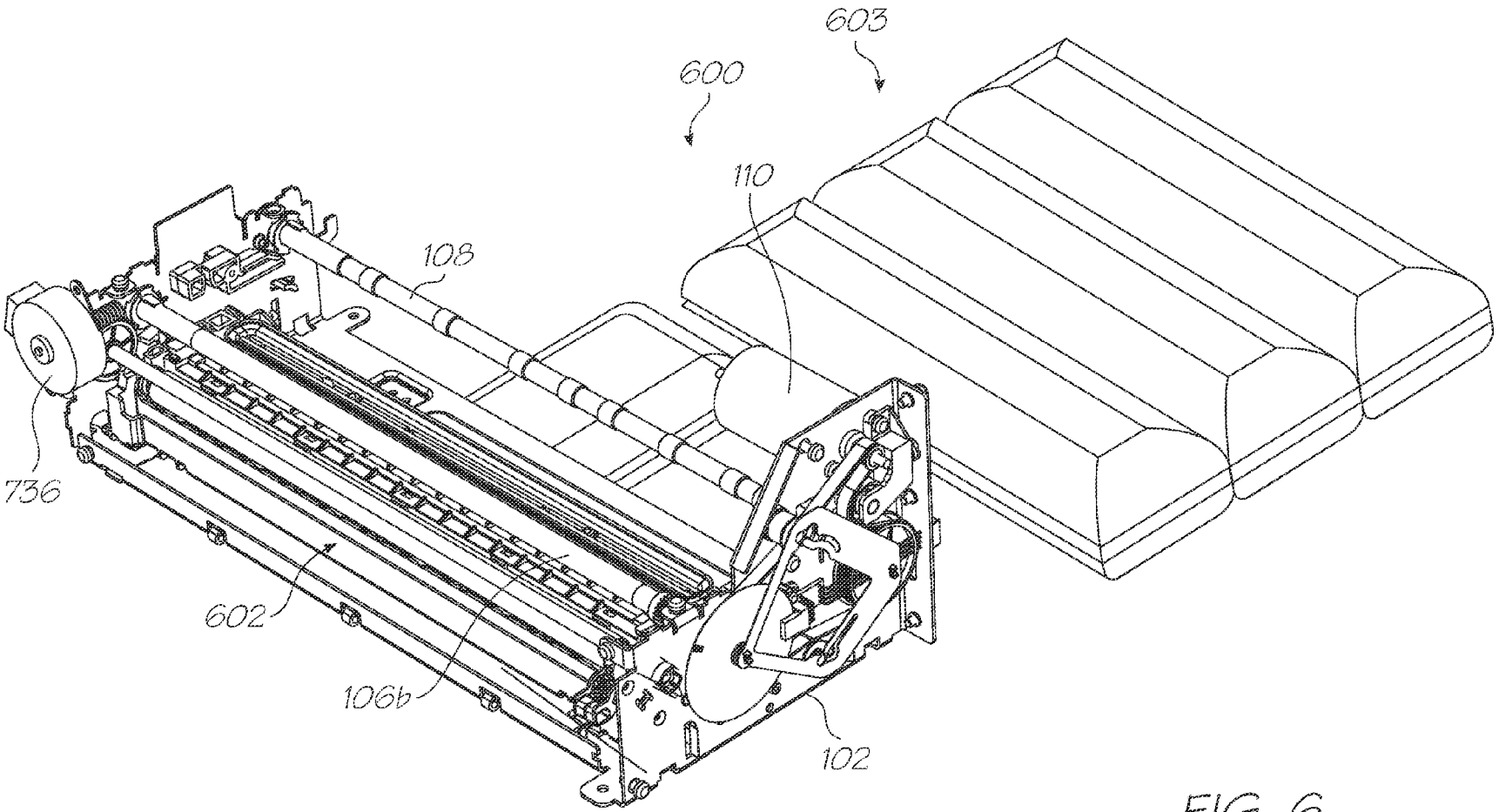
FIG. 6 illustrates an isometric view of the printer with most components other than those of a maintenance system for the printer omitted.
Figure 7:
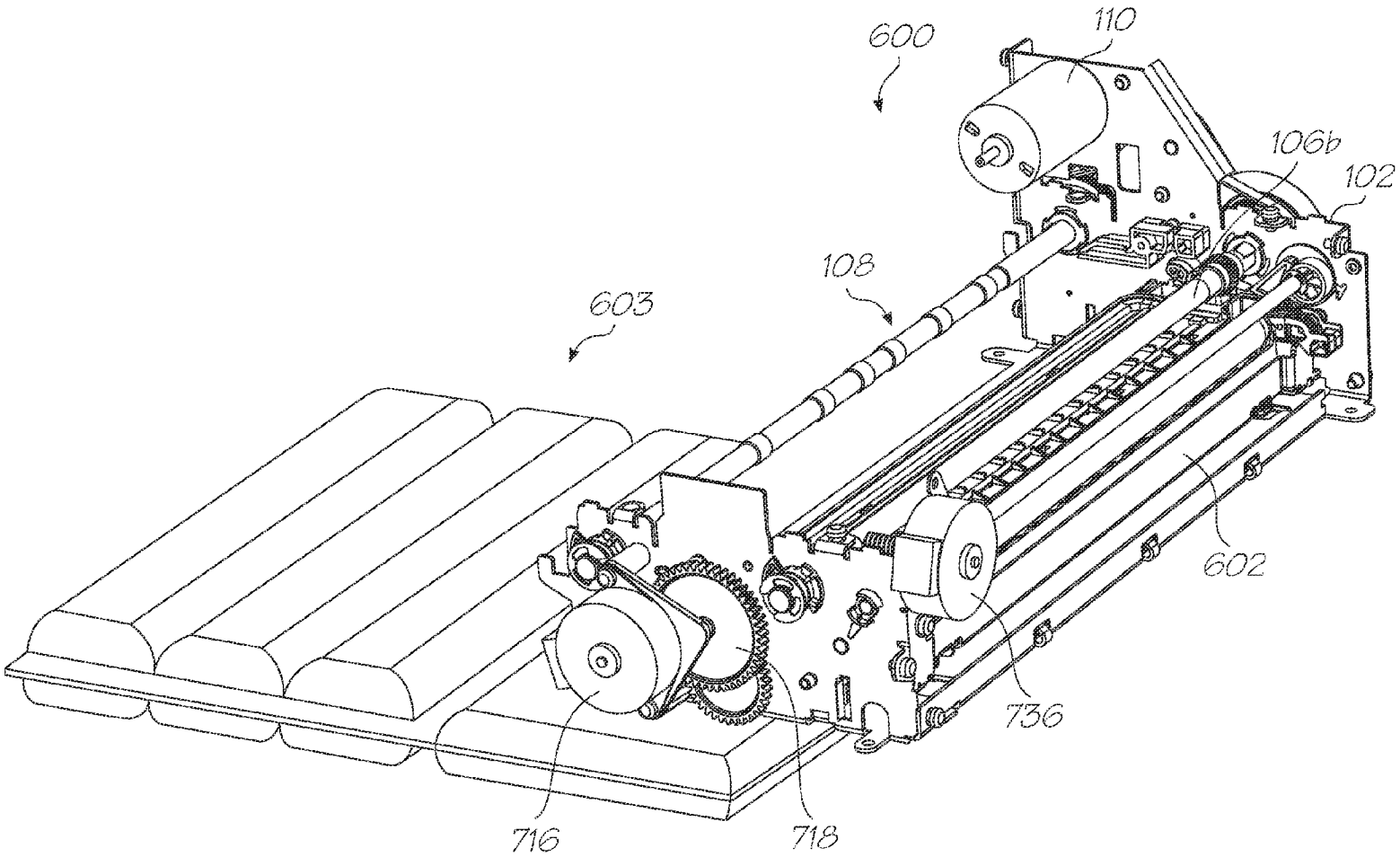
FIG. 7 illustrates an opposite isometric view of the printer as illustrated in FIG. 6.

The maintenance system 600 for maintaining the printhead 200 and the fluid distribution system 300 may be arranged relative to the printhead 200 as illustrated in FIGS. 6 and 7, which show the printer 100 with most components other than those of the maintenance system 600 omitted for clarity. Various embodiments of the maintenance system 600 and its various components are now described in detail.

The maintenance system 600 maintains the printhead 200, and thereby the fluid distribution system 300, in operational order throughout the operational life of the printhead 200.

After each print cycle of the printhead 200, and during periods of non-use of the printhead 200, the maintenance system 600 is used to cap the ejection nozzles of the printhead 200 so as to prevent drying of fluid within the nozzles. This reduces problems with subsequent printing due to blockages in the nozzles.

The maintenance system 600 is also used to clean a printing face of the printhead 200 by wiping the printhead ICs. Further, the maintenance system 600 is also used to capture fluid which the printhead 'spits' or egests from the nozzles during priming and maintenance cycles, for further details on the priming procedure see the incorporated description of the Applicant's U.S. Provisional Patent Application No. 61/345,552.

Further, the maintenance system 600 is also used to provide support for media during printing in a clean manner which minimizes fluid transfer onto the media.

Furthermore, the maintenance system 600 stores the ink and other printing fluids collected during these functions within the printer 100 for later disposal or re-use.

To achieve these functions, the maintenance system 600 employs a modular sled 602 and fluid collector 603. The sled 602 houses several maintenance modules each having a different function. In the illustrated embodiment of FIGS. 8 and 9, the maintenance modules include a platen module 604, a wiper module 606 and a capper module 608. The sled 602 is housed by a housing 102 of the printer 100 so as to be selectively displaceable relative to the printhead 200 and so that media 104 for printing is able to pass between the printhead 200 and the sled 602. Further, the maintenance modules are displaceable with respect to the sled. The displacement of the sled selectively aligns each of the maintenance modules with the printhead and the displacement of the aligned maintenance modules brings the aligned maintenance modules into operational position with respect to the printhead, which is discussed in detail later.

FIGS. 10-18 illustrate various exemplary aspects of the platen module 604. The platen module 604 is an assembly of a body 610 and a wick element 612. The body 610 is elongate so as extend along a length longer than the media width of the printhead 200. The platen module 602 is housed within an elongate frame 614 of the sled 602. The frame 614 has a base 618 and sidewalls 620 projecting from the base within which notches 620*a* are defined.

The notches 620*a* removably receive retainer elements 622 at the longitudinal ends of the body 610 of the platen module 604. This engagement of the notches and retainers allows the platen module 604 to be held by the frame 614 in an unsecured, yet constrained manner. That is, the platen module effectively "floats" within the sled, which facilitates the displacement of the platen module relative to the sled.

The platen module 604 is assembled in the frame 614 so that a platen surface 624 of the body 610 faces the printhead 200 which provides support for media being printed on as the media passes the printhead 200 when the platen module 604 is in its operational position.

In the embodiment illustrated in FIGS. 10-18, the platen 624 has a series of rib elements 626 and 628 periodically positioned on either side of a slot 630 which extends through the platen 624 along the elongate length of the platen module 604. When the platen module 604 is aligned with the printhead 200 through the selective displacement of the sled 602, the slot 630 is aligned with the nozzles. The body 610 of the platen module 604 is preferably formed of a molded plastics material, and the ribs 626,628 are preferably integrally molded in the body 610. However, other arrangements are possible, such as fixing the ribs to the platen body.

The narrow ribs 626,628 project from a surface 624*a* of the platen 624 to be aligned with the direction of media travel past the printhead 200 along their length and are configured to assist in guiding and shaping of the media within a print zone in the vicinity of the ejection nozzles of the printhead 200 when the platen module 604 is in its operational position. The guiding minimizes possibility of contact of the media with the printing face of the printhead 200, and the shaping minimizes a rate of change of spacing between different portions of the media and the nozzles.

Figure 16:
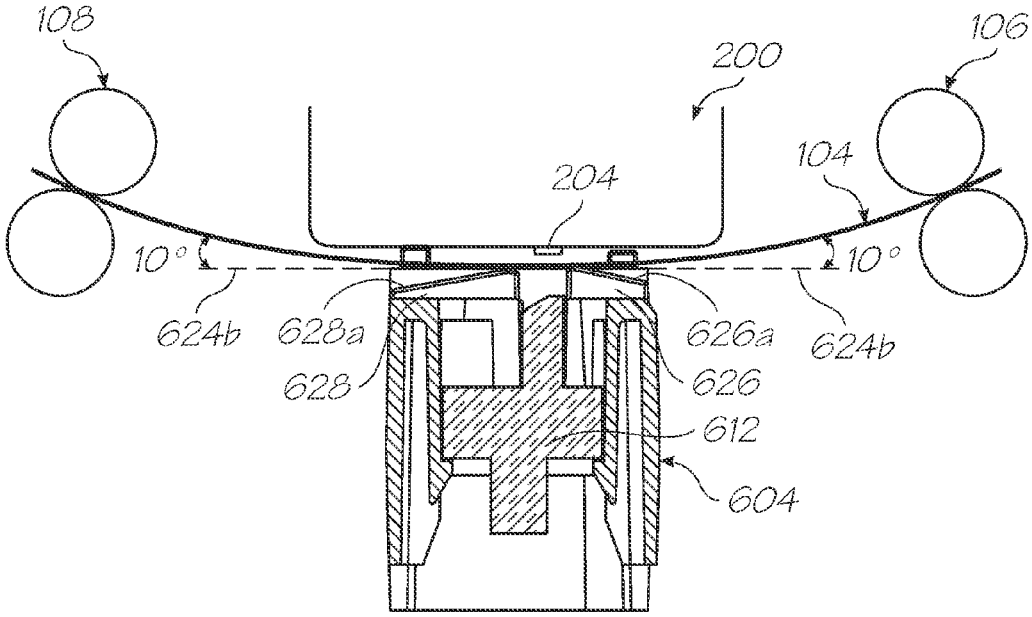
FIG. 16 illustrates an exemplary media path through a print zone of the printhead.

As illustrated in FIG. 16, the media 104 is transported or driven into the print zone by input rollers 106 of the printer 100 at a level elevated from an outer face 626*a* of each of the ribs 626, which are located upstream of the nozzles with respect to the travel direction of the media 104, so as to be angled from a plane parallel with the print zone defined by the printhead 200 and the platen 624. Further, the media is transported or driven out of the print zone by output rollers 108 of the printer 100 at a level elevated from an outer face 628*a* of each of the ribs 628, which are located downstream of the nozzles with respect to the travel direction of the media 104, so as to be angled from the parallel plane of the print zone. Upstream and downstream angles of about 10° to 12° are preferred, however other angles are possible.

Providing media entry and exit into the print zone at an angle together with contact between the media 104 and the platen 624 in the print zone ensures that the media 104 adopts a constrained path past the nozzles. That is, the media 104, which is typically paper or other flexible media, is caused to curve along this constrained path which acts to stiffen the media in the print zone and thereby maintain a substantially constant media-to-nozzle spacing for all portions of the media, which is particularly important in borderless printing applications.

Figure 13:
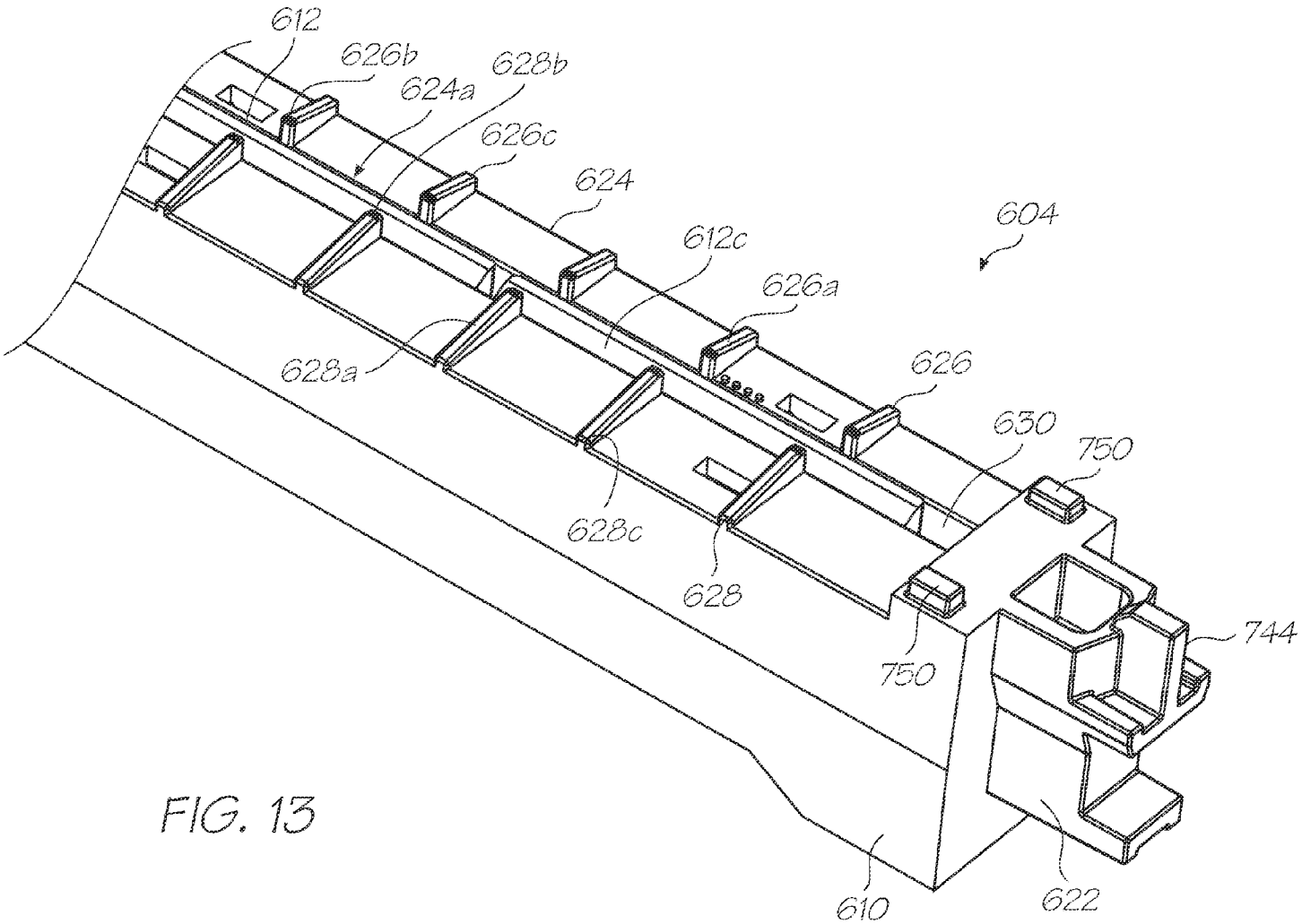
FIG. 13 illustrates a close up view of one end of the platen module.
Figure 14:
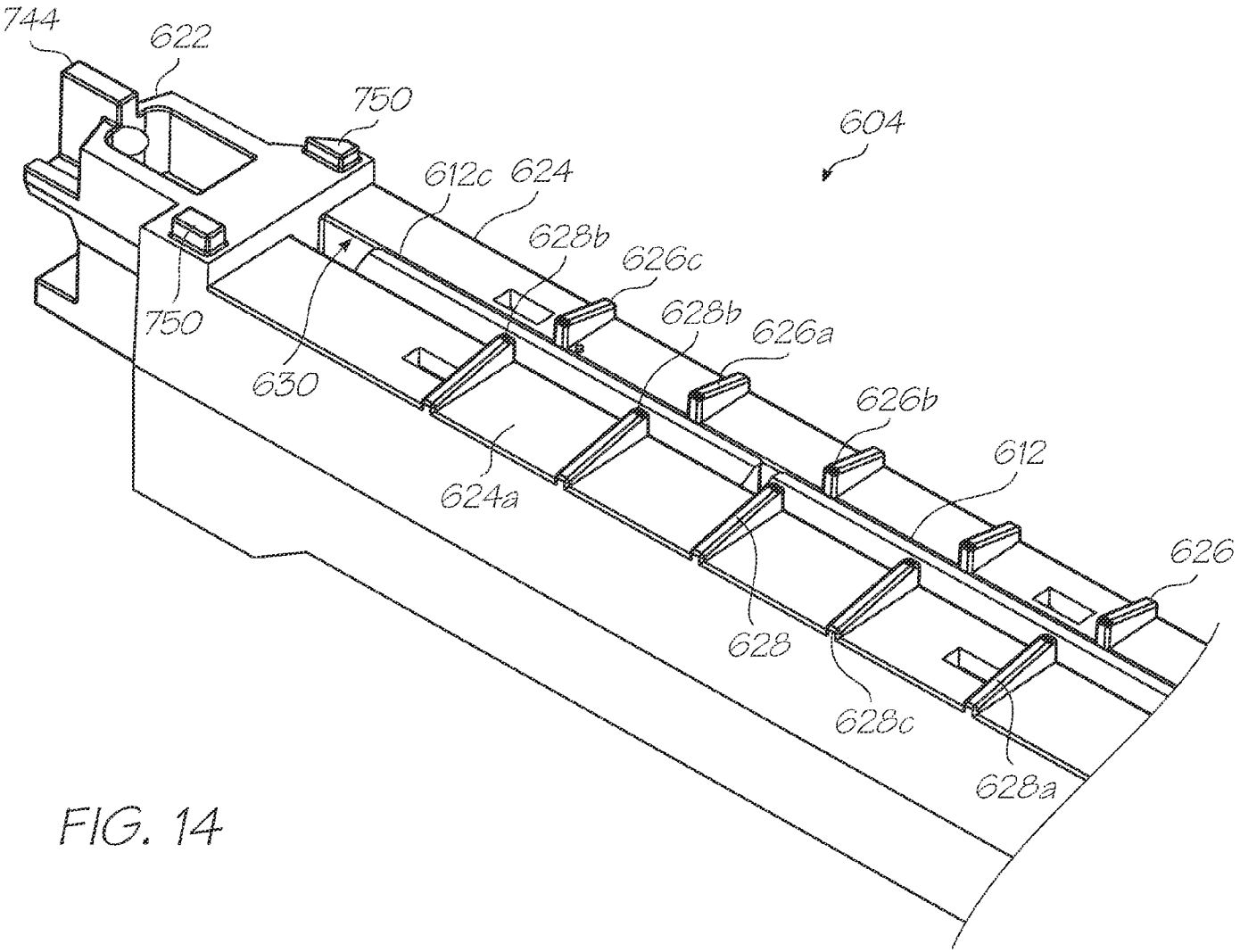
FIG. 14 illustrates a close up view of another end of the platen module.
Figure 15:
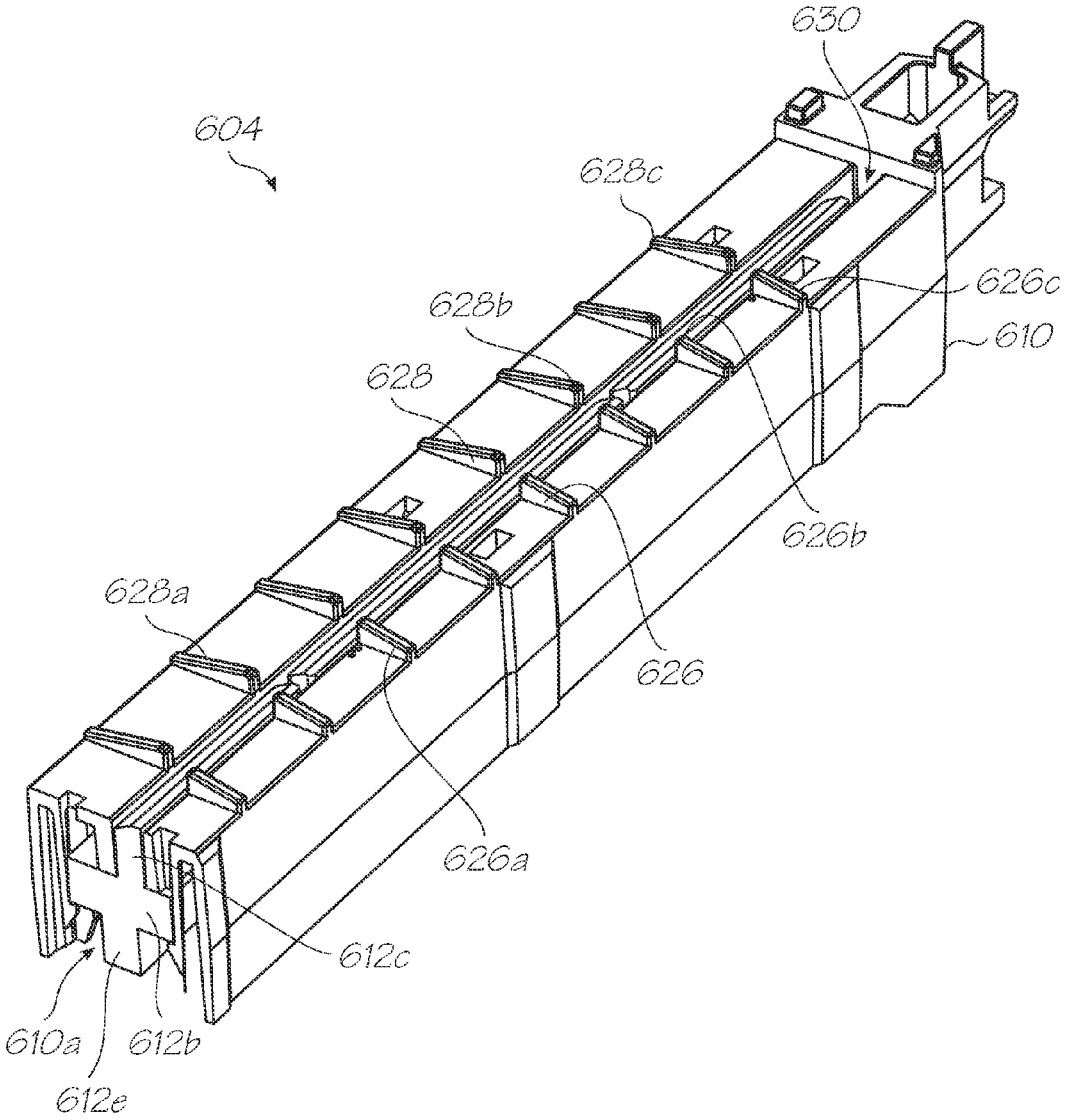
FIG. 15 is a cross-sectional view of the platen module.

As seen most clearly in FIGS. 13-15, the outer surface 626*a* of each of the upstream ribs 626 is also angled with respect to the parallel plane of the platen 624 such that a portion 626*b* of each of the ribs 626 closest to the slot 630 is closer to the printhead 200 than (e.g., higher than) a portion 626*c* of each of the ribs 626 furthest from the slot 630. Similarly, the outer surface 628*a* of each of the downstream ribs 628 is also angled with respect to the parallel plane of the platen 624 such that a portion 628*b* of each of the ribs 628 closest to the slot 630 is closer to the printhead 200 than (e.g., higher than) a portion 628*c* of each of the ribs 628 furthest from the slot 630. These relative structures of the ribs 624,626 assist in the media guiding and shaping as follows.

Figure 17A:
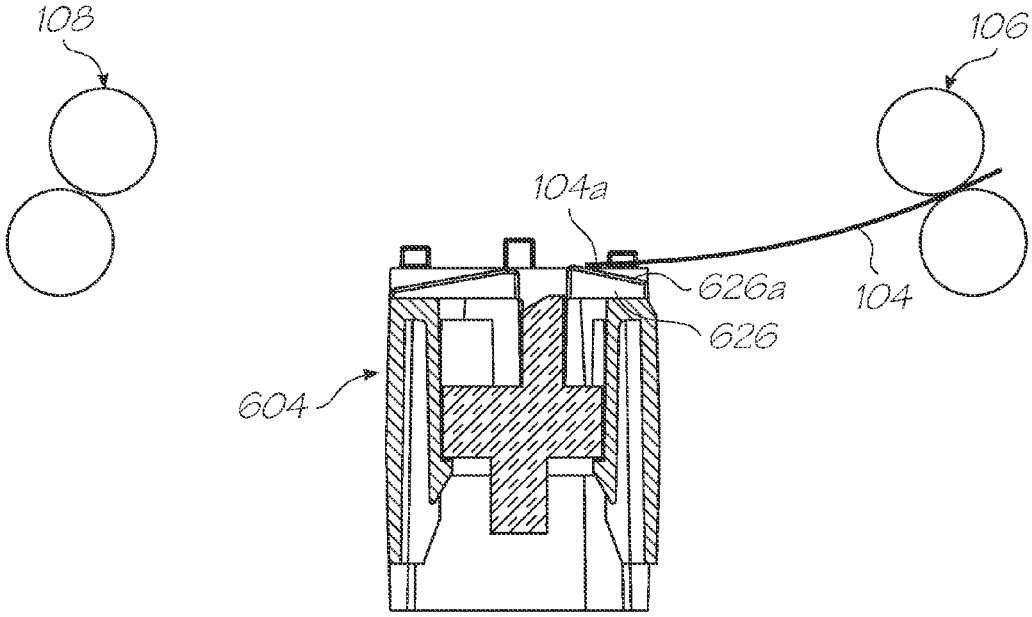
FIGS. 17A-17F illustrate subsequent stages of media travel through the media path.
Figure 17B:
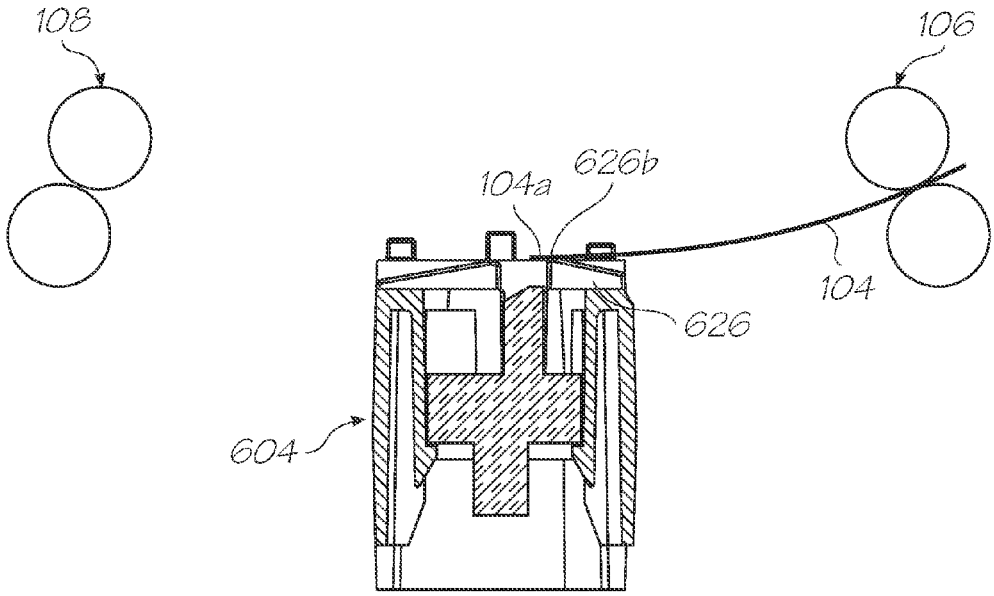

As illustrated in FIGS. 17A and 17B, a leading edge 104*a* of the media 104 driven by the input rollers 106 at the above-described angle to the platen 624 contacts the outer surfaces 626*a* of the upstream ribs 626 and is guided towards the printhead 200 along the outer surfaces 626*a*. In this way, the outer surfaces 626*a* of the ribs 626 act as a ramp for the leading edge 104*a* of the media 104. The leading edge of the media 104 then passes over the slot 630 and through the print zone of the nozzles, at which point the inherit stiffness of the media 104 causes the media 104 to bend in a cantilevered fashion such that only point-contact with the portions 626*b* of the ribs 626, which are rounded as illustrated, is made by the remaining portions of the media.

Figure 17C:
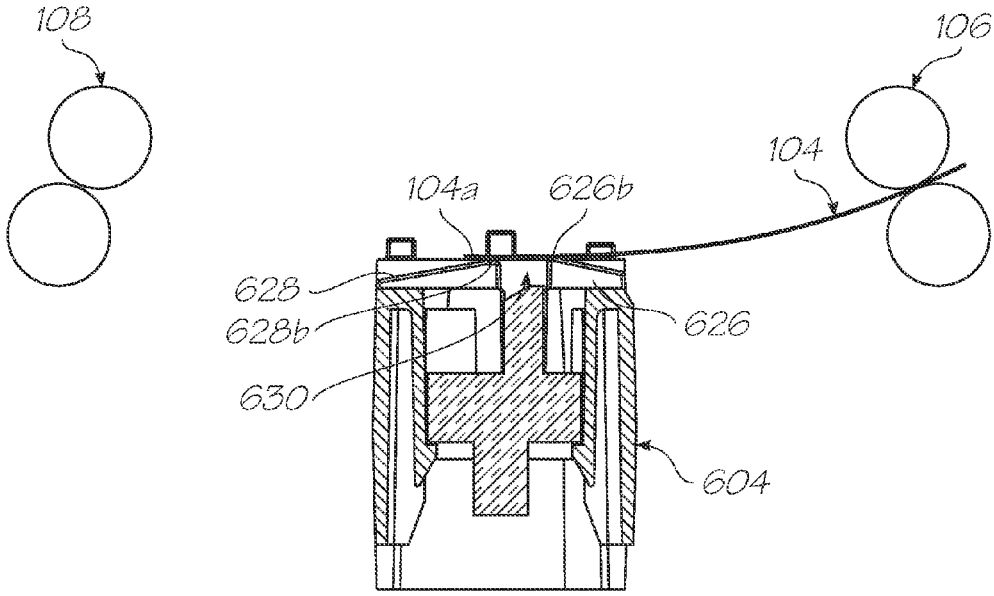
Figure 17D:
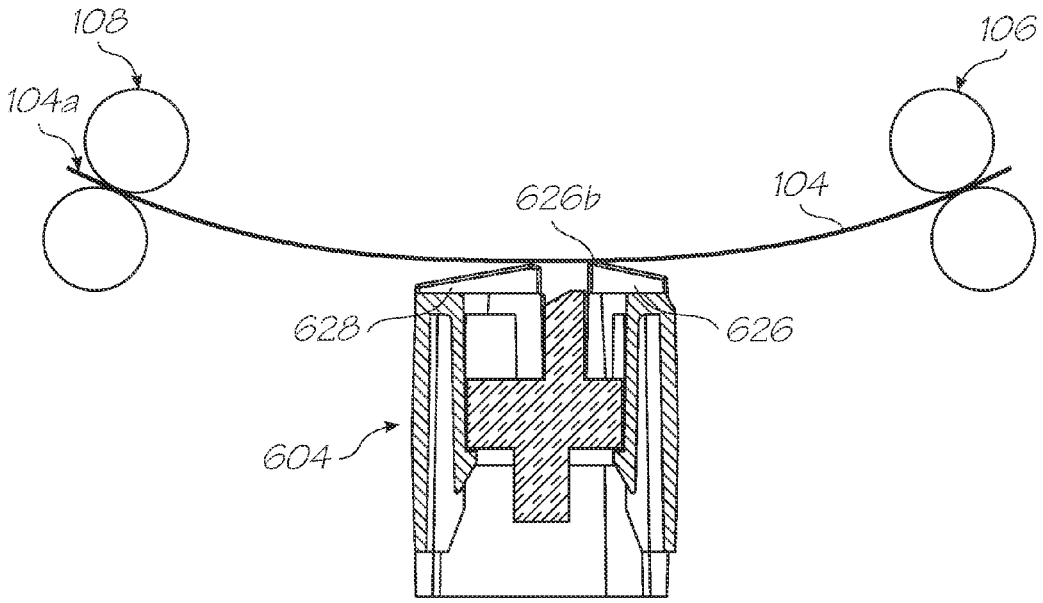

As illustrated in FIGS. 17C and 17D, the leading edge of the media 104 then point-contacts the portions 628*b* of the downstream ribs 628 to bridge the slot 630 and then due to the bend adopted by the media 104, the leading edge 104*a* of the media 104 leaves contact with the ribs 628 to be presented to the nip of the output rollers 108. In this way, the media is stably cantilevered at its point-contact with the upstream ribs 626 which maintains a substantially constant trajectory of the media through the print zone, thereby providing a substantially constant media-to-nozzle spacing for all portions of the media.

As illustrated, the portions 628*b* of the ribs 628 are slightly further away from the printhead 200 relative to (e.g., lower than) the portions 626*b* of the ribs 626. Also, the portions 628*b* have a substantially flat profile at an angle opposite to the angle of the remaining portions of the ribs 628. In this way, the leading edge of the media 104, which has a trajectory across the slot 630 from the ribs 626 below the parallel plane to the platen 624 relative to the printhead 200, contacts the ribs 628 in a smooth, non-abrupt manner. This reduces bounce of the media 104 within the print zone and minimizes possible jams within the slot 630.

Figure 17E:
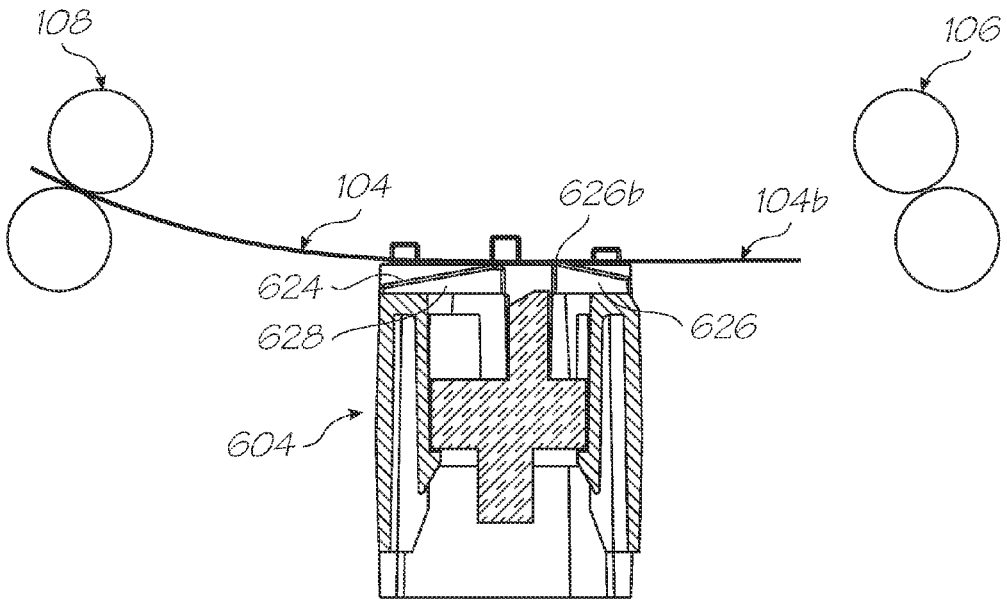
Figure 17F:
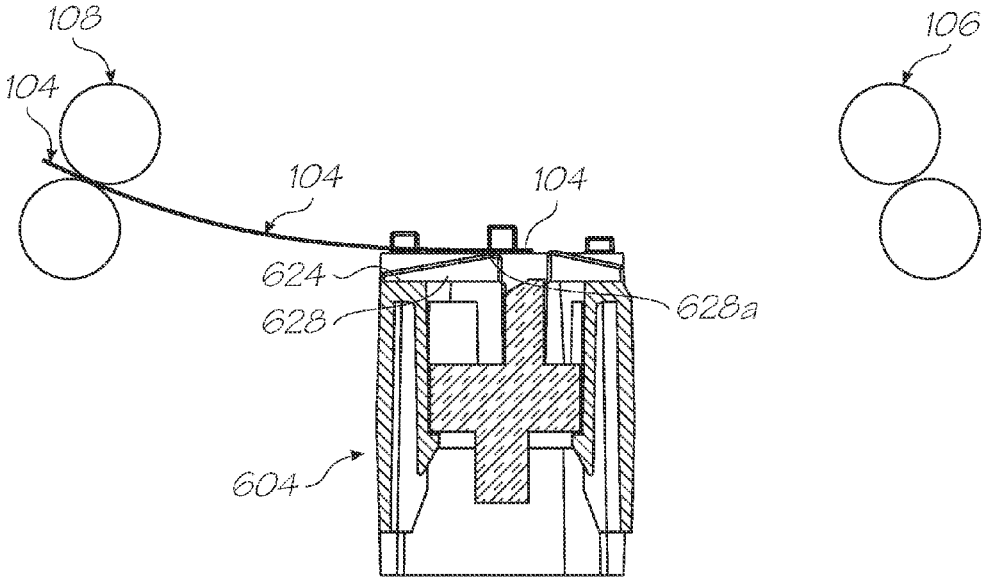

As illustrated in FIGS. 17E and 17F, a trailing edge 104*b* of the media 104 leaves the nip of the input rollers 106 to be driven by the output rollers 108 only, and due to the bend in the media 104 the trailing portion and edge of the media 104 are caused to become substantially parallel with the parallel plane of the platen 624. Then the trailing edge 104*b* of the media 104 is driven beyond the ribs 626 to be suspended over the slot 630. This causes the media 104 to come back into point-contact with the portions 628*b* of the downstream ribs 628 thereby transitioning from the upstream ribs 626 to the downstream ribs 628, which assists in maintaining the earlier trajectory of the media 104 through the print zone.

The trailing edge 104*b* of the media 104 is unsupported once it passes beyond the portions 628*b* of the ribs 628. Depending on the weight of the media, this lack of support may cause reverse bending of the trailing portion of the media. The angle of the outer surfaces 628*a* of the ribs 628 prevents this trailing portion of the media from making any further contact with the platen 422 which could otherwise cause disruption of the media exit.

The above-described media shaping is applicable to either discrete page or continuous web printing applications of the printer, since in either case leading and trailing edges of the media are present at some point of the printing cycle.

In the environment of the print zone, aerosols from the printed ink and the like and overprinting of ink, etc, particularly in borderless printing applications, causes fluid to collect on the surface of the platen, including the outer surfaces of the ribs. The above-described configuration of the ribs which provides point-contact between the ribs and the media minimizes the transfer of the collected fluid to the media. The point-contact also minimizes drag on the media through the print zone, which could affect media travel speed and therefore printing quality. Further, the provision of the relatively narrow ribs reduces the accumulation of the collected fluid on the outer surfaces of the ribs which contact the media, as the fluid is encouraged to flow away from the outer surfaces of the ribs to the surface 624*a* of the platen 624 and away from the printhead 200 through the slot 630.

In the illustrated embodiment, the ribs 626,628 are uniformly provided (e.g., each of the ribs 626 are equally spaced from one another and each of the ribs 628 are equally spaced from one another) across the media width of the print zone so that the media guiding and shaping is uniform across the media width. However, other arrangements are possible, such as having the ribs at the peripheries of the media width closer together than those central to the media width, so as to provide additional support at the sides of the media to prevent curling at the edges.

Further, each of the ribs 626 is illustrated as being aligned with a corresponding one of the ribs 628. However, other arrangements are possible in which the ribs 626 are offset from the ribs 628, so as to prevent warping of the media between the ribs along the media width.

Furthermore, more or less ribs than the number illustrated can be used depending on the type of media being used by the printer. For example, it is possible to have an arrangement in which the ribs are eliminated and the resultant continuous surface 624*a* of the platen 624 is angled on the upstream and downstream sides of the slot 630 similar to the ribs in the illustrated embodiment. Alternatively, the angled profile of either or both of the upstream and downstream ribs or sides of the platen surface can be eliminated. Such alternative arrangements would only be desirable in printing applications where aerosol and printing overspray are negligible factors such that fluid accumulation on the platen 624 is minimal Further still, other exemplary arrangements may adopt on-plane media entry and/or exit trajectories relative to the printing face of the printhead. In such arrangements, the media shaping aspects of the platen can be eliminated.

The platen 624 is preferably molded from a plastics material. In this way, the body 610 of the platen 624 can be molded as a one-piece unit integrally comprising the retainers 622 and the ribs 626,628, and having the slot 630 accurately formed therein, without the need for any cutting. The material of the platen 624 preferably has similar thermal expansion characteristics to the printhead 200, so that alignment of the platen 624 and the printhead 200 is maintained throughout all operational cycles and environments.

As discussed earlier, the surface of the platen is configured so that ink and other fluids in the printing environment from printing operation flows to the slot. During various stages of printing it may be advantageous to cause ejection nozzles of the printhead which have not printed for some time to 'spit' some ink in order to keep the nozzles 'wet'. The use of the term 'wet' is to be understood as meaning that the fluid within the nozzles is replenished with fresh fluid or is kept from drying, thereby reducing the likelihood of the fluid drying out within the nozzles, which could otherwise cause nozzle blockages. This is particularly important with respect to ink which is formed from dye suspended in a liquid such as water, because the liquid quickly evaporates when the ink is exposed to air causing the dye to leave suspension in the form of sediment. This keep-wet spitting operation is carried out between pages of the fed media, and therefore minimal disruption to the media feed is preferred. Accordingly, the platen module 604 is preferably left in place during the keep-wet spitting operation.

In order to capture the ink or other printing fluid ejected during keep-wet spitting and priming procedures, the wick element 612 of the platen module 604 is located in the slot 630 so as to be aligned with the printing face of the printhead 200. The wick element 612 is formed of a hydrophilic porous material which can be molded and has a porosity with a bead and void size which permits absorption of ink. For example, hydrophilic polyethylene is preferred, which can be used to make the wick element 612 by a process akin to sintering, being molded together into its final shape. The use of the term "hydrophilic" is to be understood as meaning that any liquid, not only water, is absorbed by the material which is said to be "hydrophilic".

Figure 10:
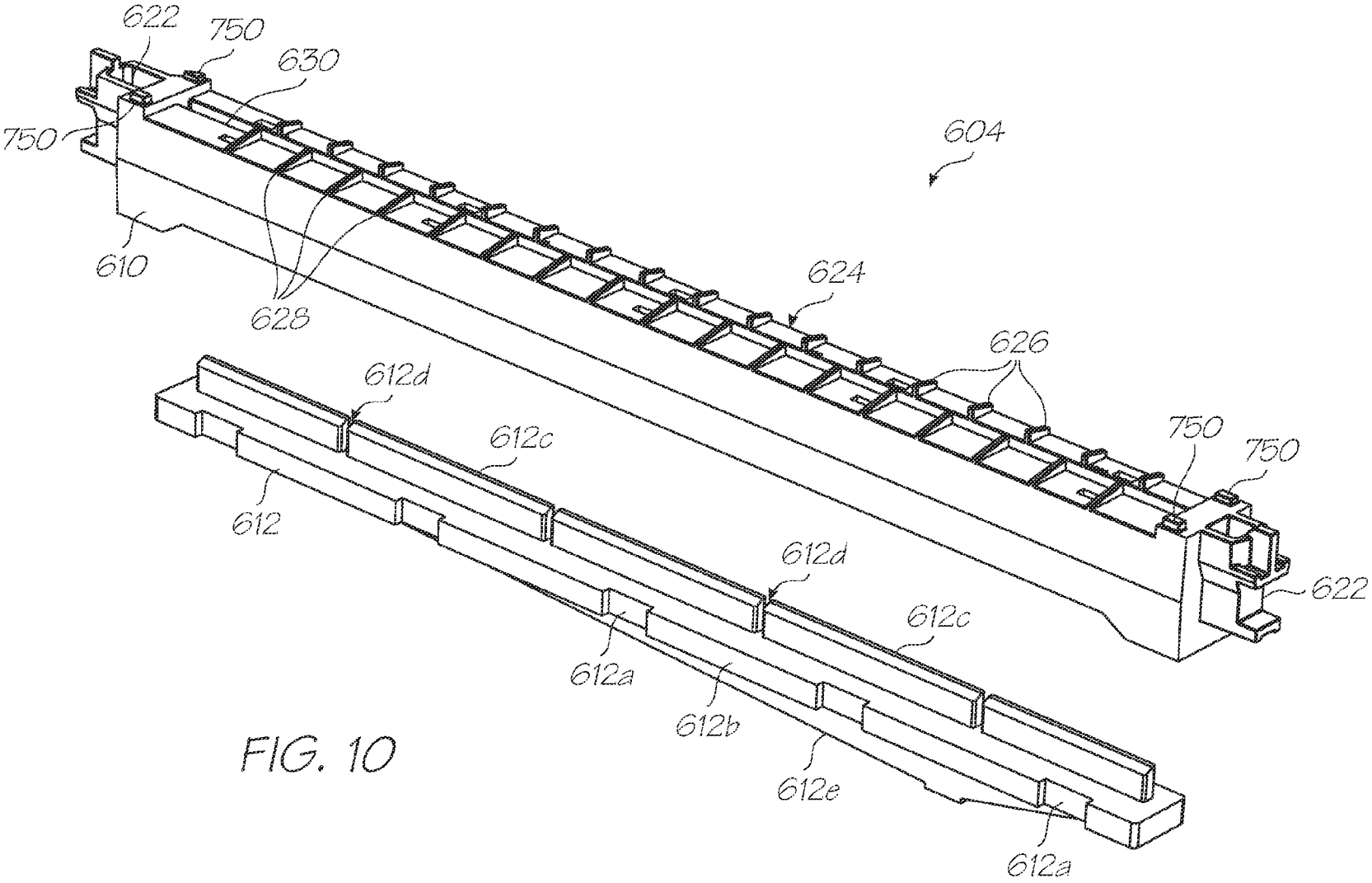
FIG. 10 is a first exploded perspective view of a platen module of the sled.
Figure 11:
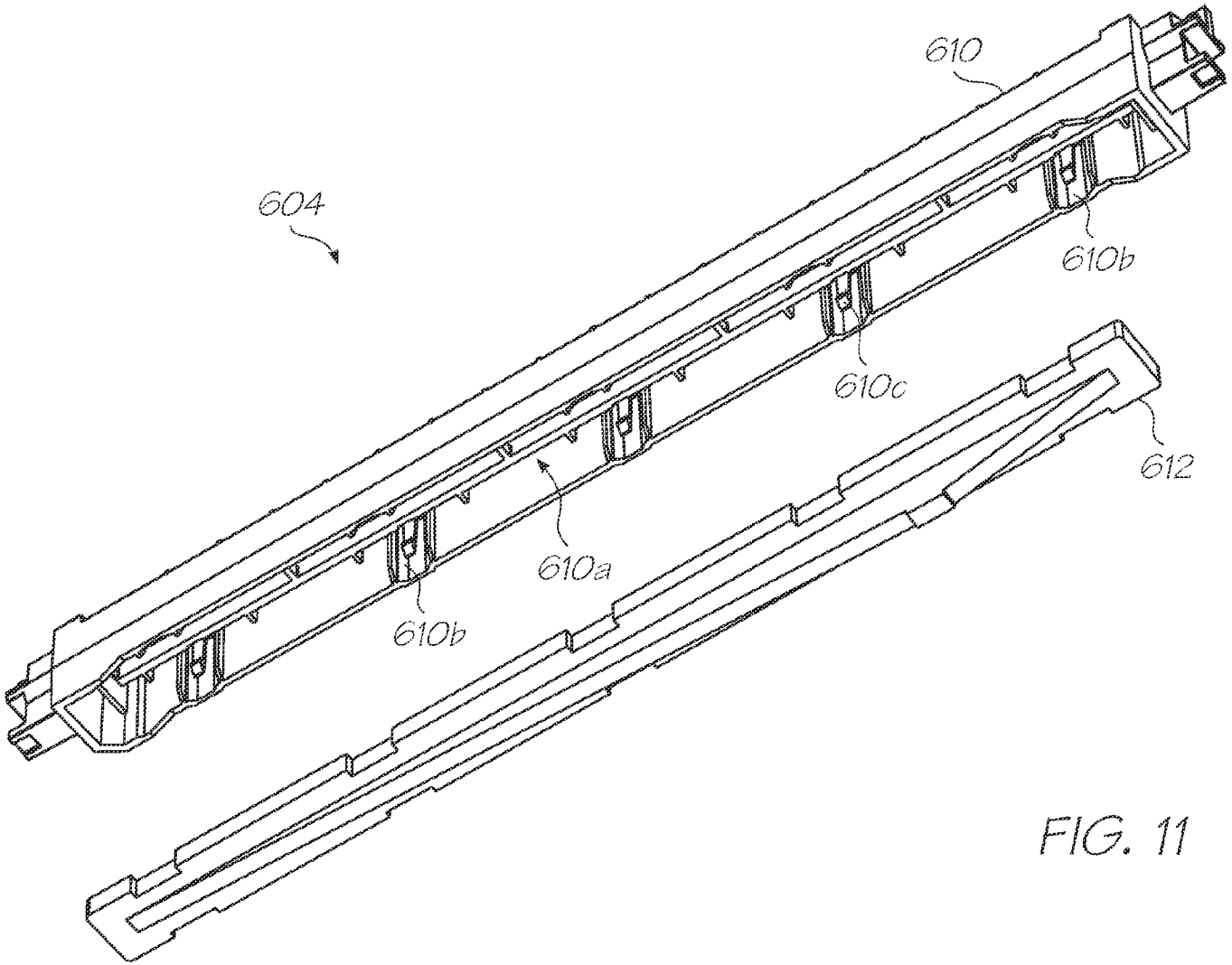
FIG. 11 is a second exploded perspective view of the platen module.
Figure 12:
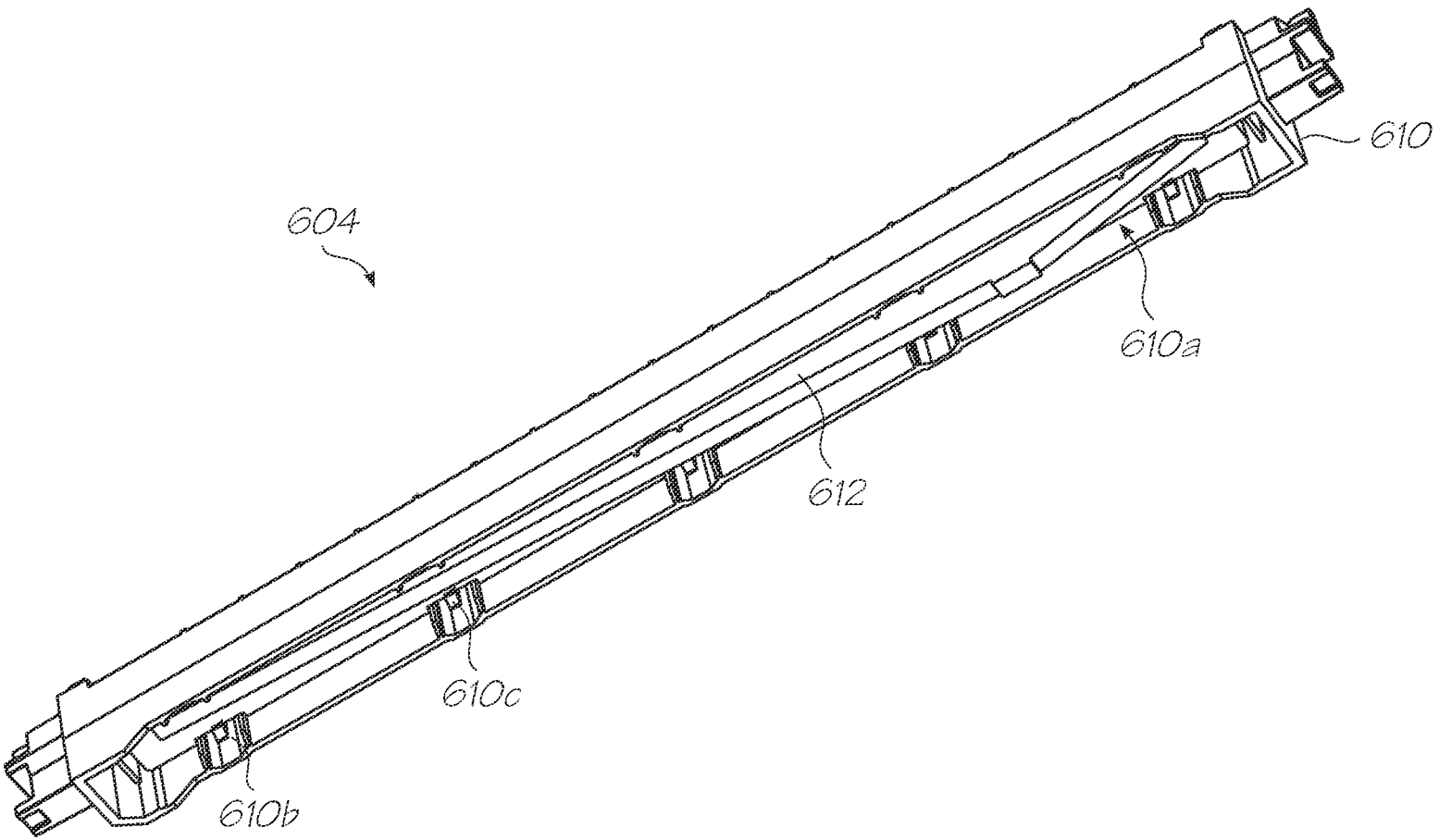
FIG. 12 illustrates the assembled platen module.

As illustrated in FIGS. 10-12, the wick element 612 is elongate and shaped to fit within a recess 610*a* of the body 610 so as to extend along the length of the platen module 604. The wick element 612 has notches 612*a* defined within a flange 612*b* defining a wick body at either side which engage with rails 610*b* within the recess 610*a*. The wick element 612 is held within the body 610 by clips 610*c* associated with the rails 610*b*, which clip over the underside of the flange 612*b* with respect to the orientation illustrated in the drawings. In this way, the wick element is removable from the platen module, such that replacement of the wick element is possible if the effectiveness of the wicking of the porous material of the wick element reduces over time.

This clipped engagement secures the wick element 612 within the body 610 so that pads 612*c* which project normally from the flange 612*b* align with, and project through, the slot 630 but so as not to project past the outer surfaces 626*a*,628*a* of the ribs 626,628 with respect to the printhead 200, as illustrated in FIGS. 13-15.

In particular, the pads 612*c* are spaced below the outer surfaces of the ribs, which form a reference surface 624*b* of the platen 624, so that the media 104 never comes into contact with the wick element 612. This prevents transfer of ink onto the media. On the other hand, the pads 612*c* are not spaced too far below the reference surface 624*b* so that the wick element 612 is in close proximity to the printhead 200. This ensures that ink is captured whilst in ballistic flight from the nozzles, which minimizes aerosol or misting about the print zone. In the illustrated embodiment, the distance of the reference surface 624*b* from the printhead ICs 204 is about 1.1 millimeters and the outer surface of the pads 612*c* is about 0.35 millimeters below the reference surface 624*b*. The manner in which these distances are set is discussed in detail later.

Due to closeness of the wick element 612 to the printing face of the printhead 200, build-up of the captured fluid on the pads 612*c*, particularly as the fluid dries on the wick element 612, by an amount which causes the built-up fluid to contact the printing face must be prevented. This build-up, which can particularly form as stalagmites in regions where overspray from the media occurs in borderless printing, is prevented by forming the wick element 612 so that notches 612*d* are defined between the pads 612*c*, as illustrated in FIG. 10. This arrangement encourages the captured fluid to be absorbed into the main porous body of the wick element 612 rather than collecting on the outer surfaces of the pads 612*c*.

Figure 18:
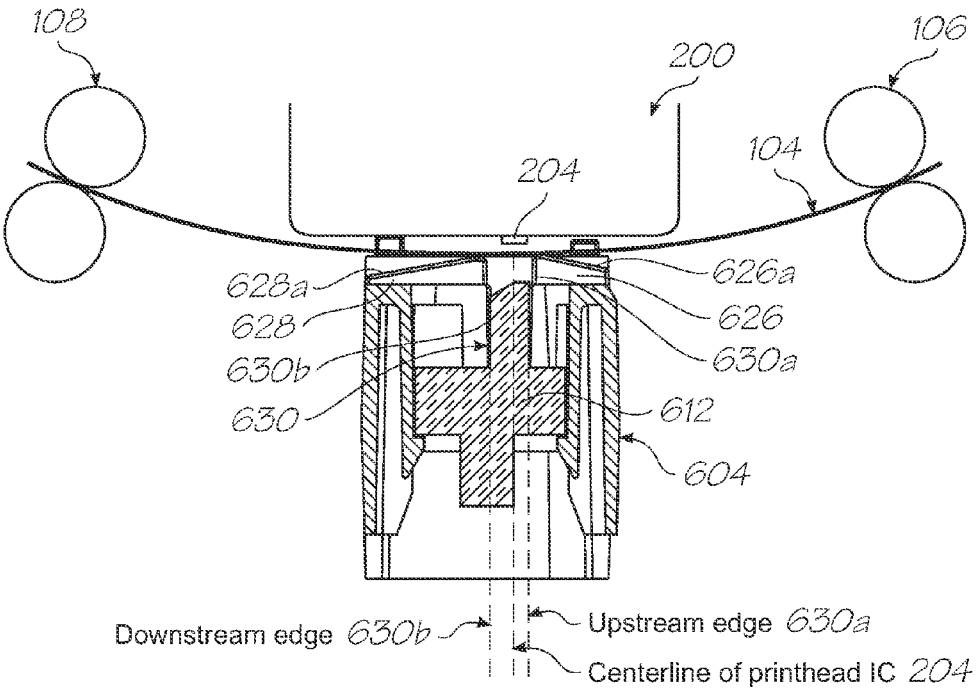
FIG. 18 is a cross-sectional view of the platen module in operational position relative to the printhead.
Figure 19:
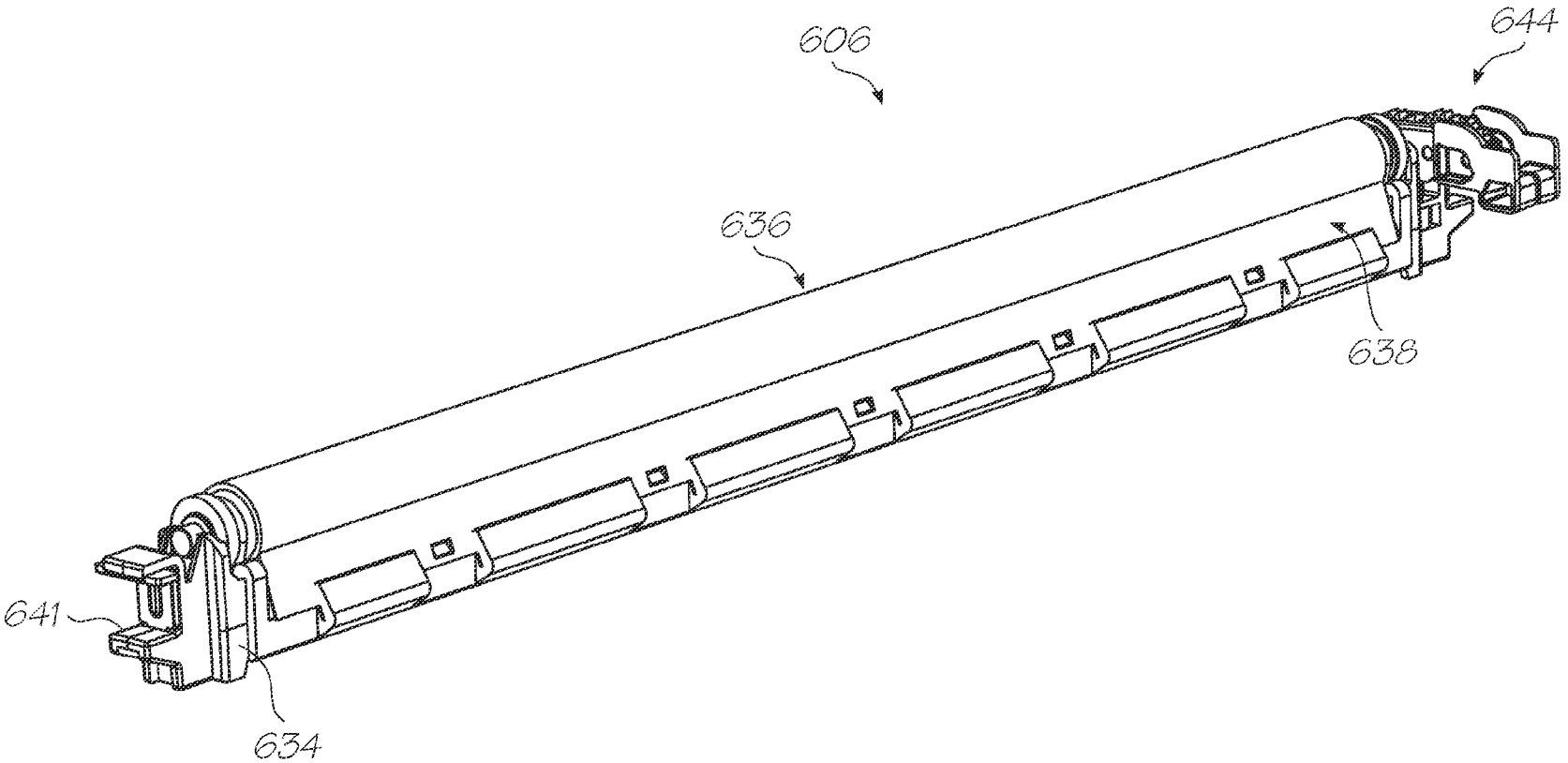
FIG. 19 is a first isometric view of a wiper module of the sled.
Figure 20:
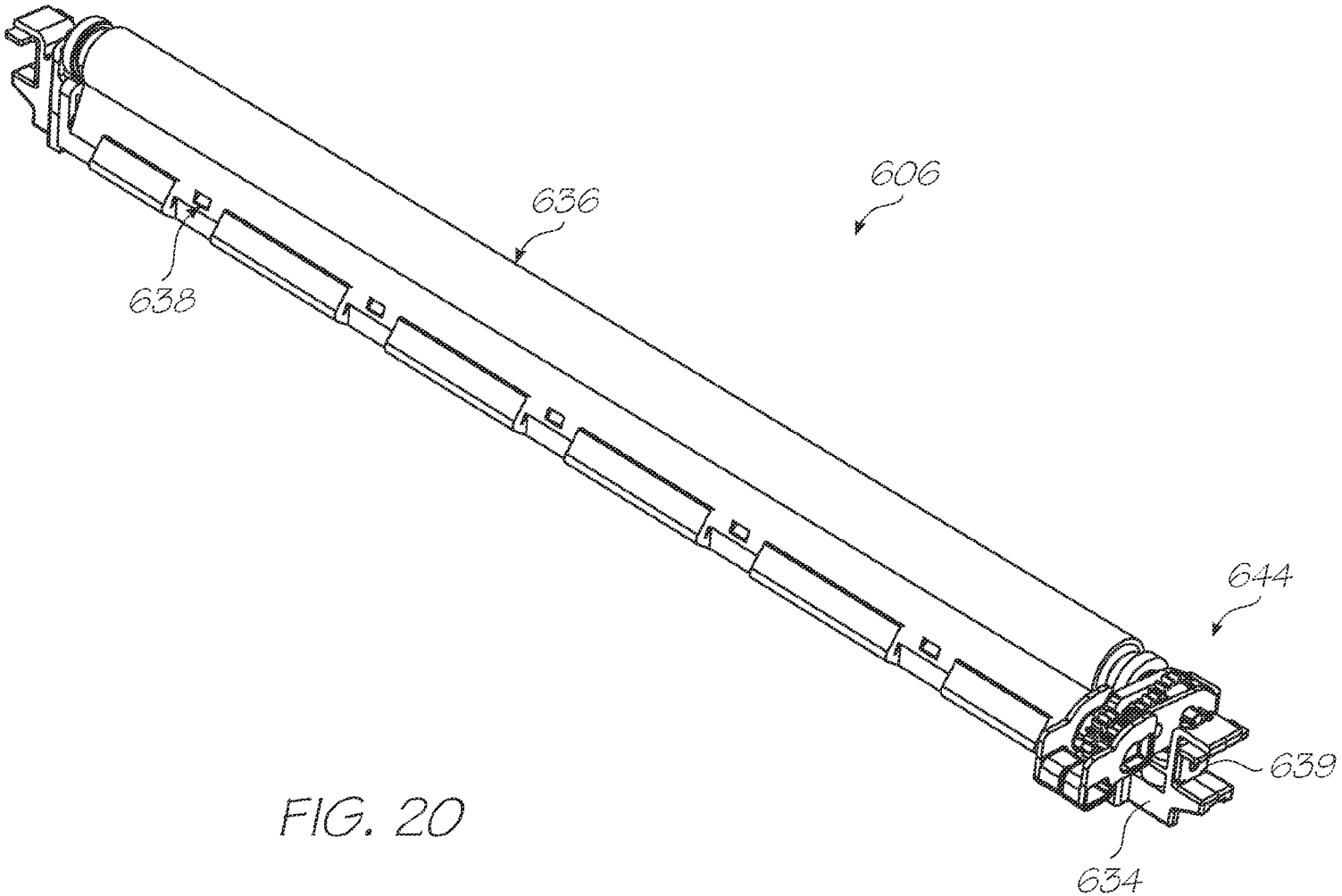
FIG. 20 is a second isometric view of the wiper module.

The width of the printhead ICs 204 of the printhead 200 along the media travel direction is of the order of one or two millimeters, or less depending on the number of nozzle rows incorporated on the printhead ICs 204. As illustrated in FIG. 18, when the platen module 604 is in its operational position an alignment mechanism of the maintenance system 600 aligns the platen module 604 with the printhead 200 so that a centerline of the nozzles of the printhead ICs 204 along the media width than a downstream edge 630*b* of the slot 630. In the illustrated embodiment, the wick element 612 has a width of about 5.5 millimeters and the slot 630 has a width of about six millimeters so as to accommodate the wick element 612, and the upstream edge 630*a* is about 1.6 millimeters from the centerline whereas the downstream edge 630*b* is about four millimeters from the centerline.

Configuring this offset alignment between the slot 630 and the printhead ICs 204 causes the wick element 612 to be offset from the centerline of the printhead ICs 204 also. Accordingly, a greater surface area of the wick element 612 is disposed downstream of the centerline of the printhead ICs 204 than upstream. This is done because there is a tendency during printing for the ink aerosol to be entrained in the same direction as the media travel, and therefore more of the aerosol is directly captured by the offset wick element 612.

Once the wick element 612 is saturated with captured ink, the ink will tend to naturally drain through the wick element 612 through capillary action under gravity with respect to the assembled arrangement of the platen module 604 in the sled 602. The draining ink is encouraged to drain from a specific region of the wick element 612 into the underlying sled 602 so that the drained ink can be suitably contained. This is achieved by forming the wick element 612 with a drainage ridge 612*e* projecting normally from the flange 612*b* in a direction opposite to the projection of the pads 612*c*.

Figure 47:
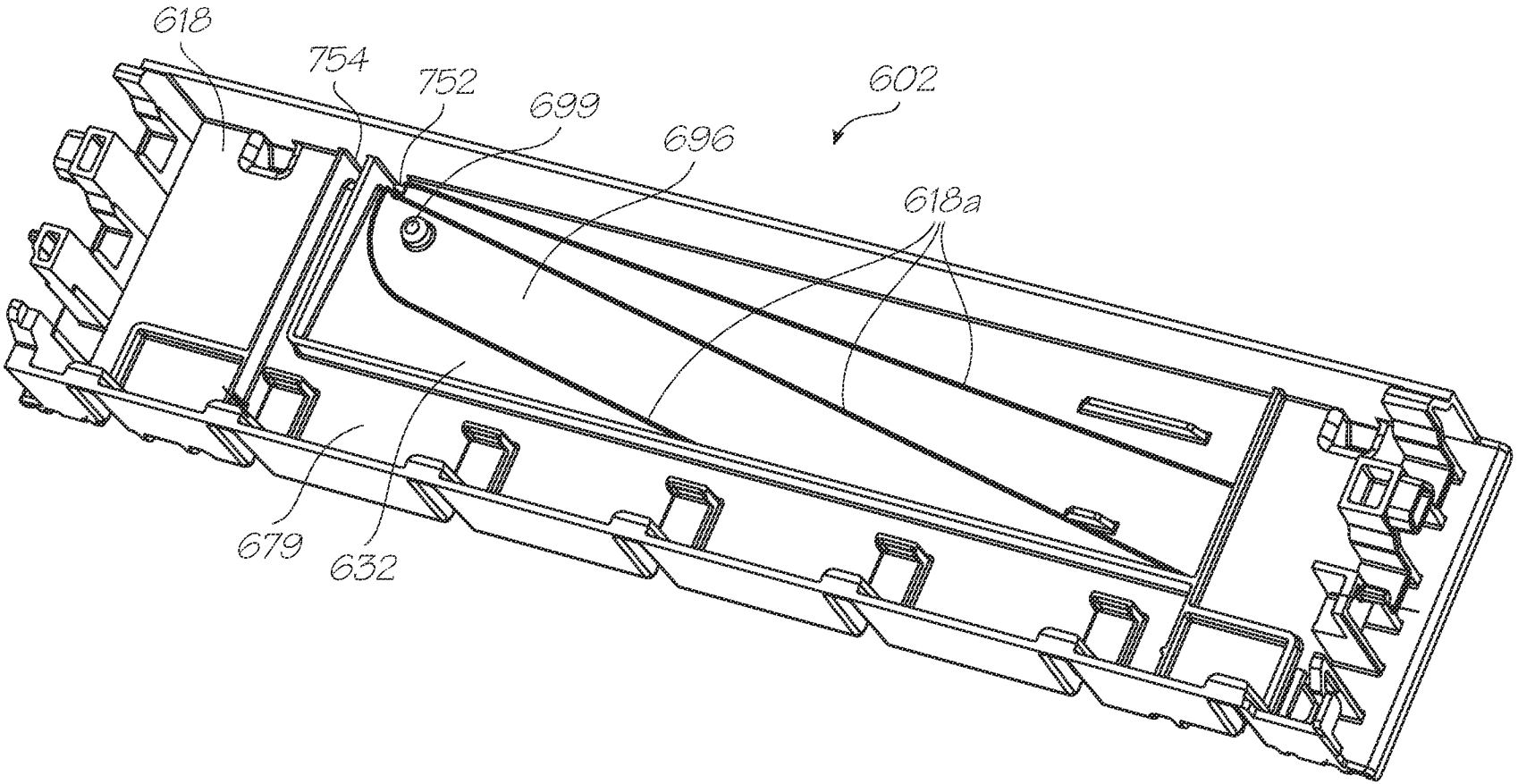
FIG. 47 illustrates a top isometric view of the sled with the modules removed.
Figure 48A:
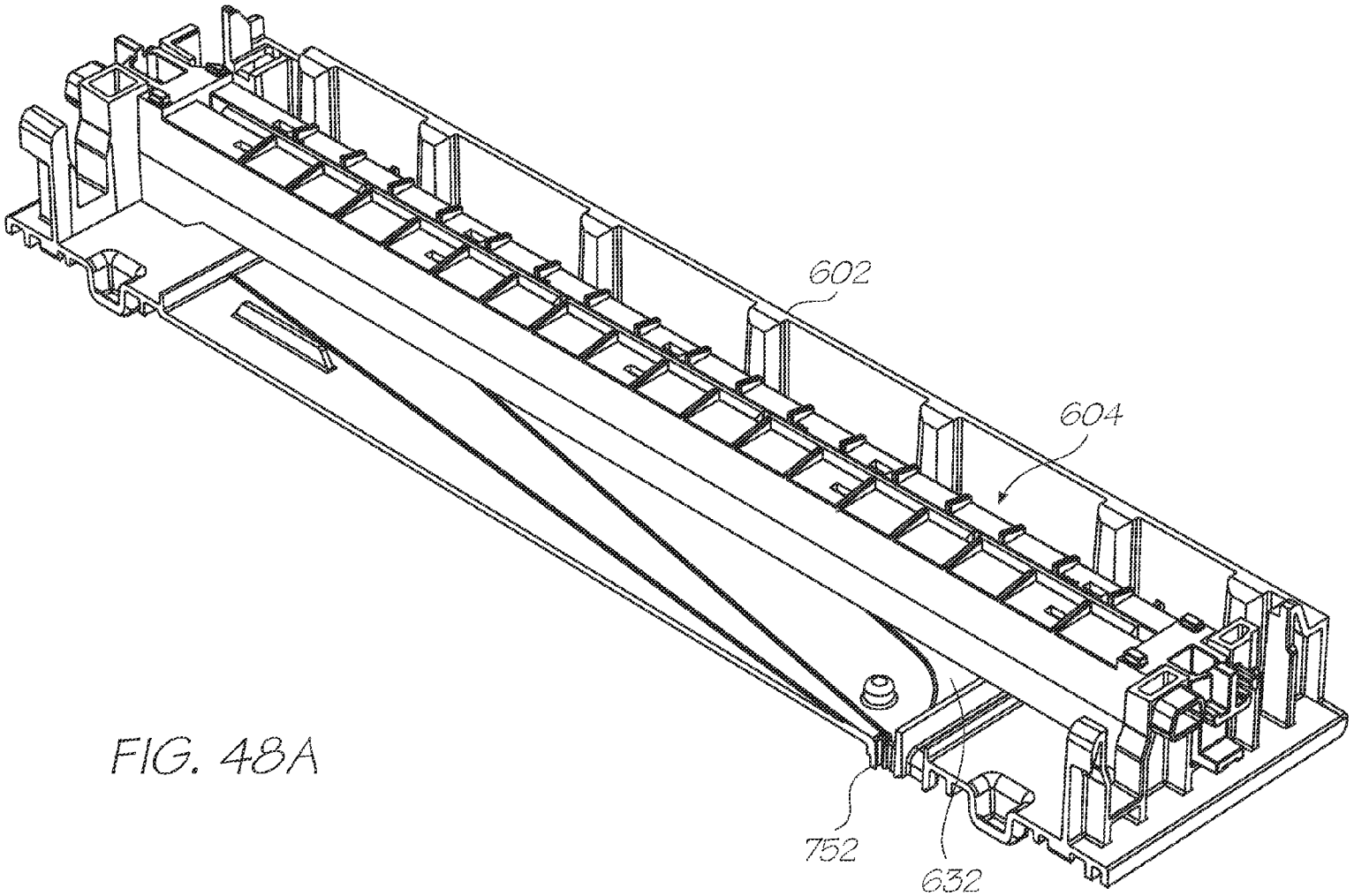
FIG. 48A is a cross-sectional view of the sled illustrating the platen module position.
Figure 48B:
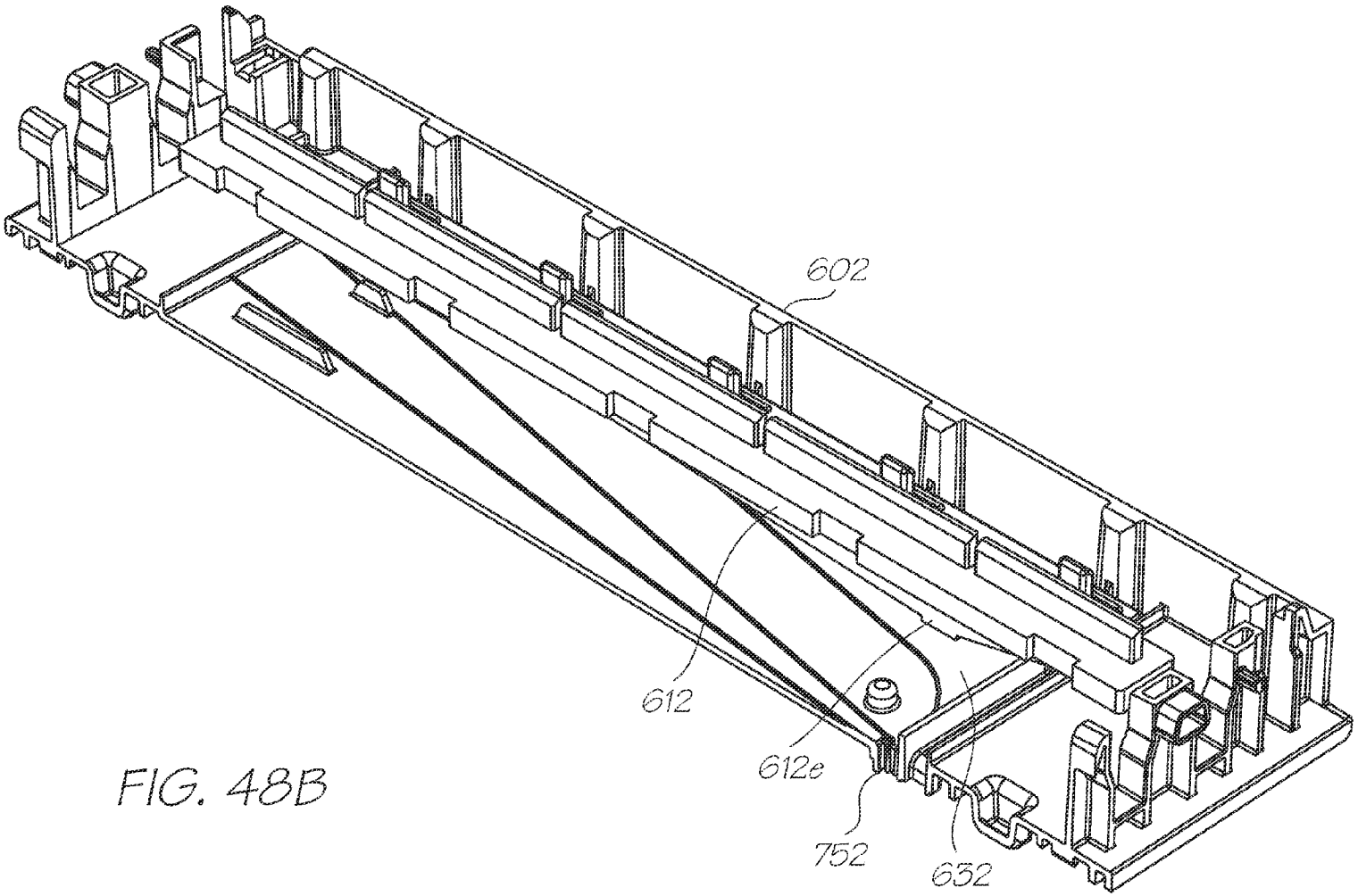
FIG. 48B illustrates the view of FIG. 48A with a body of the platen module omitted.

As illustrated in FIGS. 10-12, the drainage ridge 612*e* is a triangular projection having a peak which is aligned with a drainage detail 632 in the base 618 of the sled 602, as is illustrated in FIGS. 47, 48A and 48B and is discussed in more detail later. By this configuration, the capillary ink draining through the porous body of the wick element 612 drains out of the wick element 612 from the peak into the drainage detail 632.

Both this drainage and offset aerosol capture are also assisted by forming the outer surfaces of the pads 612*c* to be sloped in the media travel direction, as illustrated in FIGS. 13-15. In particular, the top surface of the wick element is not located directly below the printhead ICs and therefore the ejected fluid strikes the wick element in its sloped region thereby encouraging the captured fluid to be drawn away from the printing face and through the wick element. This reduces stagnation areas within the body of the wick element in which the fluid could dry causing reduction of effectiveness of the wick element.

In the above-described embodiment, the fluid captured by the wick element is allowed to drain through and out of the wick under gravity. An alternative embodiment could employ suction by a suction pump connected to the platen module through tubing.

Figure 8:
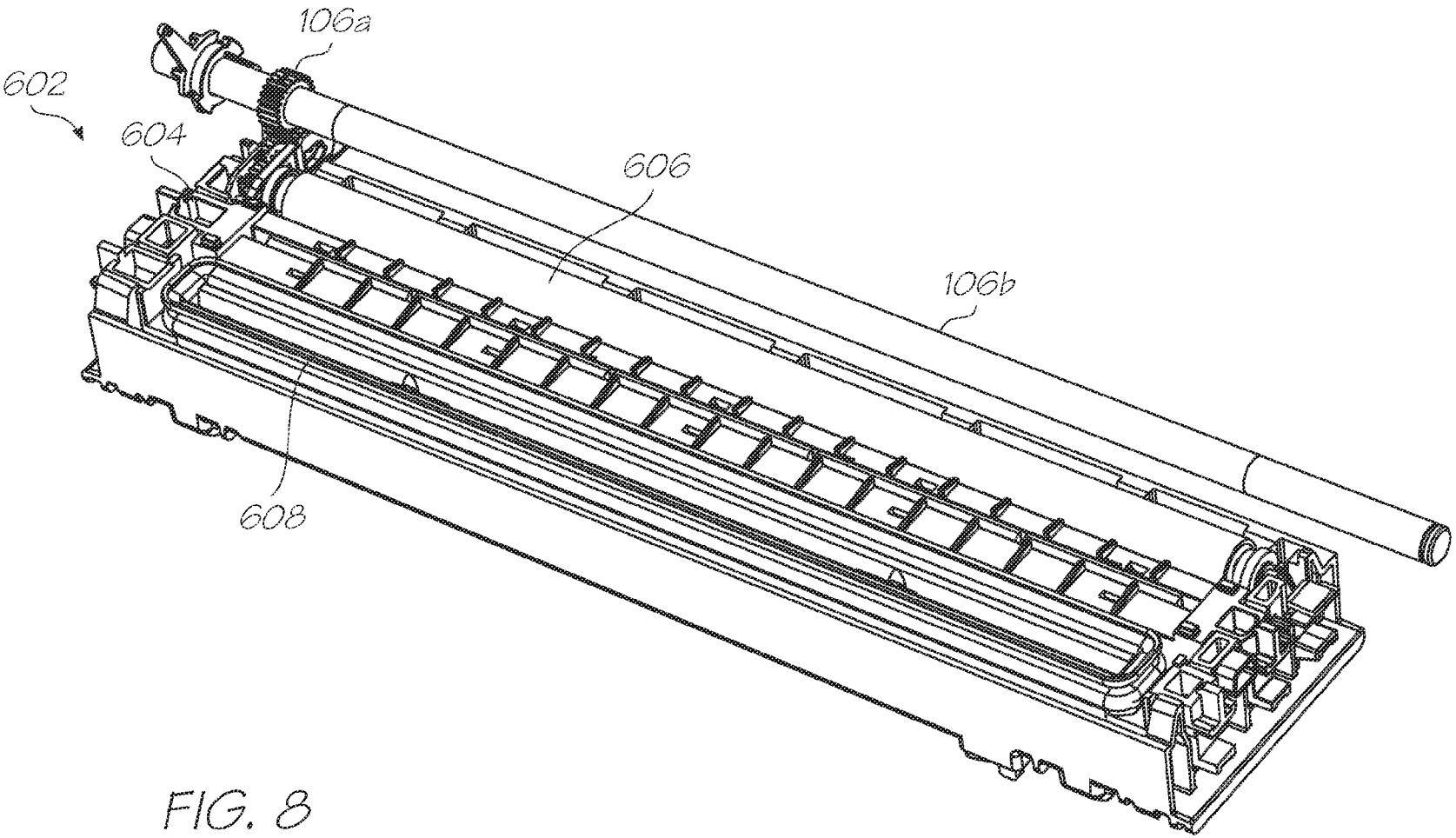
FIG. 8 schematically illustrates an exemplary embodiment of a modular maintenance sled of the maintenance system.
Figure 9:
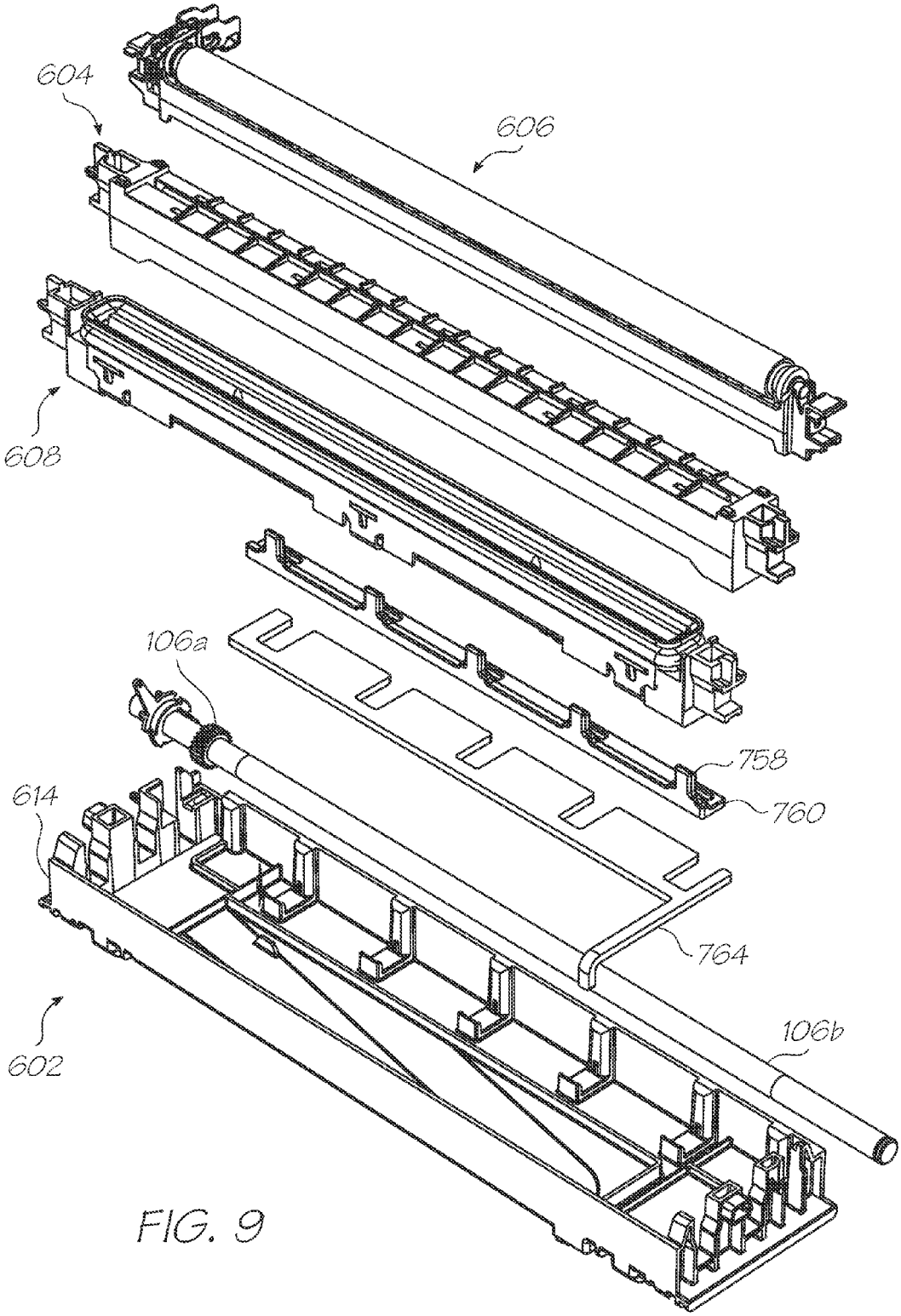
FIG. 9 is an exploded view of the sled as illustrated FIG. 8.

FIGS. 19-27 illustrate various exemplary aspects of the wiper module 606. The wiper module 606 is an assembly of a body 634, a wiper element 636 and a scraper element 638. The body 634 is elongate so as extend along a length longer than the media width of the printhead 200. The wiper module 606 is housed within the elongate frame 614 of the sled 602 so as to be adjacent the platen module 604, as illustrated in FIG. 8.

The notches 620*a* in the sidewalls 620 of the frame 614 removably receive retainer elements 639 and 641 at the longitudinal ends of the body 634 of the wiper module 606. This engagement of the notches and retainers allows the wiper module 606 to be held by the frame 614 in an unsecured, yet constrained manner. That is, the wiper module effectively "floats" within the sled, which facilitates the displacement of the wiper module relative to the sled. The wiper module 606 is assembled in the frame 614 so that the wiper element 636 faces the printhead 200 when the wiper module 606 is in its operational position.

The wiper element 636 is an assembly of a wiper roller 640 on a shaft 642 and a drive mechanism 644 at one end of the shaft 642. The wiper roller 640 has a length at least as long as the media width of the printhead 200 and is caused to rotate through rotation of the shaft 642 by the drive mechanism 644. The drive mechanism 644 has a gear train 646 rotatably mounted within a swing arm 648 pivotally mounted at the one end of the shaft 642. In the illustrated embodiment, the swing arm 648 has two arms 650 and 652. The arms 650,652 are assembled together with the gear train 646 disposed therebetween. Other arrangements are possible however, such as a swing arm having a single arm, so long as the swing arm is able to swing relative to the body 634 of the wiper module 606, as discussed in detail below.

The gear train 646 has a first gear 654 mounted on the shaft 642, a second gear 656 being a compound, driven gear which contacts a gear 106*a* of a driven roller 106*b* of the input rollers 106, and a third gear 658 being a compound gear intermediate the first and second gears 654,656.

The second and third gears 656,658 are rotatably mounted to the swing arm 648 by passing respective pins 650*a* of the arm 650 through holes 656*a*,658*a* of the second and third gears 656,658 and then through respective holes 652*a* in the arm 652.

Figure 21:
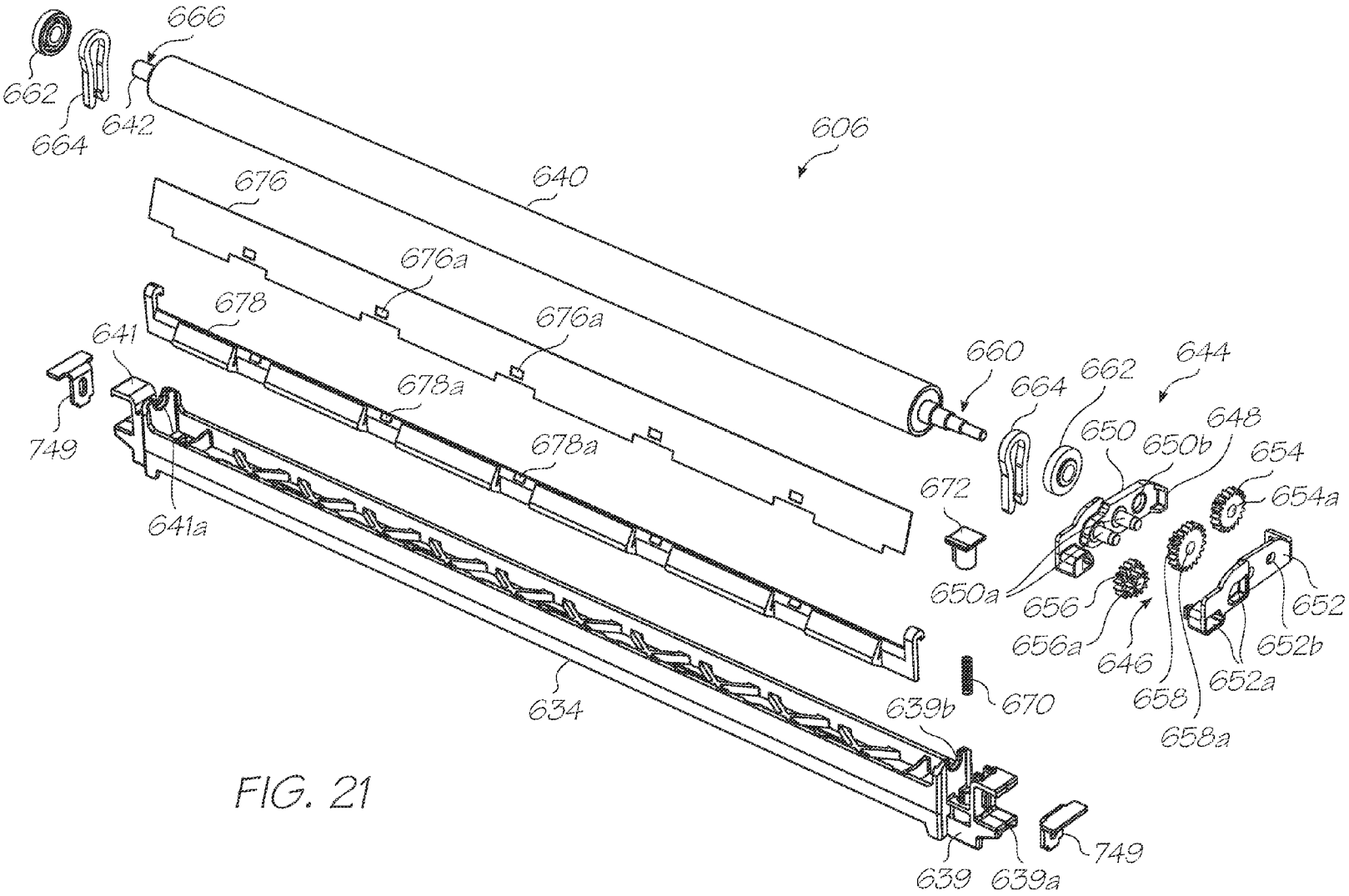
FIG. 21 is an exploded perspective view of the wiper module.

The first gear 654 is rotatably mounted to the swing arm 648 by passing an end portion 660 of the shaft 642 through a hole 650*b* in the arm 650, a hole 654*a* in the first gear 654 and then through a hole 652*b* in the arm 652. As illustrated in FIG. 21, the end portion 660 of the shaft 642 has a series of sections 660*a*-660*d* of successively smaller diameter from the wiper roller 640 to the end of the shaft 642.

The smallest diameter section 660*d* is configured to pass through the hole 654*a* in the first gear 654 and the hole 652*b* in the arm 652, whilst the adjacent inner section 660*c* has a diameter larger than the diameter of the hole 654*a* in the first gear 654. As such, the first gear 564 is securely retained within the swing arm 648 whilst allowing rotation of the shaft 642 and first gear 564 relative to the swing arm 648.

The adjacent section 660*c* is configured to pass through the hole 650*b* in the arm 650, whilst the next adjacent inner section 660*b* has a diameter larger than the diameter of the hole 650*b* in the arm 650. As such the swing arm 648 is securely held on the shaft 642 whilst allowing rotation of the shaft 642 relative to the swing arm 648.

The next adjacent section 660*b* is configured to pass through a collar 662, whilst the adjacent, largest diameter section 660*d* has a diameter larger that the internal diameter of the collar 662. Accordingly, the collar 662 is securely held on the shaft 642.

Figure 23:
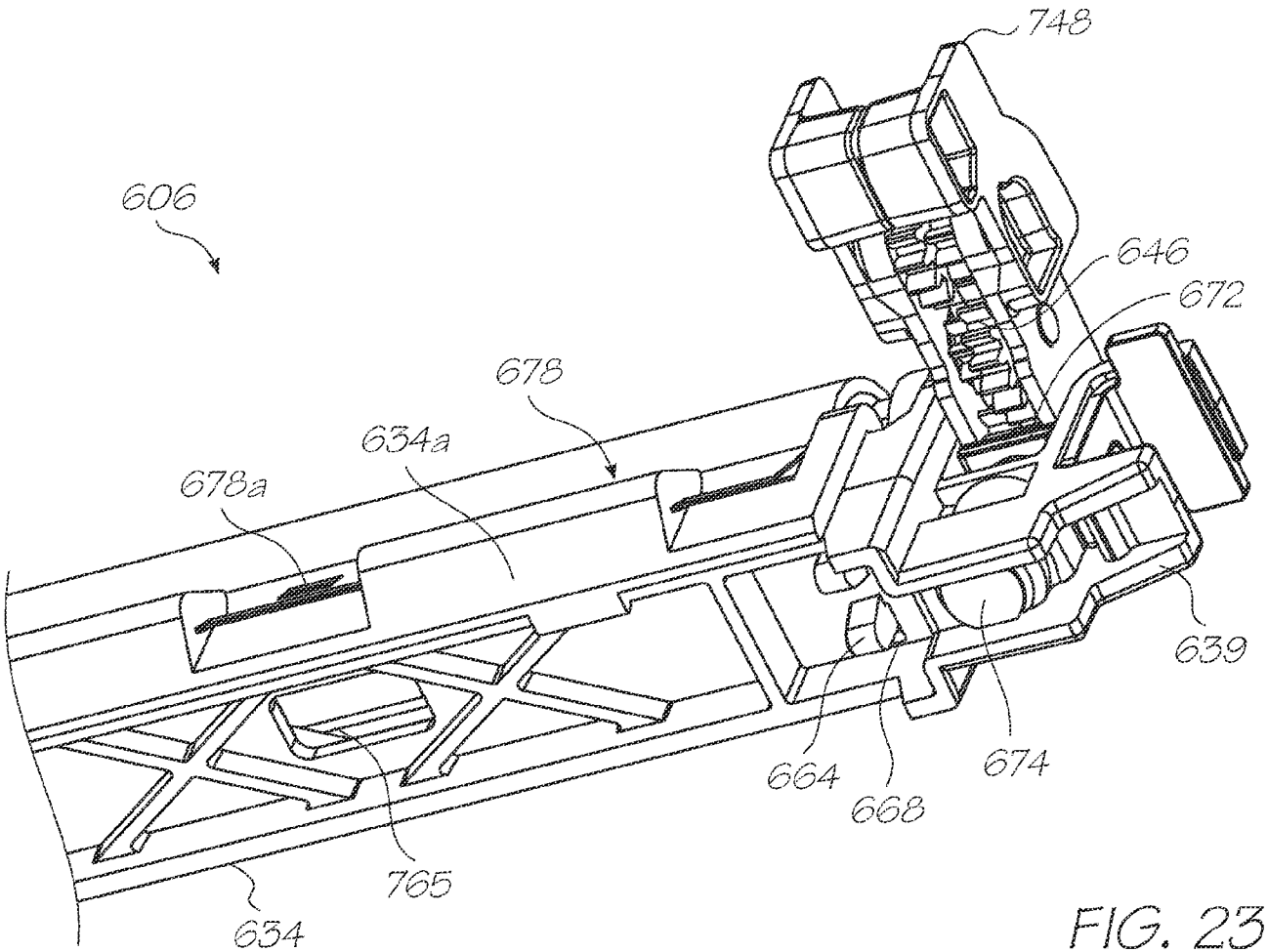
FIG. 23 illustrates a close up view of one end of the wiper module.
Figure 24:
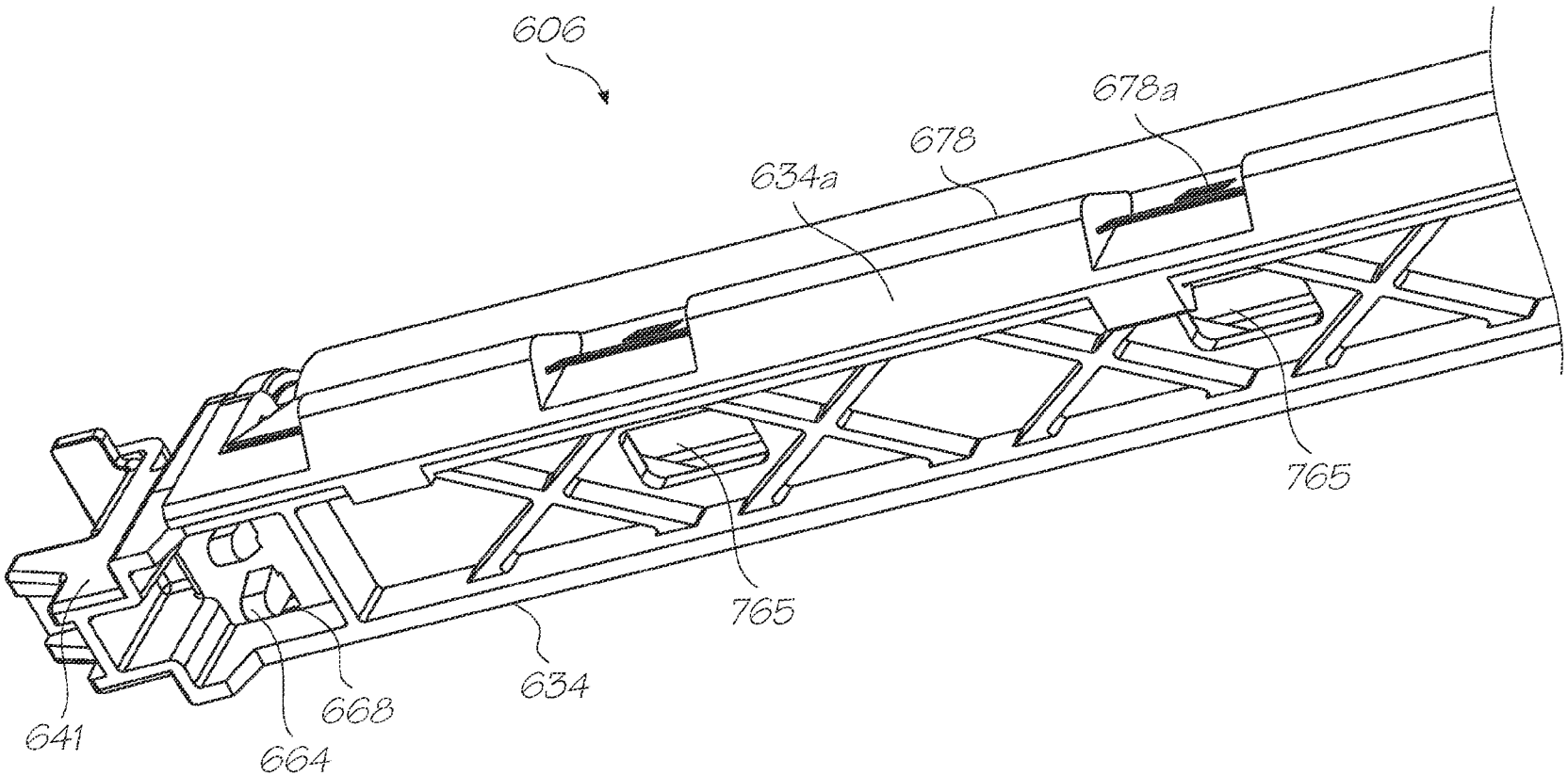
FIG. 24 illustrates a close up view of another end of the wiper module.
Figure 25:
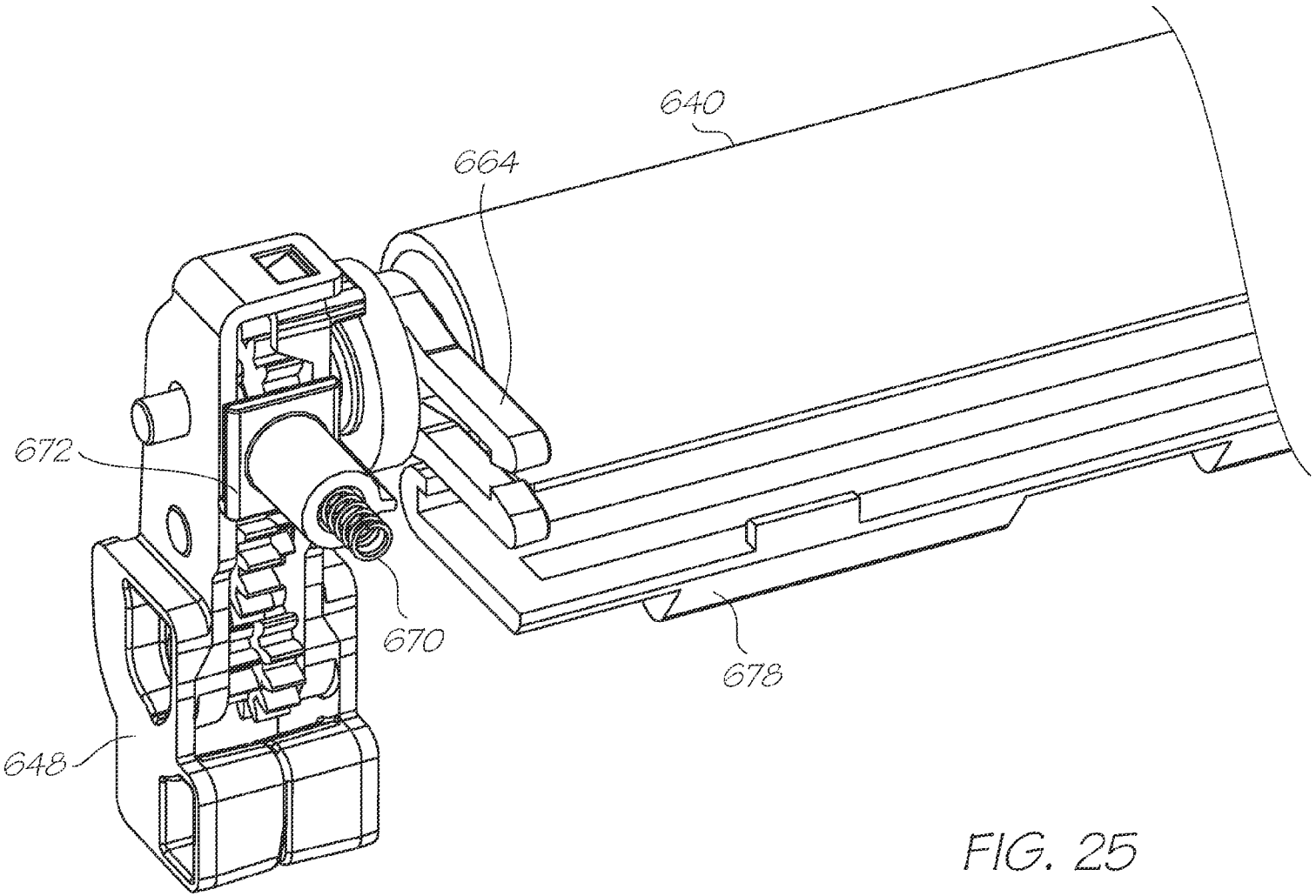
FIG. 25 illustrates an exemplary spring arrangement of a wiper element of the wiper module.

The largest diameter section 660*a* is configured to receive a clip 664. An end portion 666 at the other longitudinal end of the shaft 642 similarly has two sections of different diameter, with the smaller diameter section configured to receive another collar 662 and the larger diameter section configured to receive another clip 664. The clips 664 are passed through apertures 668 in the corresponding ends of the body 634, as illustrated in FIGS. 23 and 24, to be clipped to the body 634. This clipping removably and rotatably secures the wiper element 640 to the body 634.

In this secured assembly, the retainer element 639 at one end of the body 634 has a bay 639*a* in which the swing arm 648 is received and a notch 639*b* in which the section 660*b* of the end portion 660 of the shaft 642 is supported between the corresponding collar 662 and the swing arm 648. The retainer element 641 at the other end of the body 634 has a notch 641*a* in which the smallest diameter section of the end portion 666 of the shaft 642 is supported with the corresponding collar 662 butted thereagainst. As illustrated, the notches 639*b*,641*a* define semi-circular openings each having a radius which is fits the radius of the corresponding cylindrical sections of the shaft 642.

As the wiper module 606 is lifted from the frame 614 of the sled 602 into its operational position, the second gear 656 contacts the gear 106*a* of the driven roller 106*b*. Rotation of the driven roller 106*b* by a drive motor 110 of the printer 100 is imparted to the second gear 656 via the gear 106*a*. This rotation is transferred to the shaft 642 through the gear train 646 thereby rotating the wiper roller 640. This rotation of the wiper roller 640 is used to wipe ink from the printing face of the printhead 200, as discussed in detail below.

In the illustrated embodiment, the gear train gears down the rotational speed of the driven roller at a 3:1 ratio, because of the high speed of the driven roller, which is used to transport as many as 120 pages per minute past the printhead 200. However, other arrangements are possible to provide a suitable rotational speed of the wiper roller, such as a different gearing ratios and/or a variable speed drive motor.

By this arrangement, rotation of the wiper element 636 is driven by the drive motor 110 of the input rollers 106 of the printer 100. This eliminates the need for a additional dedicated motor for the wiper module 606, thereby reducing the number of parts and power requirements of the maintenance system 600. In order to separate the media driving and wiper driving aspects of the input rollers 106, the drive motor 110 is preferably a reversible motor and the control electronics 802 controls the motor 110 so that the drive roller 106*b* is driven in a first rotational direction when transporting media for printing, and in a second rotational direction, opposite the first direction, when driving the wiper roller 636. However, driving in the same direction is possible.

The driven roller 106*b* is mounted within the body 102 of the printer 100 as illustrated in FIGS. 6 and 7 so that contact between the second gear 656 of the wiper element 636 and the gear 106*a* of the driven roller 106*b* occurs prior to the wiper module 606 reaching its wiping position relative to the printhead 200 at which the wiper roller 640 comes into contact with the printing face of the printhead 200. In this way, the wiper roller 640 is already rotating as it contacts the printhead 200. This rotating contact prevents the wiper roller 640 from blotting the nozzles of the printhead 200, which could otherwise disturb the menisci within the nozzles.

Figure 22A:
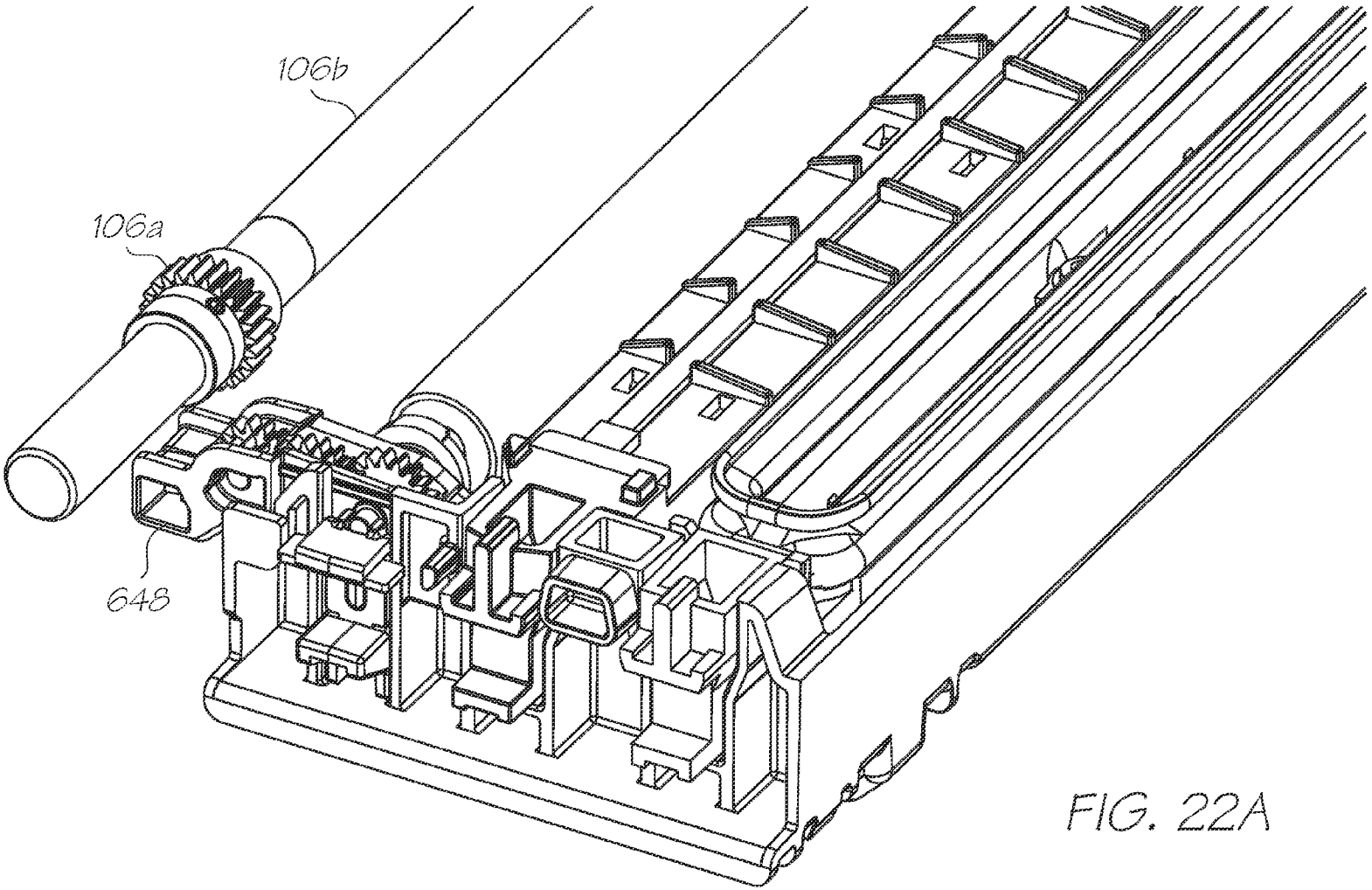
FIGS. 22A and 22B illustrate different positions for the wiper module relative to a driven roller of the printer.
Figure 22B:
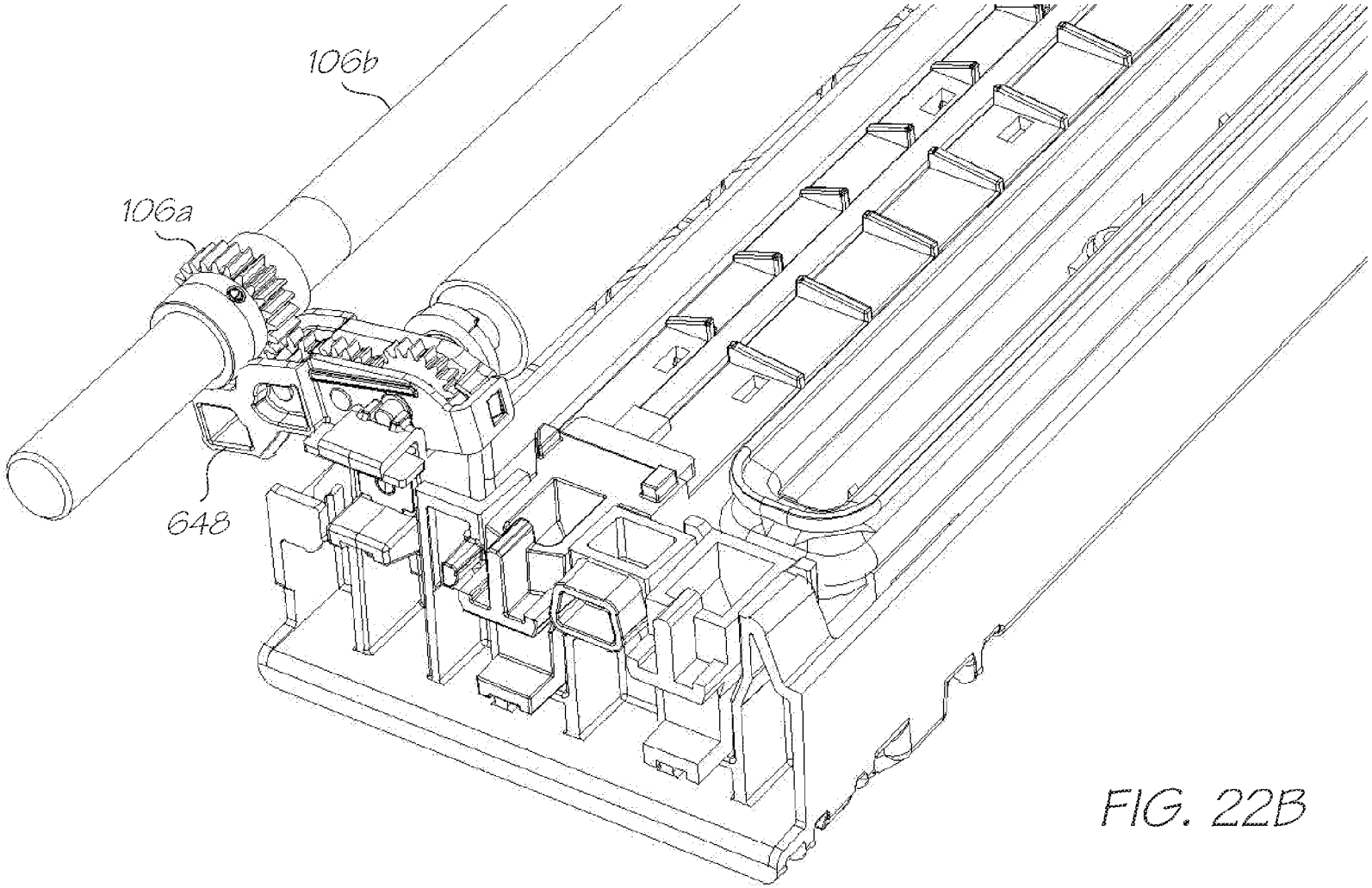

As the wiper module 606 is transitioned from its contact position with the driven roller 106*b* of the printer 100 to its wiping position the contact, and therefore driving transmission, between the second gear 656 and the gear 106*a* of the driven roller 106*b* is maintained by resilient swinging of the swing arm 648, as illustrated in FIG. 22B.

The swing arm 648 is able to swing relative to the body 634 of the wiper module 606 due to a pivot point about the shaft 642 secured within the holes 650*a*.650*b* of the arms 650,652 of the swing arm 648. Resistance to this swinging is provided by a spring 670 so that the second gear 656 of the swing arm 648 is urged against the contact gear 106*a* of the driven roller 106*b*. This urged contact is further facilitated by mounting the gear 106*a* on the drive roller 106*b* using a spring pin 106*c* (see FIG. 22B). In the illustrated embodiment of FIG. 25, the spring 670 is held within a plunger 672 between a lower surface of the arms 650,652 and an aperture 674 in the body 634, as illustrated in FIG. 23. This arrangement anchors the spring 670 to the body 634 at one end of the spring, thereby creating a cantilevered spring. The illustrated spring 670 is a compression spring, however other springs, such as a bent cantilevered spring, or other biasing means can be used so long as the swing arm is biased toward the drive roller gear.

This biased contact of the swing arm and the driven roller of the printer not only provides rotation of the wiper roller prior to contact with the printing face of the printhead, as discussed above, but also keeps the wiper roller rotating throughout the wiping contact and after the wiper module is lowered from the printhead. In the illustrated embodiment, the rotational speed imparted to the wiper roller is about 20 millimeters per second. Accordingly, the wiper roller is prevented from being in stationary contact with the printhead at any point during operation of the wiper module, which prevents blotting as discussed above and prevents deformation of the wiper roller about its circumference.

The rotational wiping of ink, other fluids and debris, such as media dust and dried ink. from the printing face of the printhead 200 by the wiper roller 640 is primarily performed after priming of the printhead 200 (see the incorporated description of the Applicant's U.S. Provisional Patent Application No. 61/345,552 and after completion of a printing cycle. However, wiping can be performed at any time through selection of the wiper module 606.

The removal of ink and other fluids from the printing face of the printhead 200 is facilitated by forming the wiper roller 640 of a porous wicking material which is compressed against the printing face so as to encourage wicking of the fluid into the wiper roller 640, and the removal of debris from the printing face is facilitated by the rotation of the wiper roller.

Figure 26:
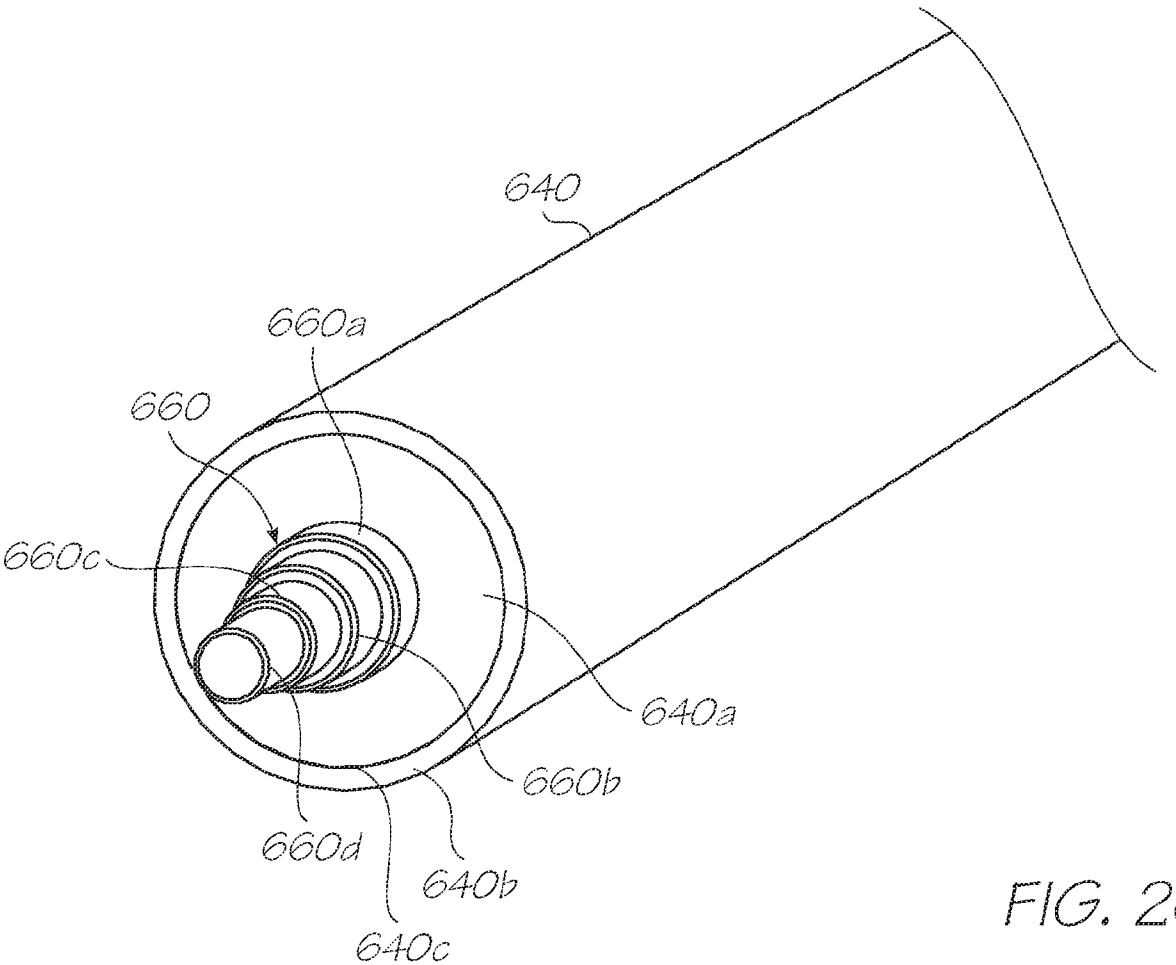
FIG. 26 illustrates a wiper roller in isolation from the wiper element.

In the illustrated embodiment of FIG. 26, the wiper roller 640 has a compressible core 640*a* mounted to the shaft 642 and a porous material 640*b* provided over the core 640*a*. In the exemplary embodiment, the core 640*a* is formed of extruded closed-cell silicone or polyurethane foam and the porous material 640*b* is formed of non-woven microfiber. Using microfiber prevents scratching of the printing face, whilst using non-woven material prevents shedding of material strands from the wiper roller and into the nozzles of the printhead. The non-woven microfiber is wrapped about the core by a spiraling technique so that at least two layers of the microfiber are present about the core with an adhesive between the layers. Using two or more layers provides sufficient fluid absorption and compressibility of the porous material from the core, which aids fluid absorption, whilst spiraling reduces the possibility of the porous material being unwrapped from the core during the high-speed rotation of the wiper roller.

In the illustrated embodiment, the outer diameter of the wiper roller is about 12 millimeters, and the amount deflection of the compressible wiper roller due to the pressing contact made on the printhead is about 0.5 millimeters. This configuration provides an absorption capacity of about four to five milliliters, at saturation, in the absorbent material 640*b* of the wiper roller 640. It has been found by the Applicant that about 20 wiping operations of the printhead accumulates about three milliliters of ink in the wiper roller.

The Applicant has found that the use of microfiber which is compressed against the printing face of the printhead whilst rotating the microfiber, causes ink to be drawn from the nozzles into the microfiber by capillary action. The amount of ink drawn from the nozzles is not so much that drying of the nozzles occurs, but is sufficient to remove any dried ink from the nozzles.

In order to prevent to core from absorbing the fluid collected in the microfiber, which could otherwise cause oversaturation of the wiper roller 640 leading to transfer of the absorbed fluid back to the printhead 200, a hydrophobic film 640*c* is disposed between the core 640*a* and the porous material 640*b*. In the exemplary embodiment, the film 640*c* is formed of a pressure sensitive adhesive. The use of the term "hydrophobic" is to be understood as meaning that any liquid, not only water, is repelled by the material which is said to be "hydrophobic".

Fluid and debris collected on the surface of the wiper roller 640 is further prevented from being transferred back to the printing face by the scraper element 638. The scraper element 638 has an elongate scraper 676 which contacts the outer porous material 640*b* of the wiper roller 640 along the elongate length of the wiper roller 640 so as to flick particles of debris from the wiper roller 640.

Figure 27:
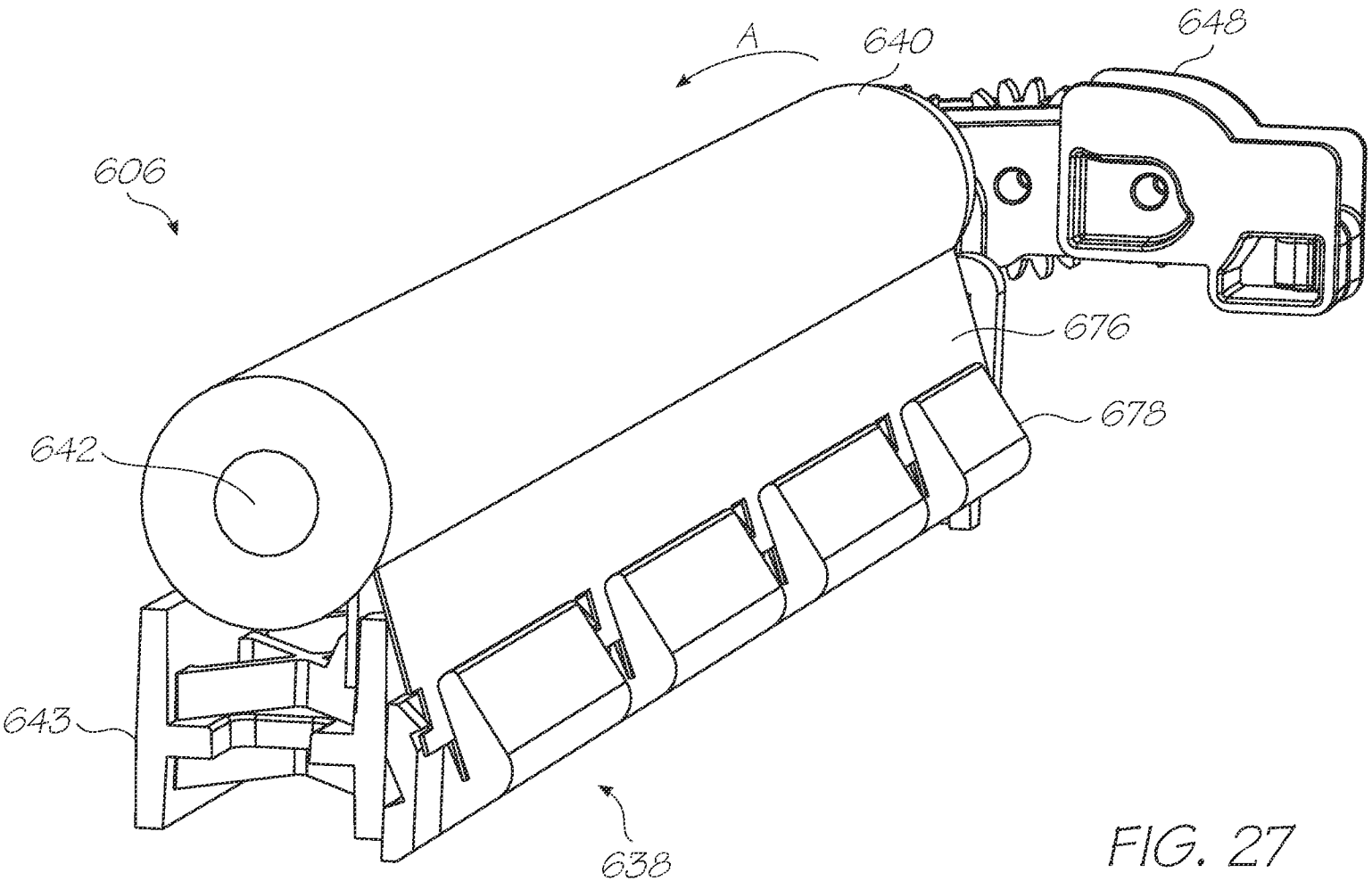
FIG. 27 is a cross-sectional view of the wiper module.

The scraper 676 is removably mounted to the body 634 of the wiper module 606 by a clip frame 678. The clip frame 678 is received by details 634*a* of the body 634 as illustrated in FIGS. 21 and 27, to secure the frame 678 to the body 634. The clip frame 678 has clips 678*a* which are removably received through holes 676*a* in the scraper 676 thereby clipping the scraper 676 to the frame 678.

This clipped assembly arranges the scraper 676 so as to contact the wiper roller 640 on a vertical circumferential region of the wiper roller below the upper circumferential region of the wiper roller which contacts the printing face of the printhead 200. The scraper 676 is disposed at a sloped angle relative to the wiper roller 640 by the secured frame 678, such that the sloped scraper 676 contacts the wiper roller 640 at a tangent to the circumference of the wiper roller 640.

Figure 50A:
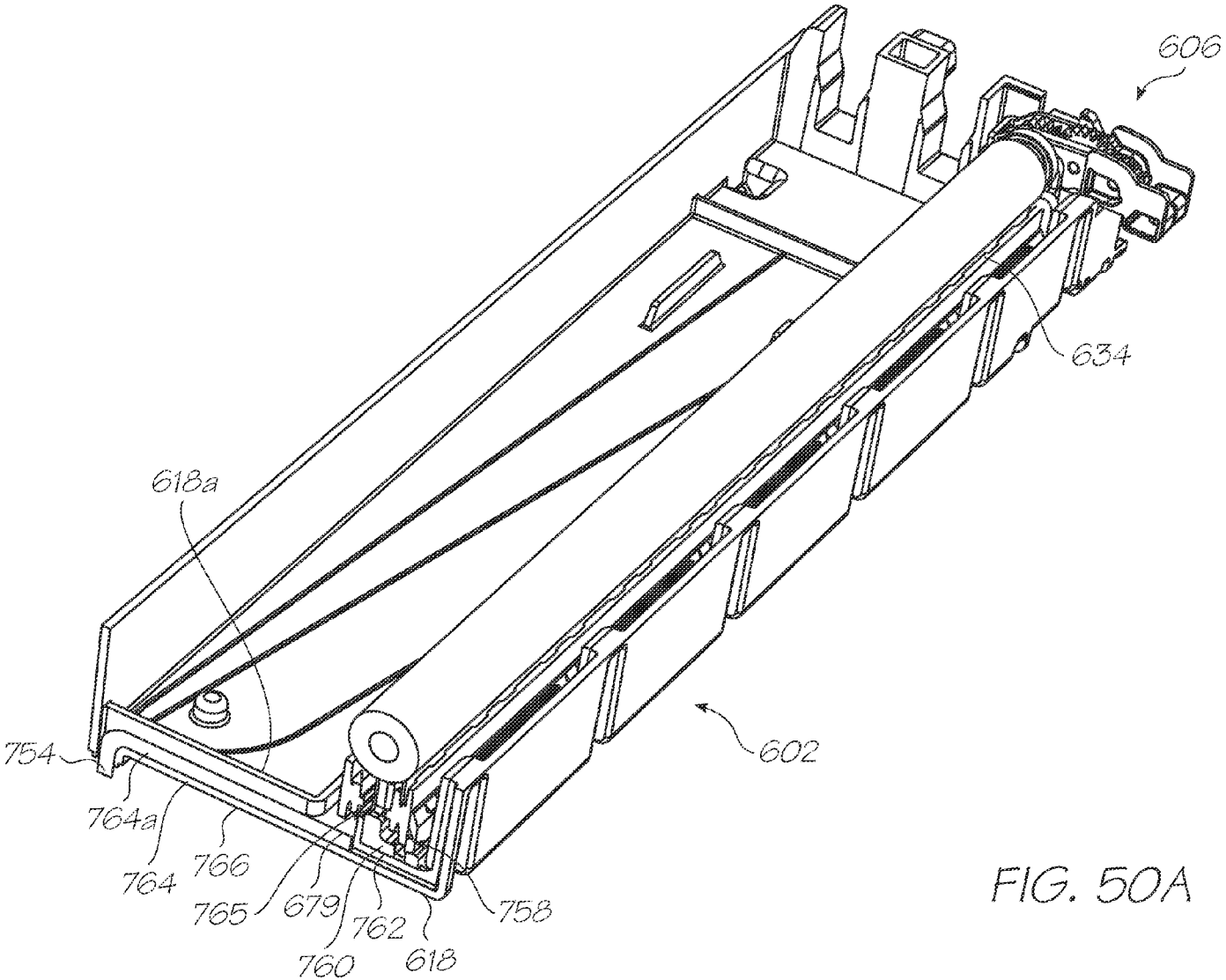
FIG. 50A is a cross-sectional view of the sled illustrating the wiper module position.
Figure 50B:
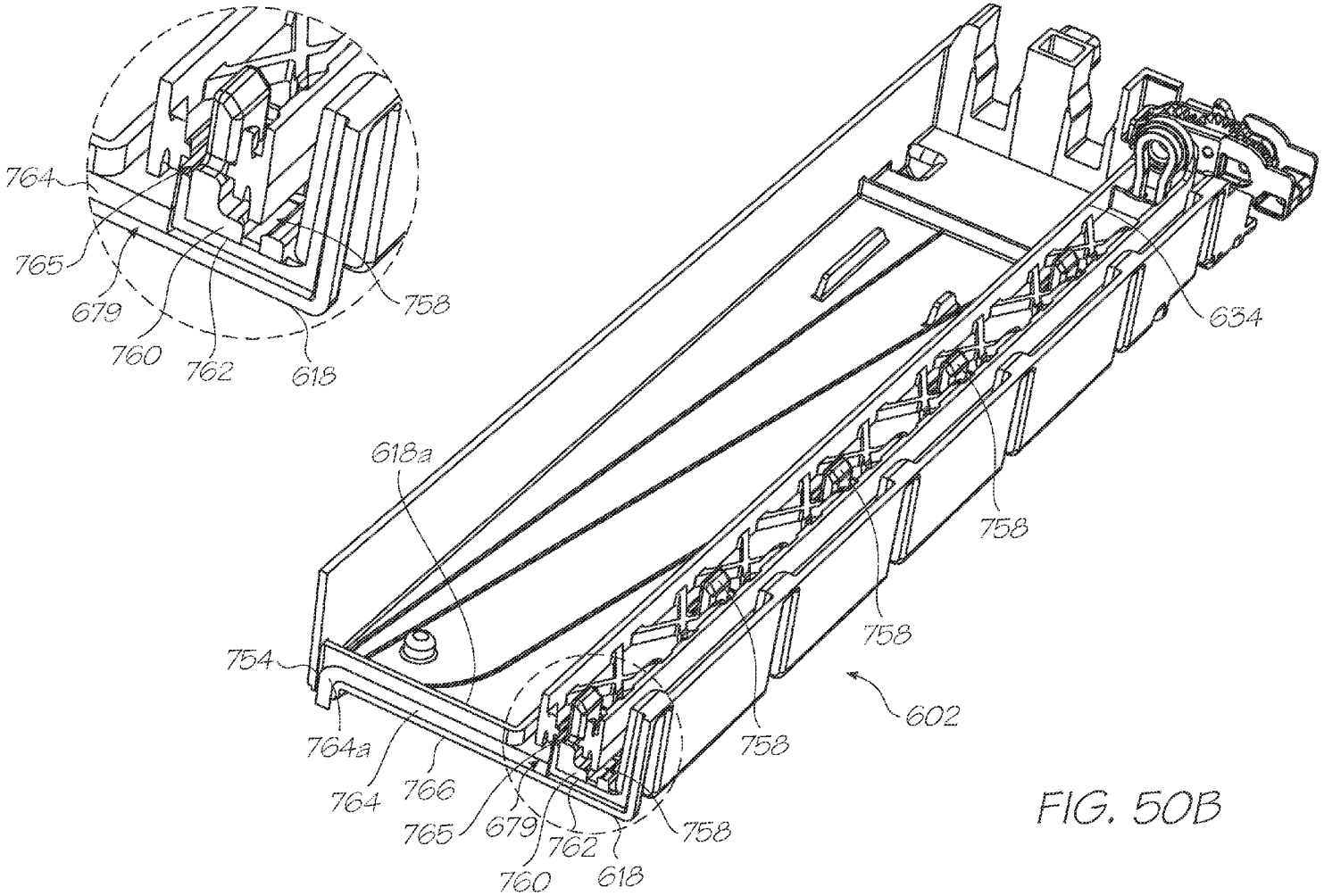
FIG. 50B illustrates the view of FIG. 50A with a wiper roller of the wiper module omitted.

In particular, the scraper 676 slopes into the wiper roller 640 as illustrated in FIG. 27 and exerts contact pressure on the compressible wiper roller 640 in a region of wiper roller 640 which is rotationally returning to the upper circumferential region of the wiper roller 640 in the rotational direction of arrow A illustrated in FIG. 27. That is, the scraper 676 is positioned upstream of the rotational wiping direction of the wiper roller 640. This positional arrangement ensures that particles are removed by the scraper 676 from portions of the wiper roller 640 prior to those portions re-contacting the printhead 200. Further, the contact pressure arrangement assists in draining of excess fluid absorbed by the porous material 640*b* from the wiper roller 640 through compression of the porous material 640*b* into a drainage area 679 in the base 618 of the sled 602, as is illustrated in FIGS. 47, 50A and 50B and is discussed in more detail later.

These functions of the scraper element 638 are assisted by employing a resiliently flexible scraper 676 which provides the contact pressure. In the preferred embodiment, the scraper 676 is a resiliently flexible sheet of Mylar with a thickness of about 0.2 millimeters, however other materials of different thickness which are inert to ink and other printing fluids can be used. The clipped assembly of the scraper 676 to the wiper module body 634 enables removal of the scraper 676 for cleaning or replacement if warping of the thin flexible sheet occurs.

FIGS. 28-31 illustrate various exemplary aspects of the capper module 608. The capper module 608 is an assembly of a body 680, a capper element 682 and a wick element 684. The body 680 is elongate so as extend along a length longer than the media width of the printhead 200 so that the wick element 684 extends at least the length of the media width. The capper module 608 is housed within the elongate frame 614 of the sled 602 so as to be adjacent the platen module 604, as illustrated in FIG. 8.

The notches 620*a* in the sidewalls 620 of the frame 614 removably receive retainer elements 686 at the longitudinal ends of the body 680 of the capper module 608. This engagement of the notches and retainers allows the capper module 608 to be held by the frame 614 in an unsecured, yet constrained manner. That is, the capper module effectively "floats" within the sled, which facilitates the displacement of the capper module relative to the sled. The capper module 608 is assembled in the frame 614 so that the capper element 682 faces the printhead 200 when the capper module 608 is in its operational position.

The capper module 608 is used to seal the nozzles of the printhead 200 after a printing cycle or during a non-printing phase, i.e., when printing is not taking place, so as to protect the printhead from dehydration. To achieve this, the capper module 608 is lifted so that the capper element 682 is pressed against the printing face of the printhead 200. The capper element 682 is formed as a elongate resilient lip having a length longer than the assembled length of the printhead ICs 204 along the printhead 200 so that the lip surrounds the printhead ICs 204. The material of the capper element 682 is preferably rubber, and more preferably butyl rubber, which provides low air permeability and a low water vapor transmission rate, whilst being inert to ink.

Figure 30:
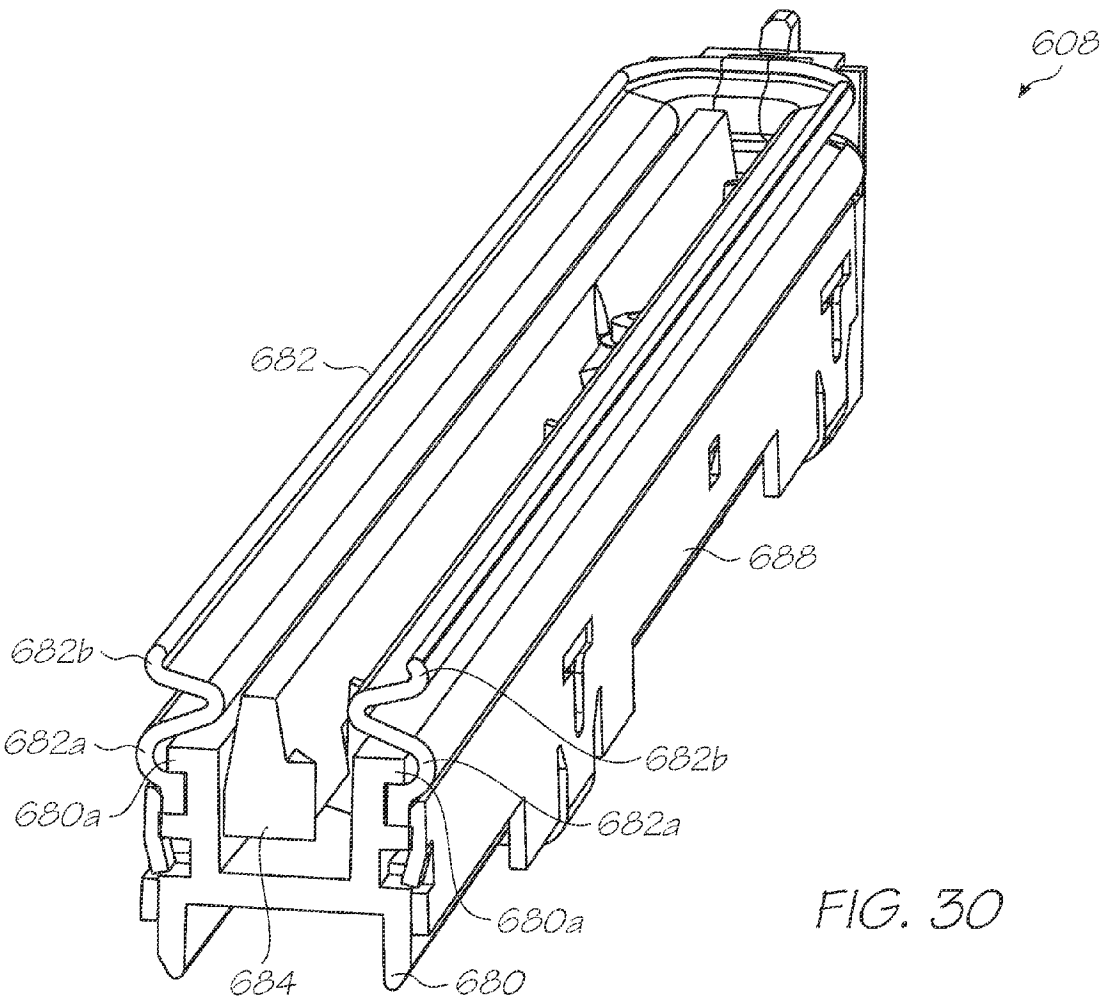
FIG. 30 is a cross-sectional view of the capper module.

Sidewalls of the capper element lip have a wave profile as illustrated in FIG. 30, which facilitates compression of an outer surface of the capper element 682 onto the printing face for sealing. In particular, the wave profile of the lower section of the sidewalls of the capper element lip defines a groove 682*a* configured to be held over a ridge 680*a* of the body 680. In assembly, the flexible material of this lower section of the capper element 682 is stretched over the ridge 680*a* and is then allowed to contract over the ridge 680*a* so as to be retained. This arrangement eliminates the need to glue the capper element 682 to the body 680 which could otherwise cause adhesion of the capper element 682 to the printhead 200.

By suitable relative configuration of the capper element 682 and the body 680 the flexible material of the capper element 682 is compressed against the body 680 thereby providing a hermetic seal therebetween. The use of the term "hermetic" in relation to a seal is to be understood as meaning that the seal is considered fluid tight, and therefore prevents transmission of fluids including gases and liquids through the seal which is termed "hermetic".

Figure 31:
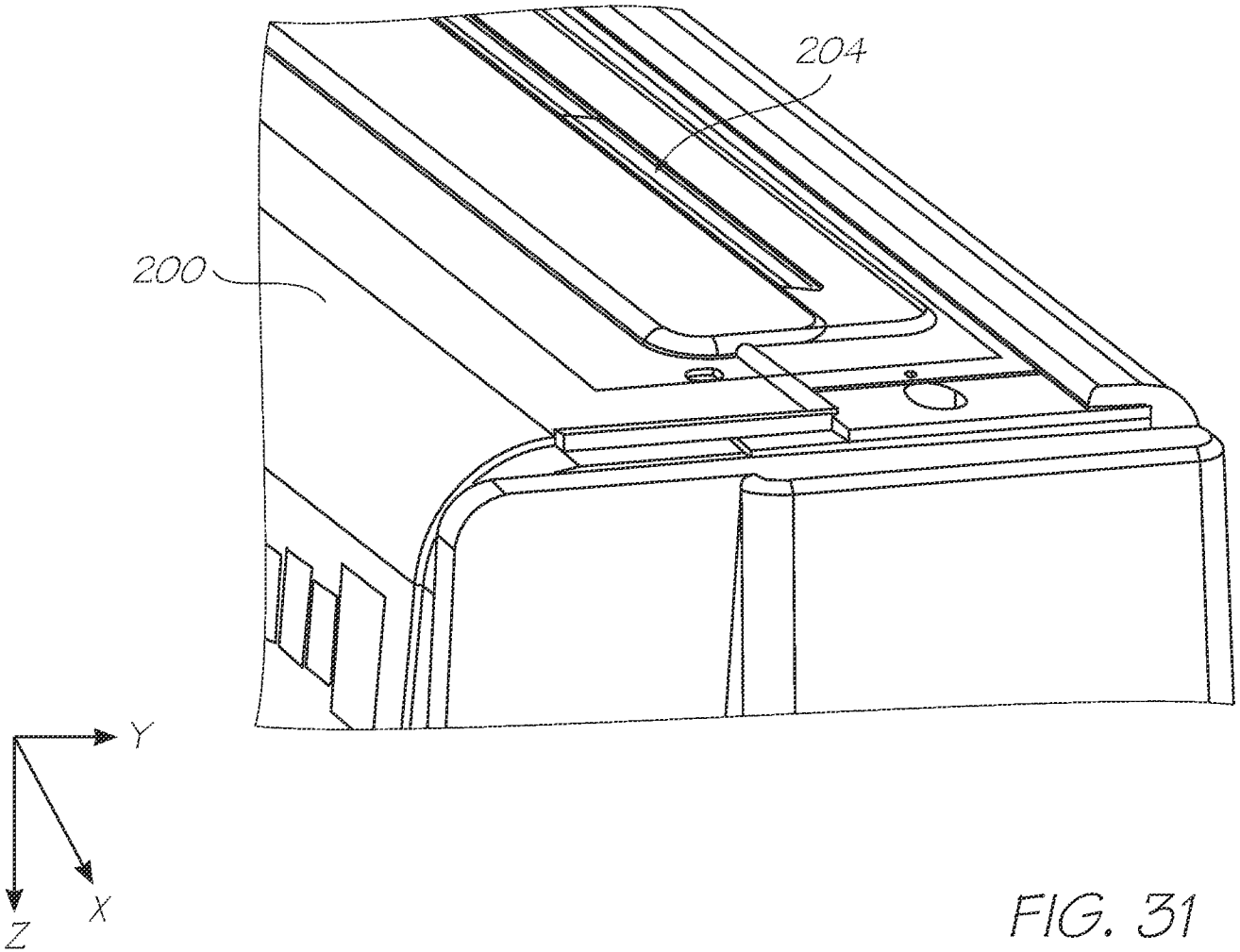
FIG. 31 illustrates a portion of a printing face of the printhead.

The wave profile of the upper section of the sidewalls of the capper element lip defines a cantilevered beam 682*b* terminating at a free outer surface 682*c*. When the outer surface 682*c* is pressed against the printing face of the printhead 200, the cantilevered beam 682*b* of the capper element 682 allows the capper element 682 to hermetically seal over the surface topography of the printing face, which may take the form illustrated in FIG. 31. In FIG. 31, the dotted line illustrates the approximate location of the seal provided by the capper element 682 which can be seen as traversing different levels on the printing face. These different levels are defined in the drawing along with typical negative z-axis height values relative to the printhead ICs 204 of the various features of the printing face, where the z-axis is normal to the printing face as shown.

The flexibility of the cantilevered section 682*b* of the capper element 682, also assists in smooth engagement and disengagement of the capper element 682 with the printhead 200. Providing smooth engagement and disengagement reduces the possibility of disturbing the ink menisci in the nozzles of the printhead 200, due to bumping of the printhead 200 during capping and un-capping.

The body 680 of the capper module 608, as well as the body 610 of the platen module 604 and the body 634 of the wiper module 606, are preferably molded from a plastics material having thermal expansion characteristics similar to the thermal expansion characteristics of the printing face of the printhead 200. Such a material is a 10% glass fibre reinforced combination of polyphenylene ether and polystyrene, such as Noryl 731. This provides registration of the selected modules with the printhead 200 during all operational states of the printer.

In the case of the capper module 608, the uniformly distributed force acting downward on the capper module 608 in its capped position due to the sealing deflection of the capper element 682 can cause sagging of plastics material of the elongate capper module 608, which could compromise the seal of the capper element 682. In order to prevent this, an elongate stiffening frame 688 is clipped over the body 680. The stiffening frame 688 is a rigid U-shaped channel member which assists in preventing the elongate capper module 608 from sagging and maintains straightness of the capper module 608 along its length. This ensures that the relative positions of the capper module and printhead remain substantially constant during capping.

The stiffening frame 688 is preferably formed of sheet metal. Accordingly, a thermal expansion mismatch may occur between the body 680 and the stiffening frame 688, thereby asserting additional stresses on the body 680 which could circumvent the straightening function of the stiffening frame 688. This thermal mismatch is accommodated by providing the stiffening frame 688 with a degree of freedom along its elongate length. In particular, slots 688*a* on both sidewalls of the channel formed by the stiffening frame 688 which clip over tabs 690 on the sides of the body 680 are formed so that they are larger than the tabs 690, thereby allowing so movement along the elongate length of the body 680 relative to the stiffening frame 688.

Secured retention of the capper element 682 on the body 680 about the groove 682*a* and ridge 680*a* is also improved by the stiffening frame 688, which presses against the engaged groove 682*a* and ridge 680*a*, as illustrated in FIG. 30.

As illustrated in the drawings, the lip formed by the capper element 682 together with a channel 692 within the body 680 provides a hollow space within capper module 608. This hollow space formed by the channel 692 is configured to be aligned with the printhead ICs 204 of the printhead 200 when the capper module 608 is in its operational position, and provides a means for further functions of the capper module 608.

During capping of the printhead 200, priming of the printhead 200 and keep-wet spitting operations may be carried out. For further details on the priming procedure see the incorporated description of Applicant's U.S. Provisional Patent Application No. 61/345,552. Accordingly, the channel 692 of the capper module 608 is used to capture the fluid ejected by the printhead nozzles during these priming and keep-wet operations.

The various priming procedures performed cause ejection of relatively large volumes of ink in a short span of time, up to 10 milliliters in two seconds. Accordingly, the interior volume of the capper module is dimensioned to accommodate this large volume of ink whilst ensuring that the captured ink level (inclusive of any ink capillary action occurring around the inside perimeter of the capper element) does not reach the printing face of the printhead. Capture and extraction of the ink or other printing fluid ejected during keep-wet spitting and priming procedures is assisted by the wick element 684 which is disposed within the channel 692. In the illustrated embodiment, the wick element wicks about six to eight millimeters at this high flow rate and the capper module body provides flow paths of about eight millimeters around the wick element. The captured fluids are also quickly drained from the capper module, as is discussed later.

The wick element 684 is formed of a hydrophilic porous material which can be molded and has a porosity with a bead and void size which permits absorption of ink at the above-described large volumes and rate of ink ejection from the printhead. For example, hydrophilic polyethylene is preferred, which can be used to make the wick element 684 by a process akin to sintering, being molded together into its final shape.

Figure 32:
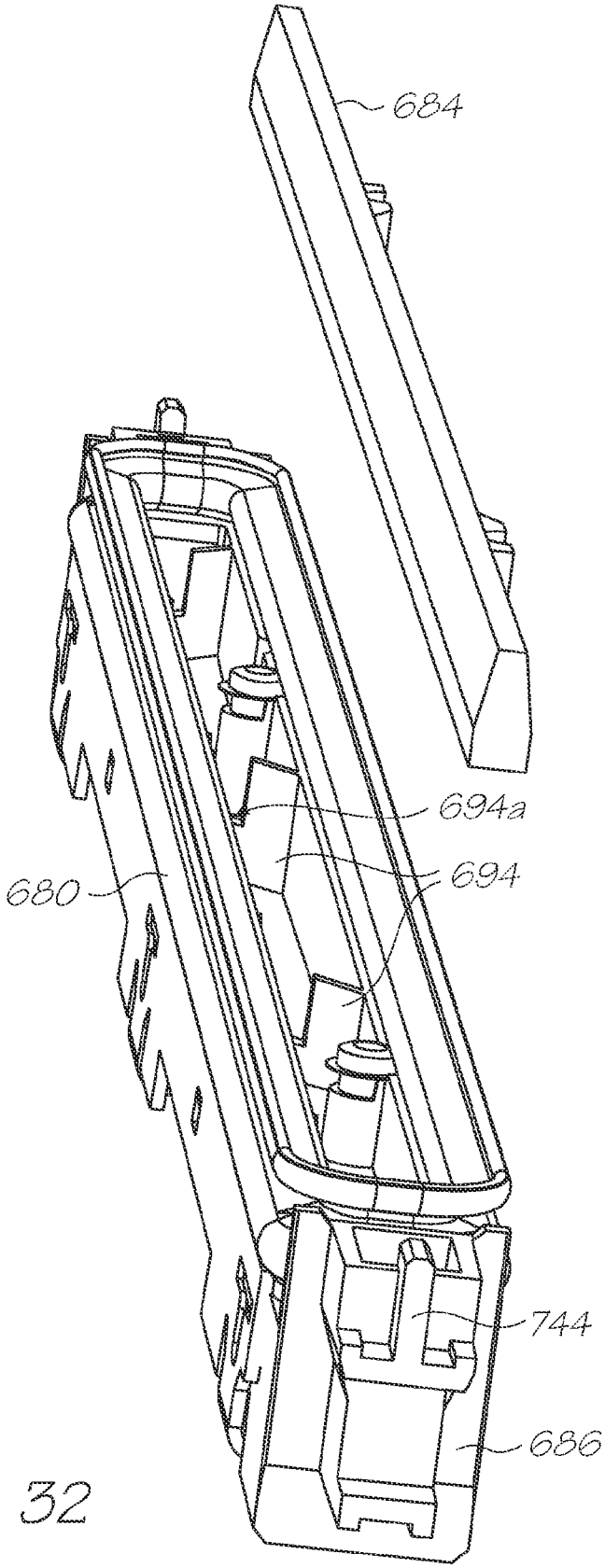
FIG. 32 illustrates the capper module with a capper element omitted and a wick element disassembled from the capper module.
Figure 33:
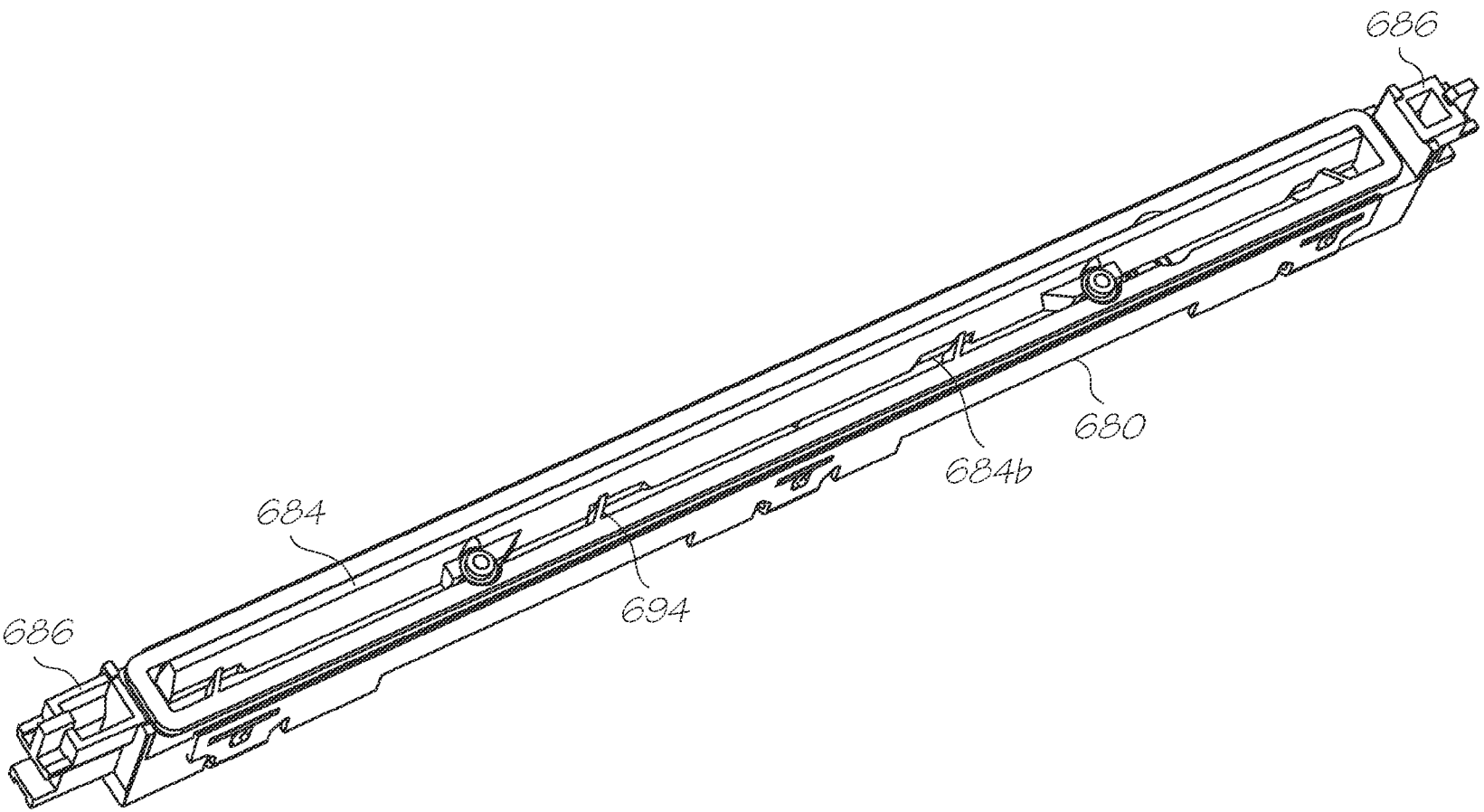
FIG. 33 illustrates the wick element assembled in the capper module.

As illustrated in FIGS. 32 and 33, the wick element 684 is elongate and shaped to fit within the channel 692 of the body 680 so as to extend along the length of the capper module 608. Ribs 694 are provided on a base 680*b* of the body 680 on which a lower surface 684*a* of the wick element 684 is supported. The wick element 684 has notches 684*b* defined along one elongate side thereof which engage with notches 694*a* in the ribs 694 on the corresponding side of the channel 692. This notched engagement constrains movement of the wick element 684 along the length of the body 680, which maintains accurate alignment of the wick element 684 along the combined length of the printhead ICs 204 of the printhead 200.

Figure 28:
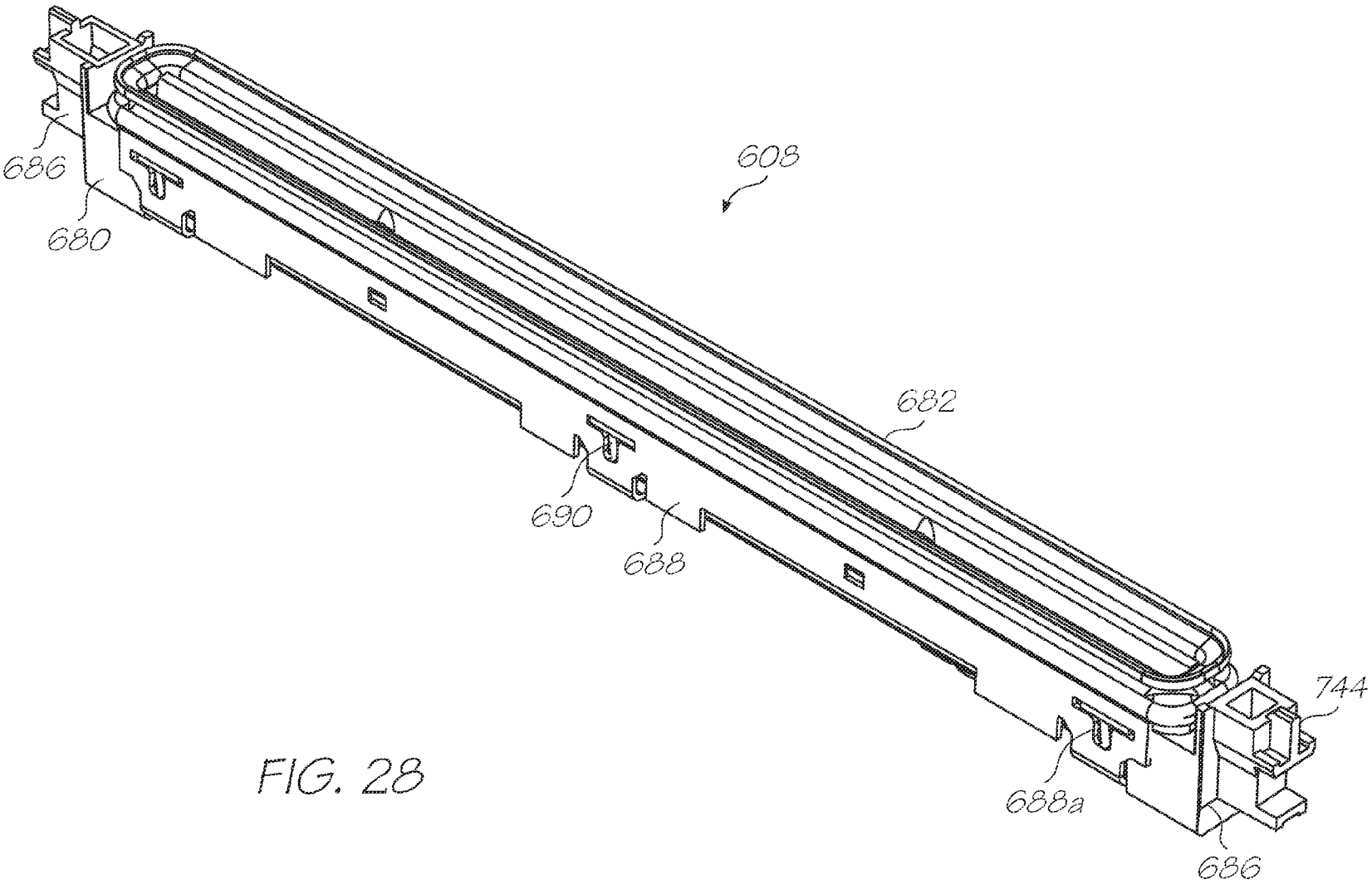
FIG. 28 an isometric view of a capper module of the sled.
Figure 29:
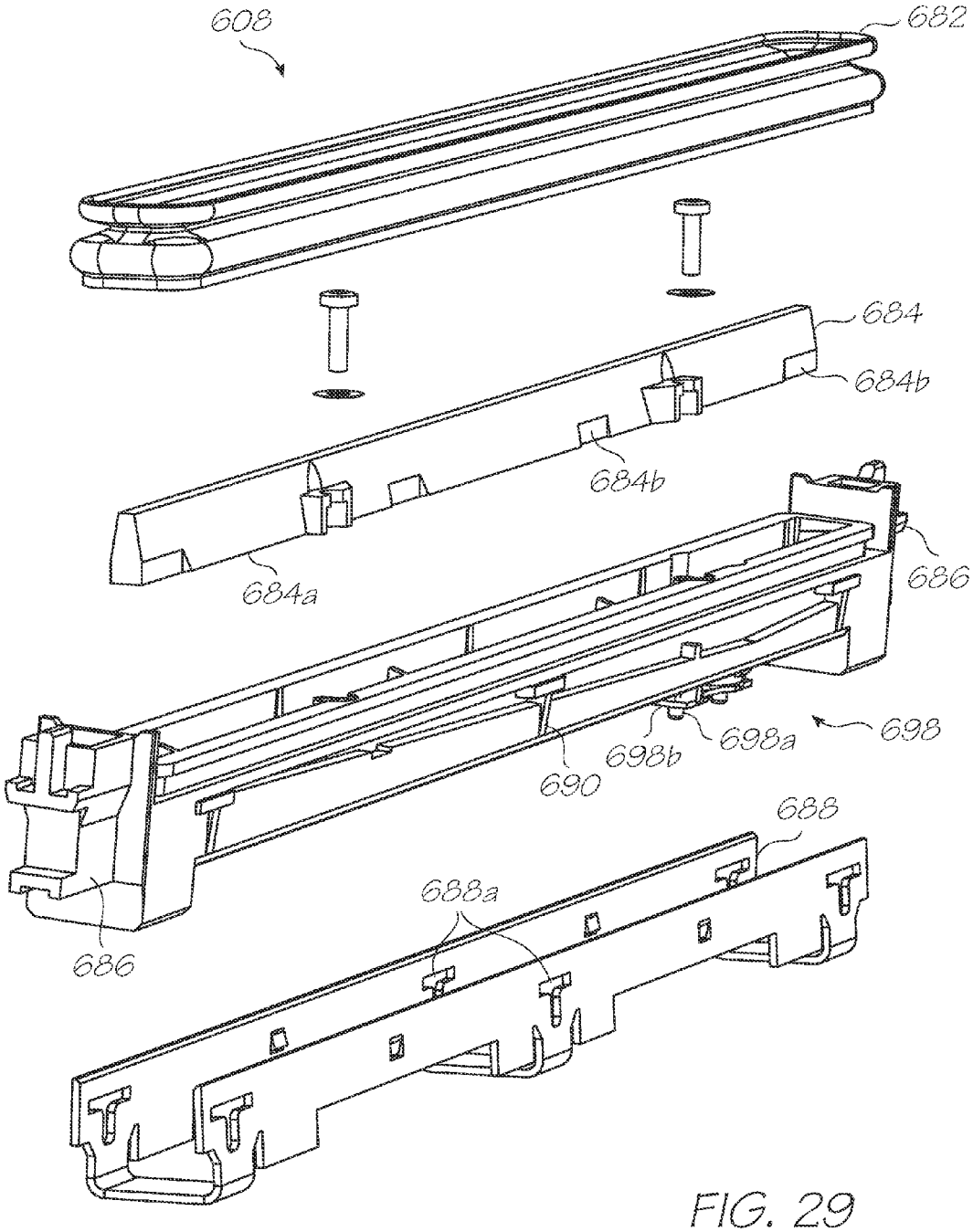
FIG. 29 is an exploded perspective view of the capper module.

In the illustrated embodiment, the wick element 684 is held within the body 680 by screws, however other arrangements are possible, such as clips or the like, so long as an upper surface 684*c* of the wick element 684 does not project past the capper element 682 with respect to the printhead 200, as illustrated in FIGS. 28 and 30, but is close enough to the nozzles of the printhead 200 so that a fluid 'bridge' is formed between the nozzles and the wick element 684 as a natural flow path for the ink.

In particular, the distance of the upper surface 684*c* of the wick element 684 from the nozzles, when the capper module 608 is in its capped position, is set so that the upper surface 684*c* comes into sufficient contact with the ink drops so as to wick off the maximum amount of ink before the flow path breaks off and so that the ink has a sufficient gap that induces break-off of the ink from the nozzles after priming, so that the fluid bridge does not remain. In the illustrated embodiment, the distance between the wick element 684 and the printhead ICs 204 is about 1.1 millimeters. The manner in which this distance is set is discussed in detail later.

This wicking effect between the nozzles and the wick element continues even after priming is complete. Therefore, the control electronics 802 is configured to allow a certain amount of dwell time between the end of the priming procedure and the un-capping operation. A dwell time of about 10 to 30 seconds has been found to be sufficient for the various priming procedures. This dwell time allows the ink bridge between the wick element and the nozzles to naturally drain and break on its own. If this process were prematurely interrupted, for example, by lowering the capper module from the capped position too soon, the printhead ICs, and localized surroundings, will likely be partially flooded with ink. Further, the wicking effect and allowed dwell time leaves a minimal amount of ink on the printhead 200 for the wiper module 606 to clean off after priming. This prevents large droplets of ink being left on the printhead 200 that would quickly saturate the wiper roller 640.

Once the wick element 684 is saturated with captured ink, the ink will tend to naturally drain through the wick element 684 through capillary action under gravity with respect to the assembled arrangement of the capper module 608 in the sled 602. The capillary drained ink through the porous body of the wick element is allowed to drain from the lower surface 684*a* of the wick element 684 into the underlying base 680*b* of the body 680 since the ribs 692 provide a space between the wick element 684 and the base 680*b*.

Both this drainage and offset aerosol capture, as discussed previously in relation to the platen module, are also assisted by forming the outer surfaces of the wick element 684 to be sloped in the media travel direction, as illustrated in FIGS. 30 and 32, and by offsetting the upper surface 684*b* of the wick element 684 from the printhead ICs. In this way, the ejected fluid strikes the wick element in its sloped regions thereby encouraging the captured fluid to be drawn away from the printing face and through the wick element. This reduces stagnation areas within the body of the wick element in which the fluid could dry causing reduction of effectiveness of the wick element.

Figure 34:
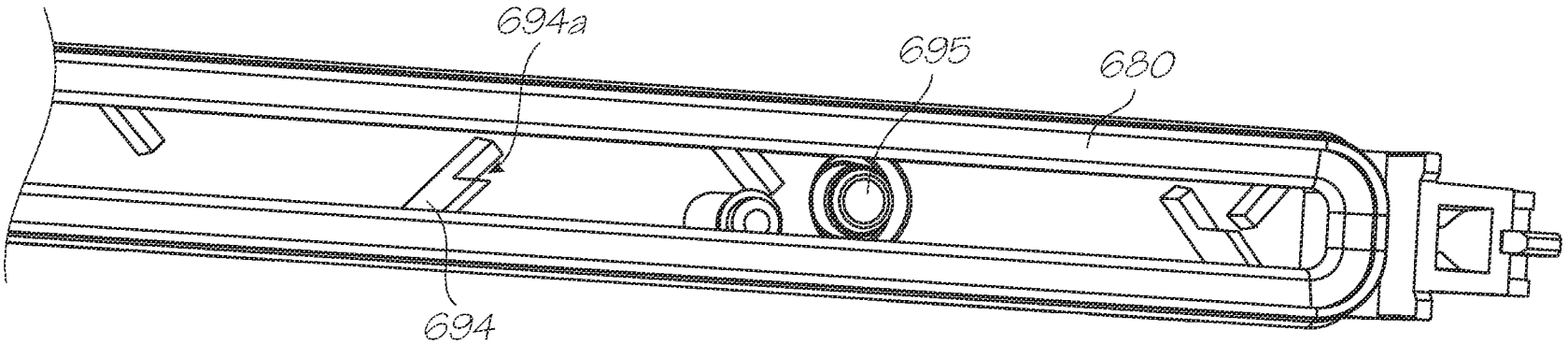
FIG. 34 illustrates a channel of the capper module with the wick and capper elements omitted.
Figure 35:
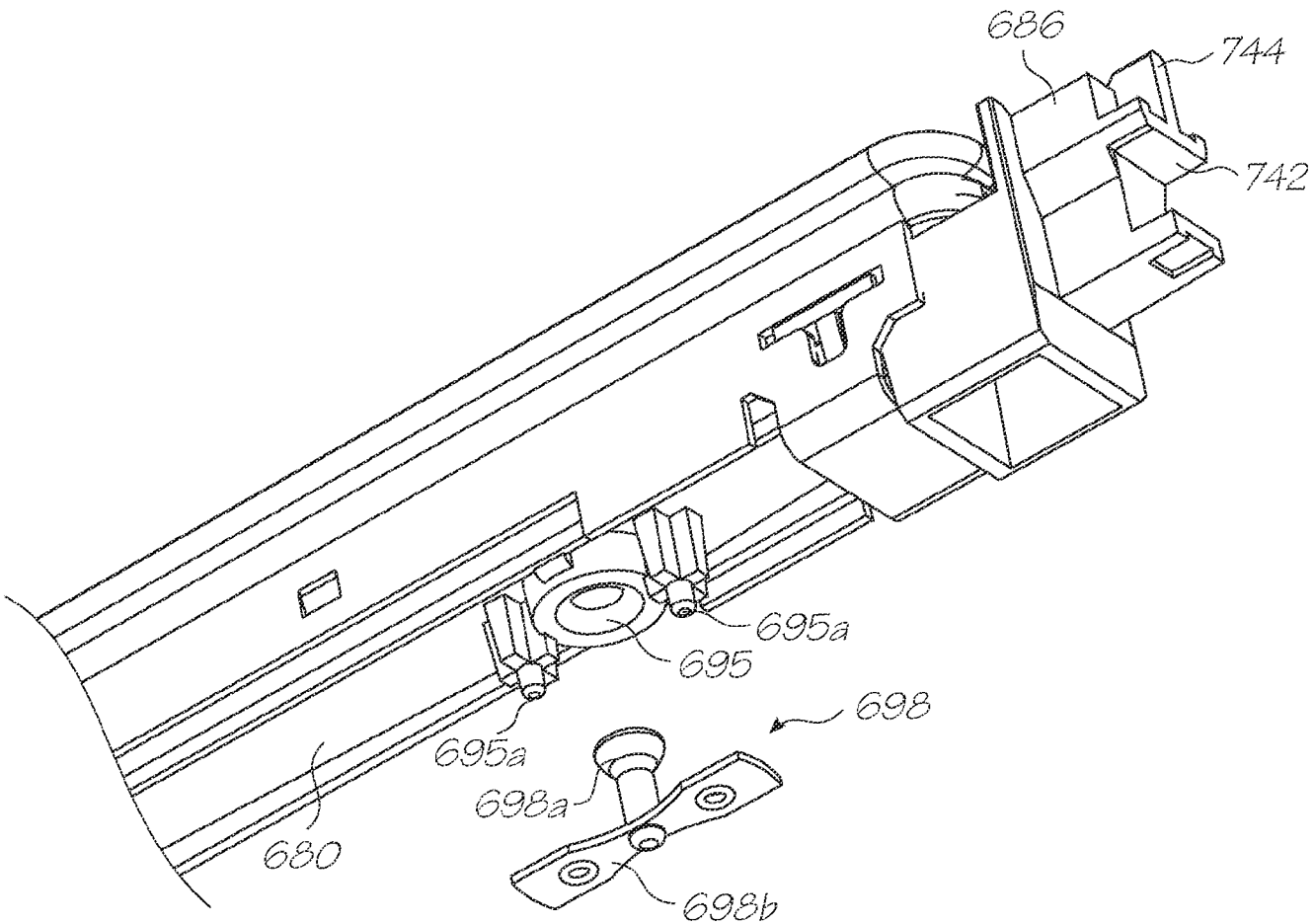
FIG. 35 illustrates a drainage port of the capper module with a valve disassembled from the port.
Figure 36:
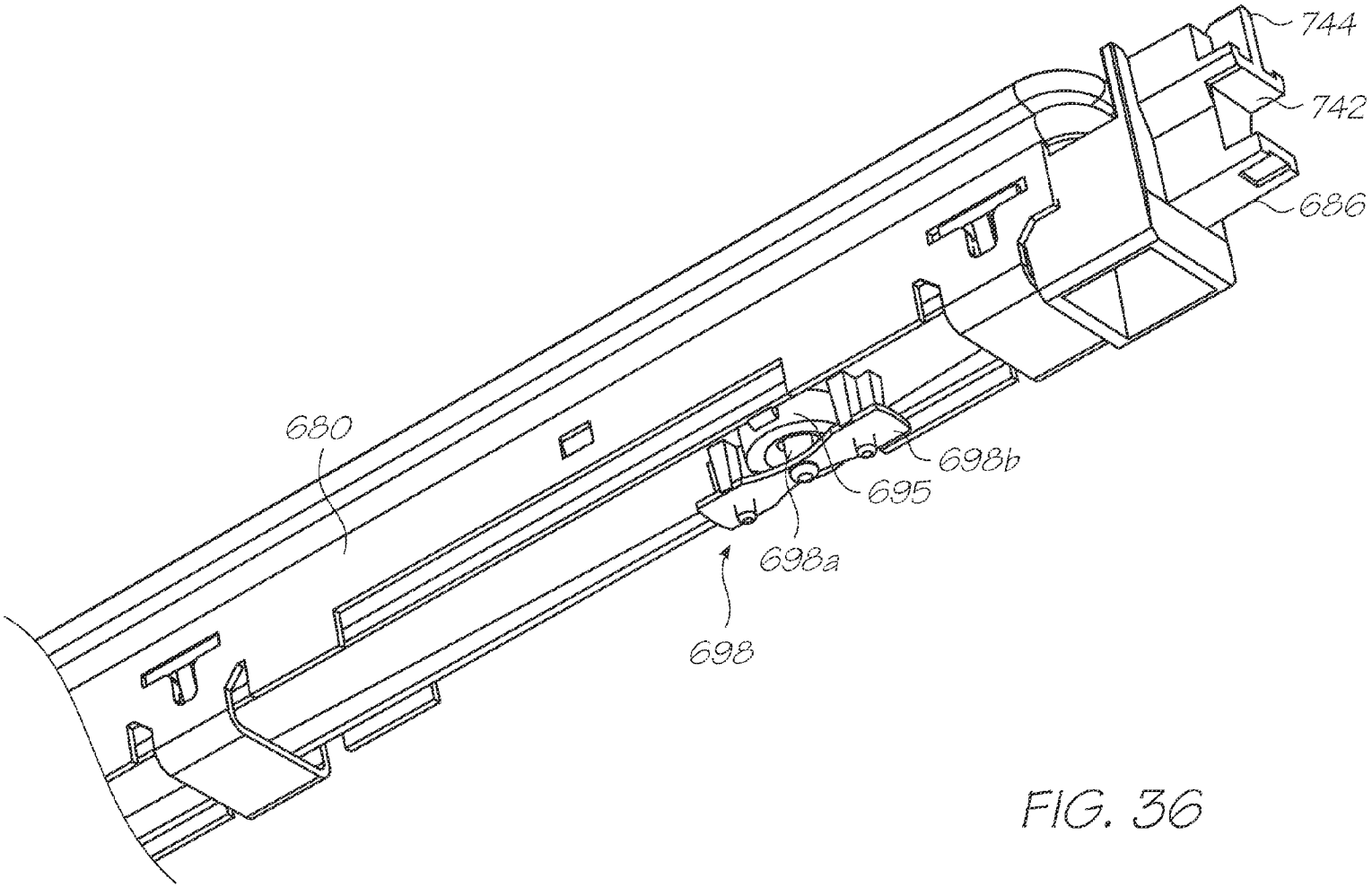
FIG. 36 illustrates the valve assembled in the port.
Figure 37:
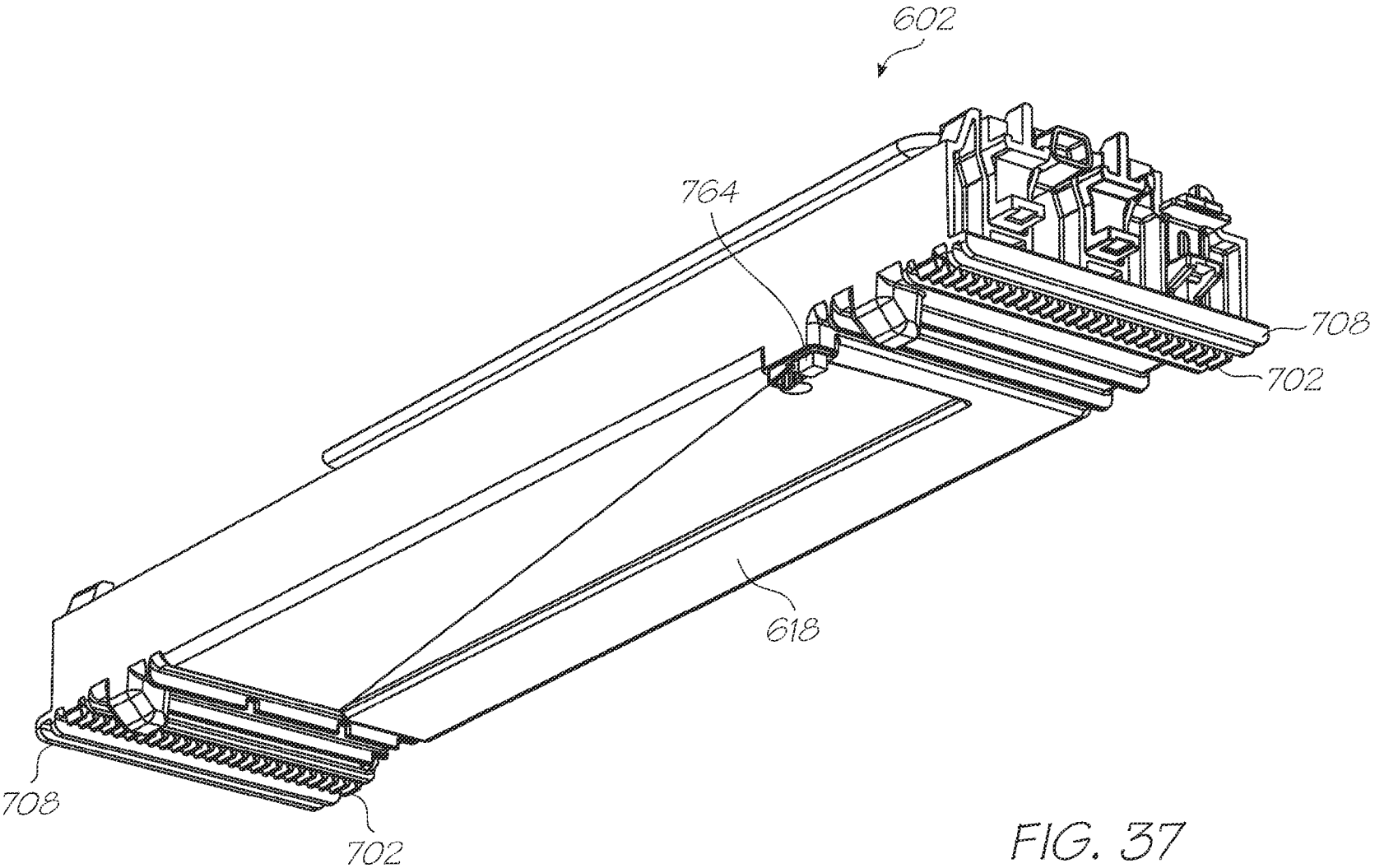
FIG. 37 is a bottom isometric view of the maintenance sled.
Figure 38:
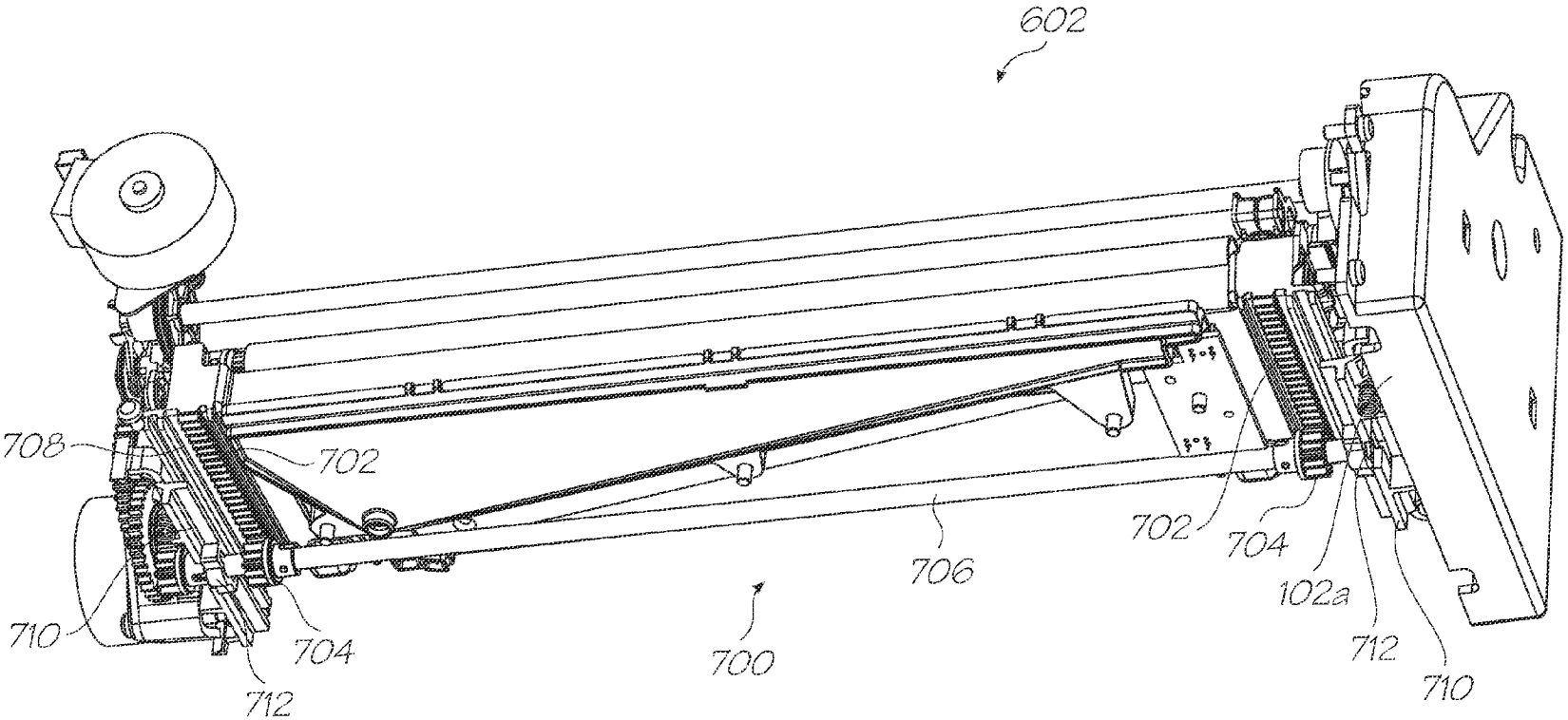
FIG. 38 illustrates a translation mechanism of the sled.
Figure 49:
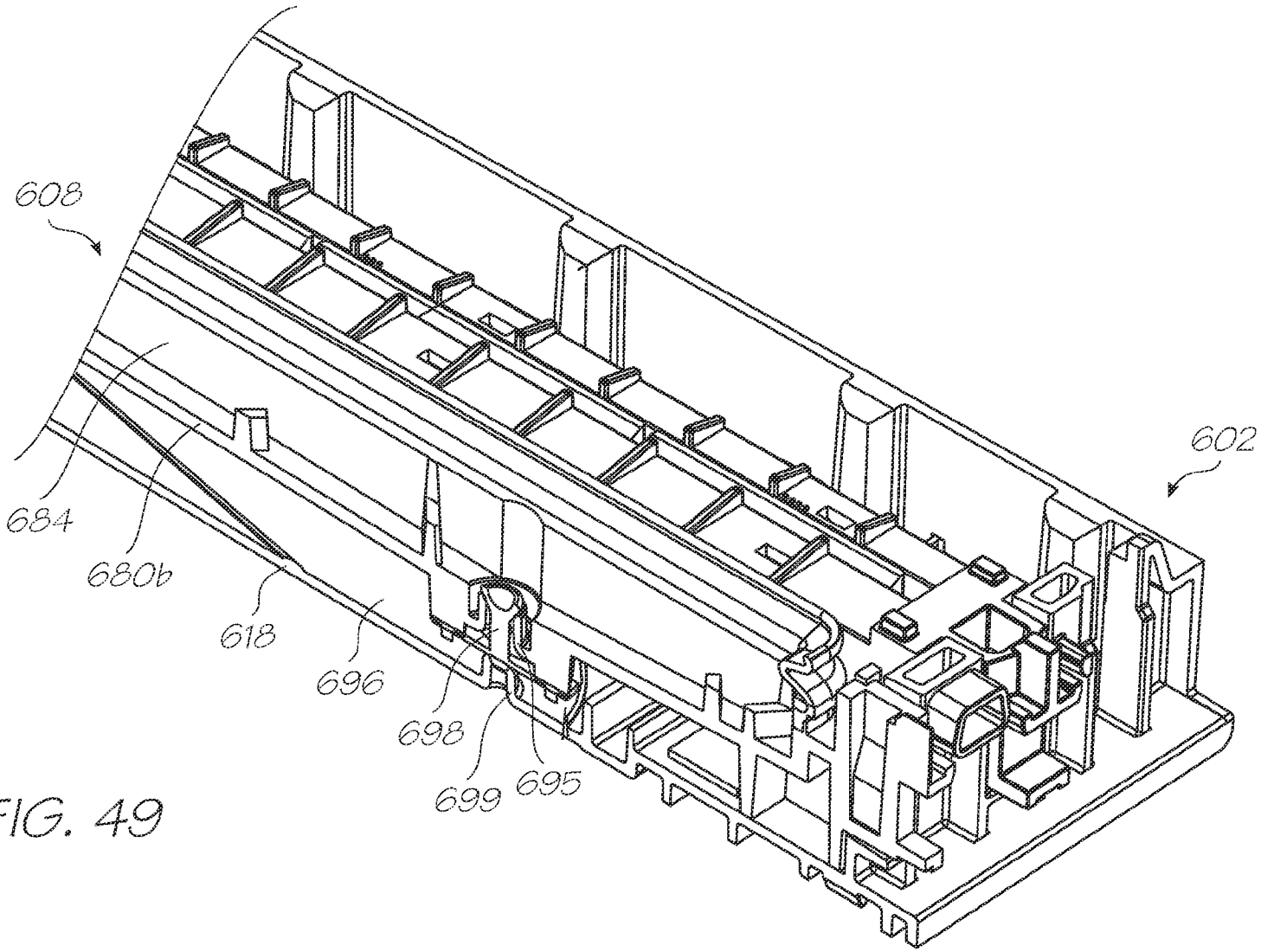
FIG. 49 is a cross-sectional view of the sled illustrating the capper module position.

When the capper module 608 is returned to its uncapped or home position in the sled 602, the fluid collected in the capper module 608 is allowed to drain from the capper module 608 to the underlying sled 602 via a port 695 through the base 680*b*, illustrated in FIGS. 34-36. To assist this draining, the base 680*b* is sloped toward the port 695, as illustrated in FIGS. 35, 36 and 49. The port 695 is aligned with a drainage detail 696 in the base 618 of the sled 602, as is illustrated in FIGS. 47 and 49 and is discussed in more detail later. A valve 698 is positioned in the port 695. The valve 698 is normally closed so that the capper module is completely hermetically sealed whilst in the capped position and during the travel of the capper module to and from the uncapped position within the sled 602, i.e., when the retainer elements 686 are fully received in the notches 620*a* of the frame 614.

In the illustrated embodiment, the valve 698 is a ball float valve having a ball float 698*a* connected to resiliently flexible wings 698*b*. The flexible wings 698*b* are connected to barbs 695*a* of the port 695 so that the wings 698*b* are able to bend about the barbs 695*a*, thereby moving the ball float 698*a* relative to the port 695. The normally closed position of the valve 698 is shown in FIG. 36 at which the wings 698*b* are un-flexed and the ball float 698*a* is held and sealed against the port 698. The valve 698 is opened upon return of the capper module 608 to the sled 602 by a valve actuator or projection 699 on the base 618 of the sled 602 coming into contact with and pressing the valve 698 to flex the wings 698*b* and move the ball float 698*a* away from the port 695 (see FIG. 49).

In the above-described embodiment, the fluid captured by the wick element and capper module is allowed to drain through and out of the wick and capper module under gravity. An alternative embodiment could employ suction by a suction pump connected to the capper module through tubing.

FIGS. 37-41 illustrate various exemplary aspects of a displacement mechanism 700 for the modular sled 602. The displacement mechanism 700 is used to provide the selective displacement of the sled 602 relative to the housing 102 of the printer 100 and the printhead 200 which selectively aligns each of the maintenance modules with the printhead.

Figure 39:
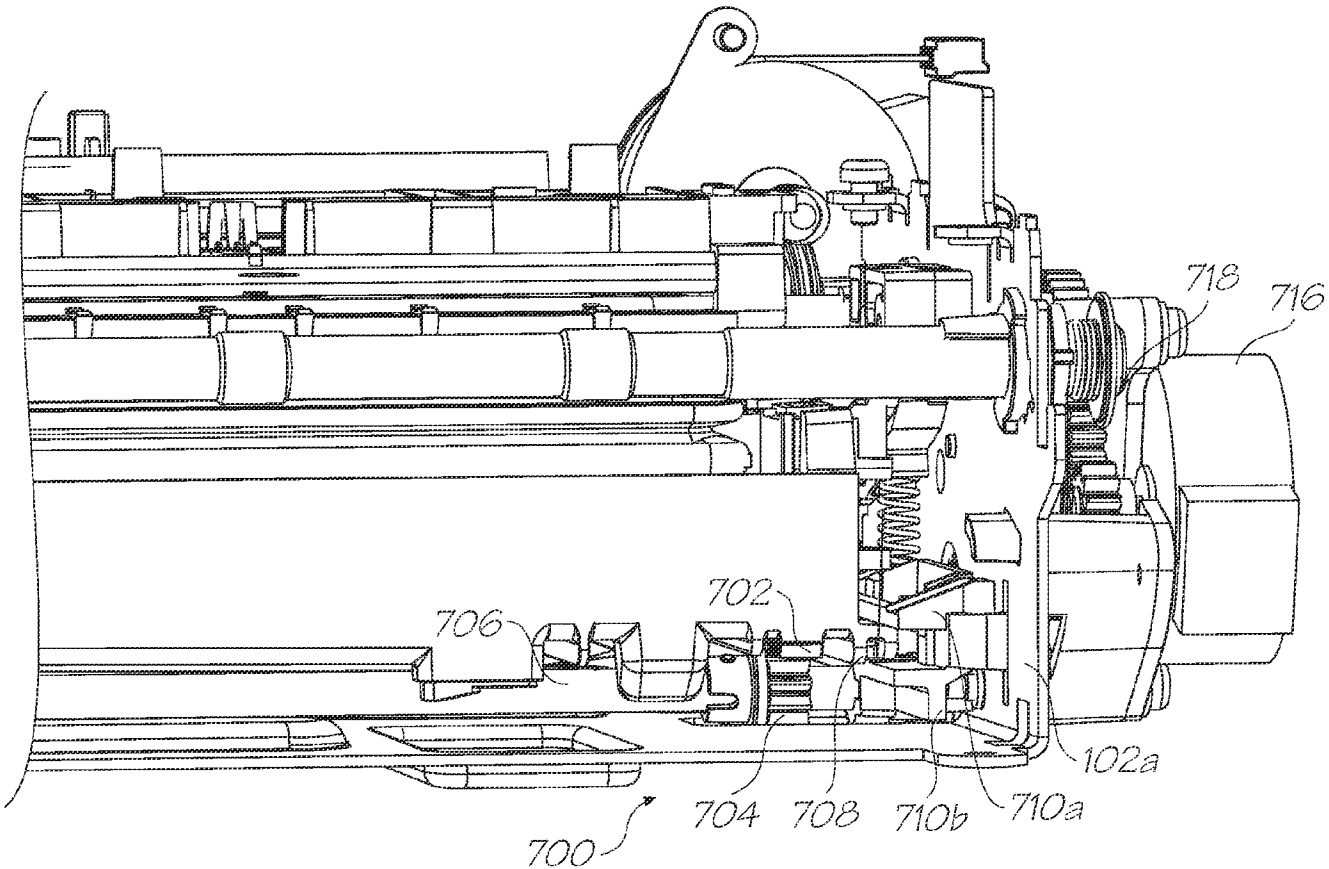
FIG. 39 is a close up view of one section of the displacement mechanism.
Figure 40:
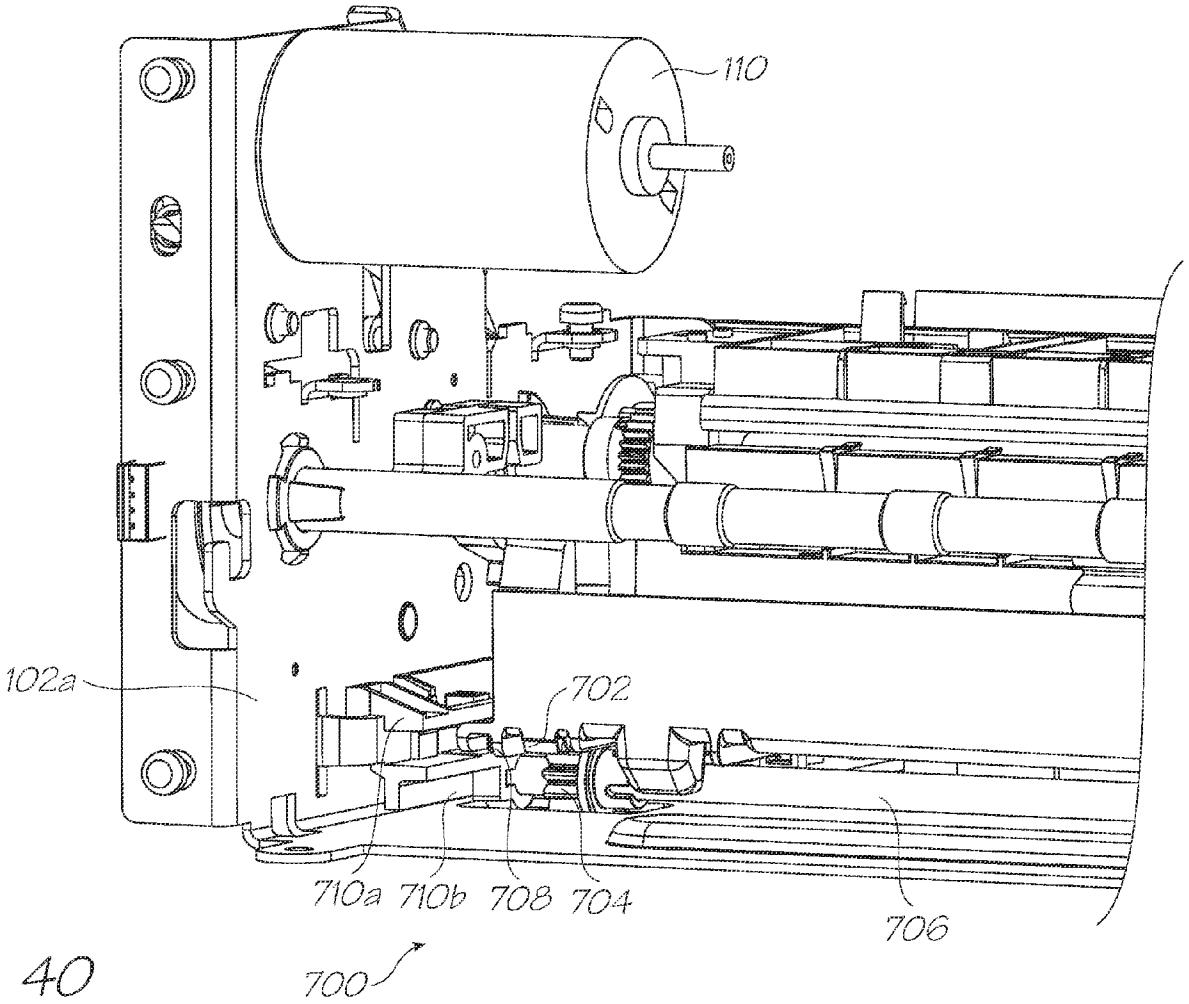
FIG. 40 is a close up view of another section of the displacement mechanism.
Figure 41:
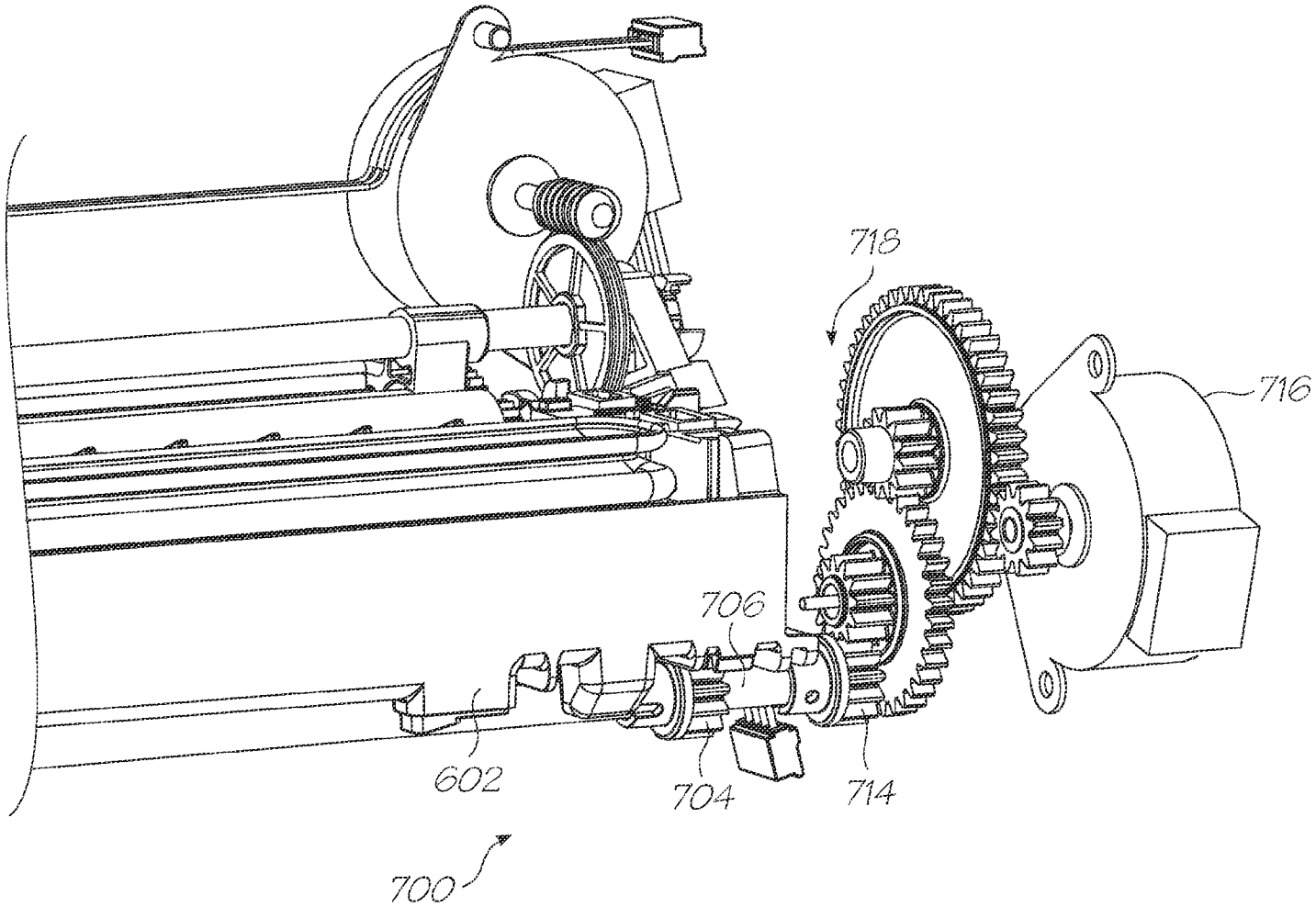
FIG. 41 illustrates a motor arrangement of the displacement mechanism.

In the illustrated embodiment, the displacement mechanism 700 is a dual rack and pinion mechanism, having a rack 702 at either elongate end of the sled 602, which are aligned with the media travel direction when sled 602 is installed in the printer 100, and a pinion gear 704 at either end of a shaft 706, which is aligned with the media width direction. The sled 602 is mounted to the housing 102 of the printer 100 at the racked ends through sliding engagement of rails 708 on the sled 602 with linear bushings 710 mounted on sidewalls 102*a* of the housing 102. In particular, as illustrated in FIGS. 39 and 40, the rails 708 are received between upper and lower sections 710*a* and 710*b*, respectively, of the bushings 710.

The shaft 706 is rotationally mounted to the housing 102 of the printer 100 at either end through apertures 712 in the lower sections 710*b* of the bushings 710. One end of the shaft 706 passes through one of the bushings 710 and has a drive gear 714 on the other side of the housing 102. The drive gear 714 is coupled to a motor 716 via a gear train 718. The motor 716 is controlled by the control electronics 802 to drive rotation of the shaft 706 via the coupled gears thereby sliding the sled 602 along the linear bushings 710. Selective positioning of the sled 602 to align the modules with the printhead is achieved by providing position sensors which communicate with the control electronics. One of ordinary skill in the art understands possible arrangement of such position sensors, so they are not discussed in detail herein.

The use of the dual rack and pinion mechanism for translating the sled relative to the printhead, provides un-skewed and accurate displacement of the sled, which facilitates true alignment of the modules with the printhead. Other arrangements are possible however, so long as this un-skewed and accurate displacement of the sled is provided. For example, a belt drive system could be employed to displace the sled.

Once a selected one of the modules is aligned with the printhead, the aligned module is lifted from the sled into its respective afore-described operational position. Lifting of the modules is performed by a lift mechanism 720, various exemplary aspects of which are illustrated in FIGS. 42A-46.

The lift mechanism 720 has rocker arms 722 pivotally mounted to either sidewall 102*a* of the housing 102 at a pivot point 724. Each rocker arm 722 has an arm portion 726 and a cam follower portion 728 defined on opposite sides of the respective pivot point 724.

The lift mechanism 720 also has a cam shaft 728 which is rotationally mounted between the sidewalls 102*a* to be aligned with the media width direction. The cam shaft 728 has cam wheels 730 and 732 at respective ends thereof. The cam shaft 728 is disposed so that an eccentric cam surface 730*a*, 732*a* of each respective cam wheel 730,732 is in contact with the cam follower portion of a respective one of the rocker arms 722. The eccentric cam surfaces 730*a*,732*a* of the eccentric cams 730,732 are coincident with one another, such that rotation of the cam shaft 728 causes simultaneous and equal pivoting of the rocker arms 722 through rotated contact of the eccentric cam surfaces 730*a*,732*a* against the cam followers 728.

Figure 42A:
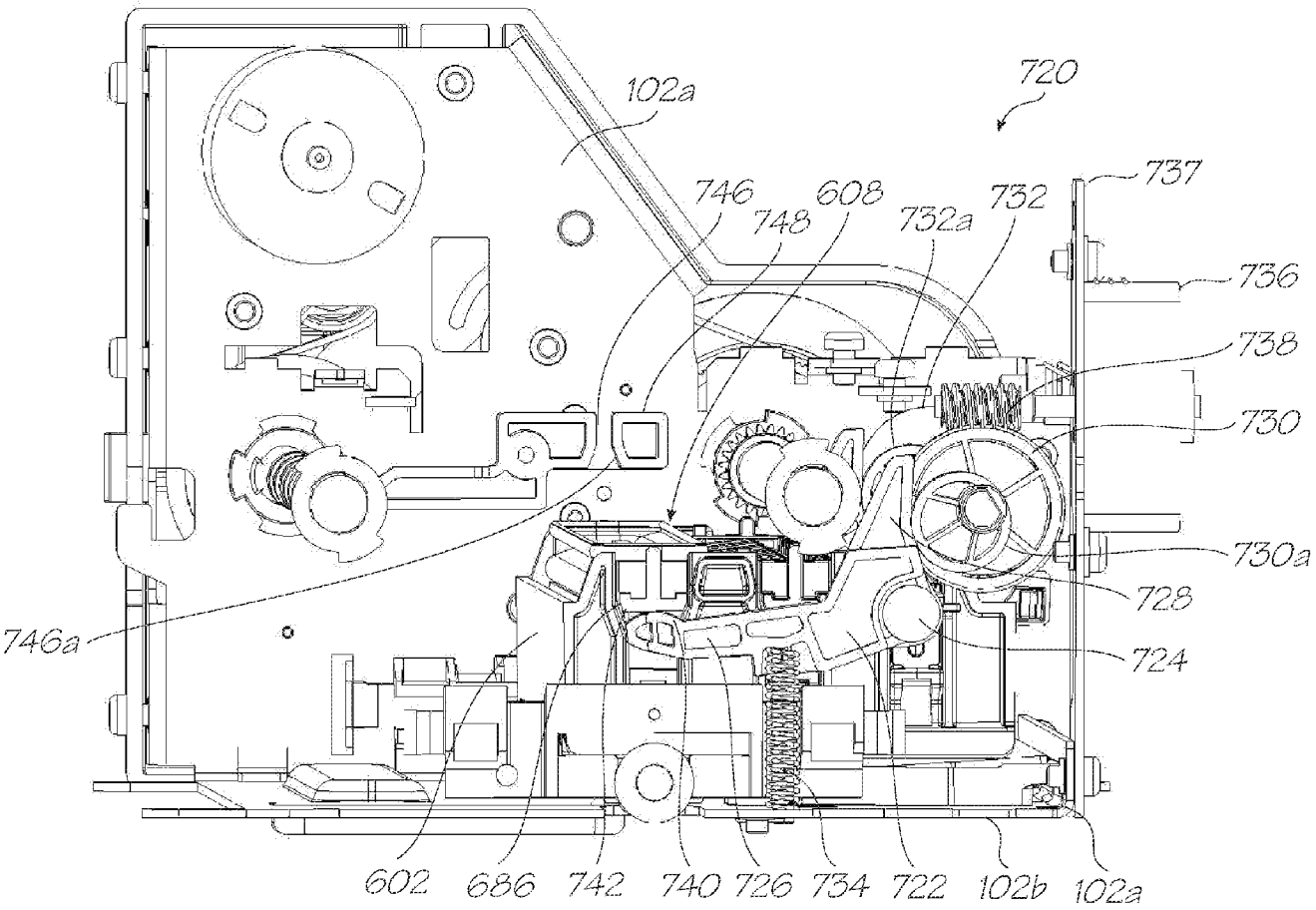
FIG. 42A is a cross-sectional view of the printer with most components omitted and illustrating the capper module engaged with a lift mechanism of the maintenance system in a non-lifted position.
Figure 42B:
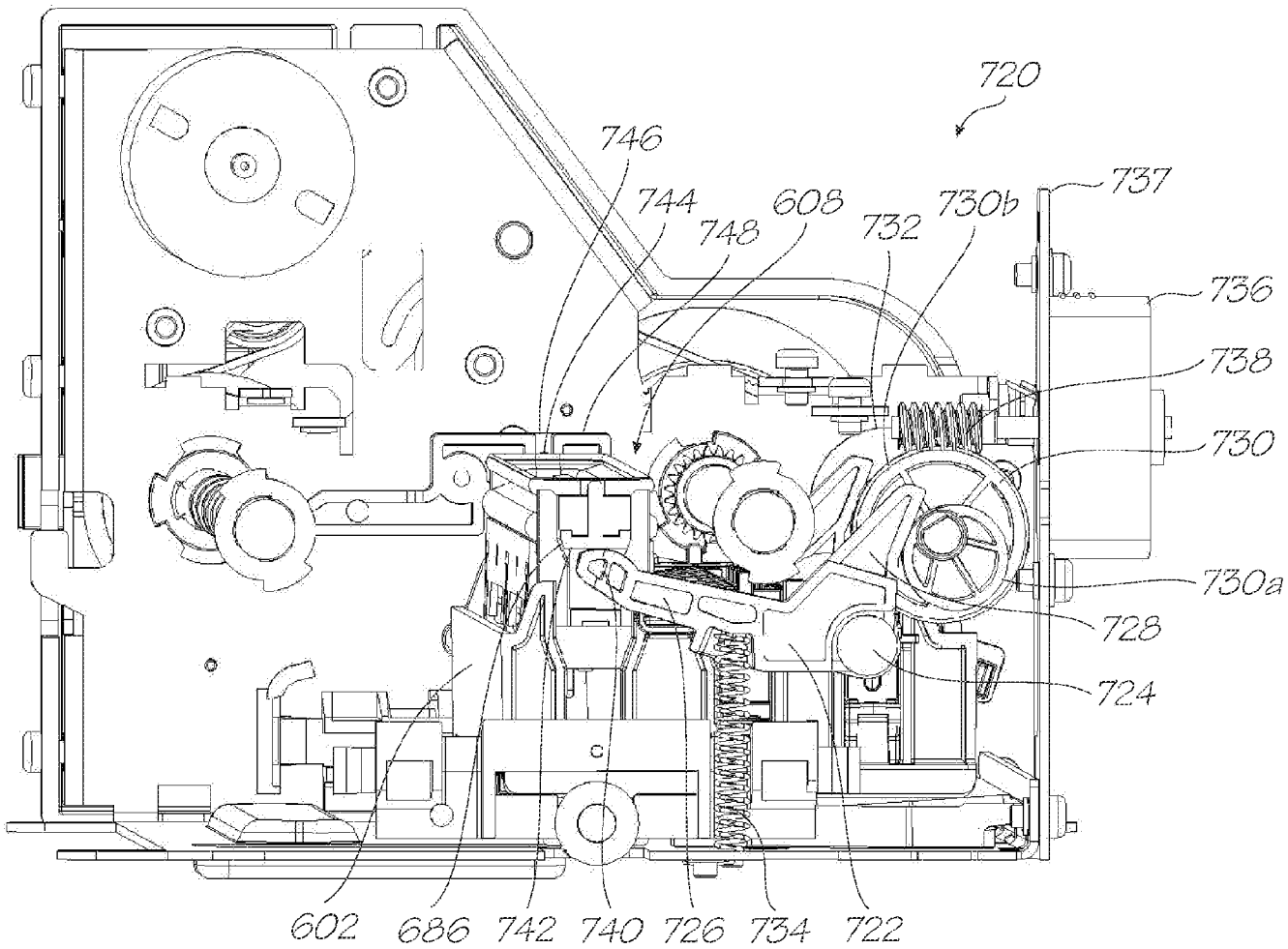
FIG. 42B illustrates the capper module engaged with the lift mechanism in a lifted position.
Figure 42C:
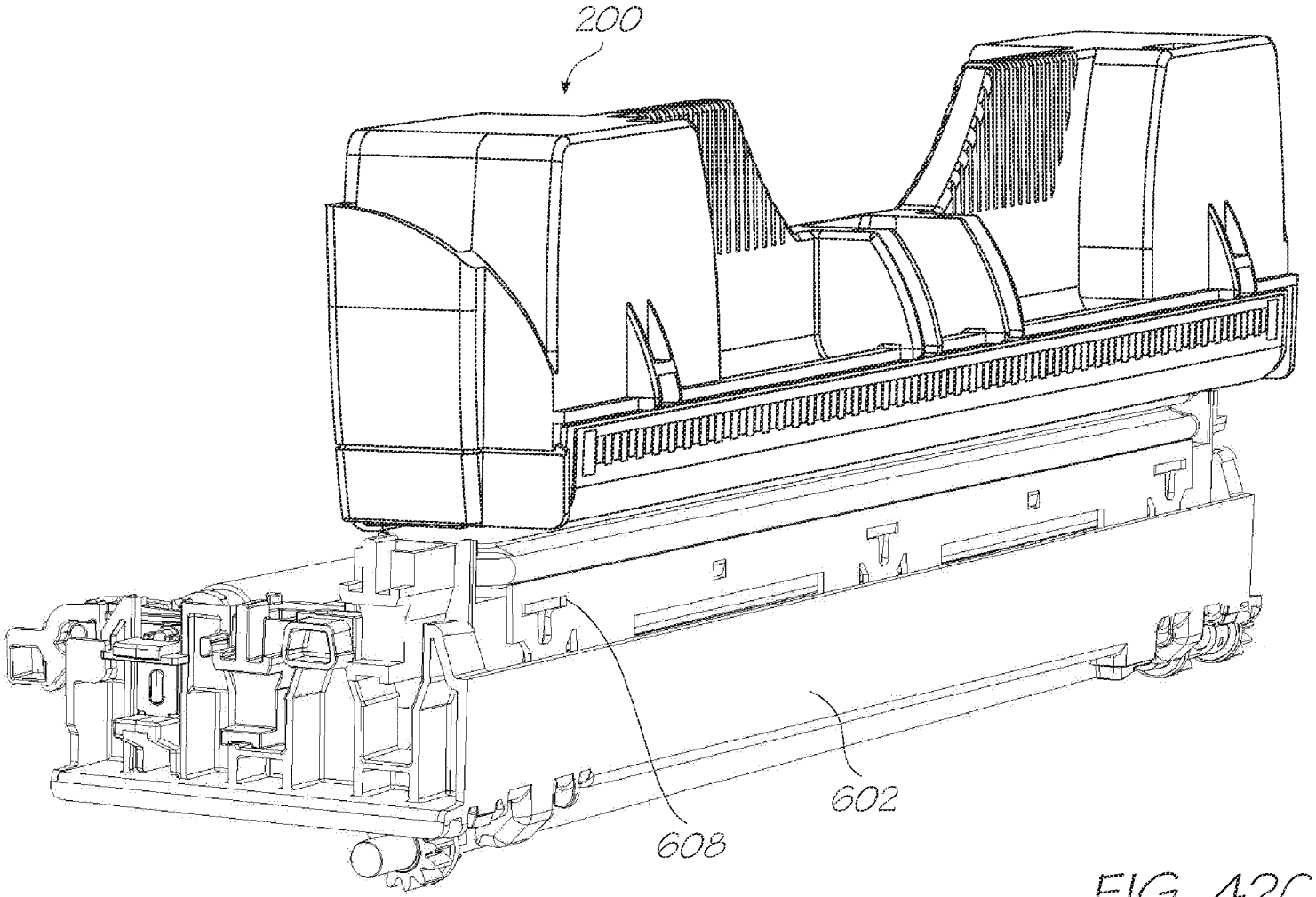
FIG. 42C illustrates the capper module in a capped position on the printhead.
Figure 43A:
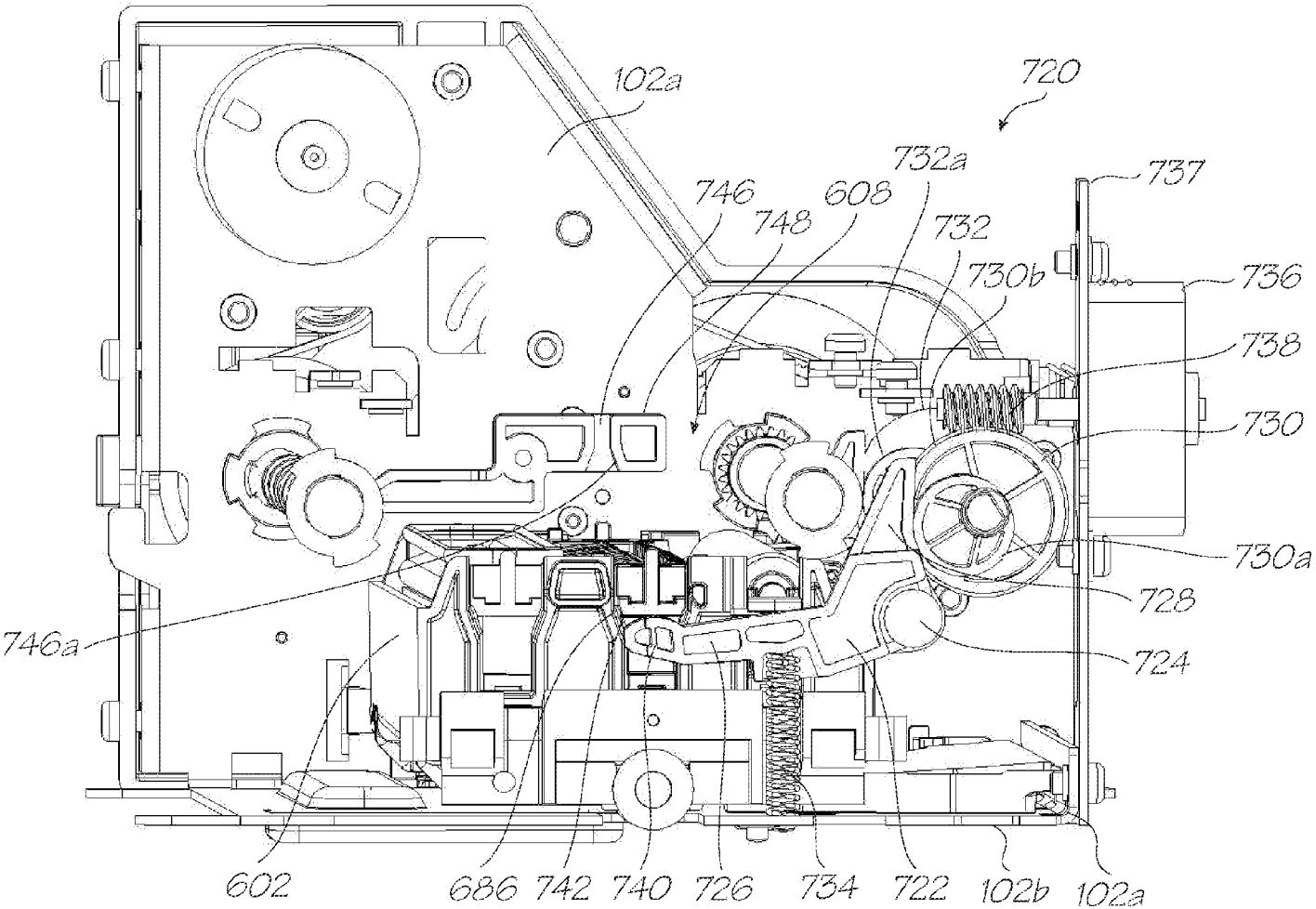
FIG. 43A is a cross-sectional view of the printer with most components omitted and illustrating the platen module engaged with the lift mechanism in a non-lifted position.
Figure 43B:
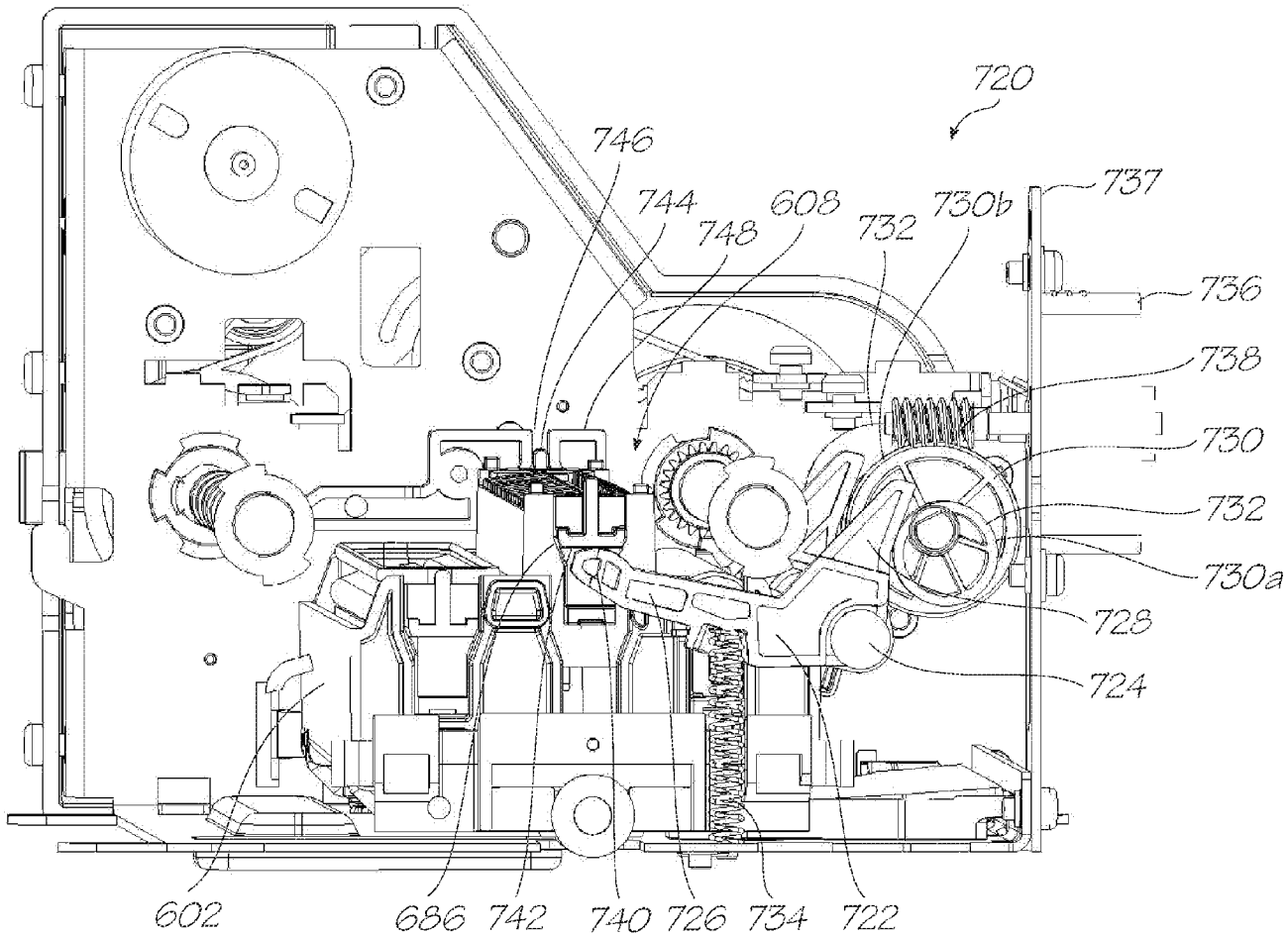
FIG. 43B illustrates the platen module engaged with the lift mechanism in a lifted position.
Figure 43C:
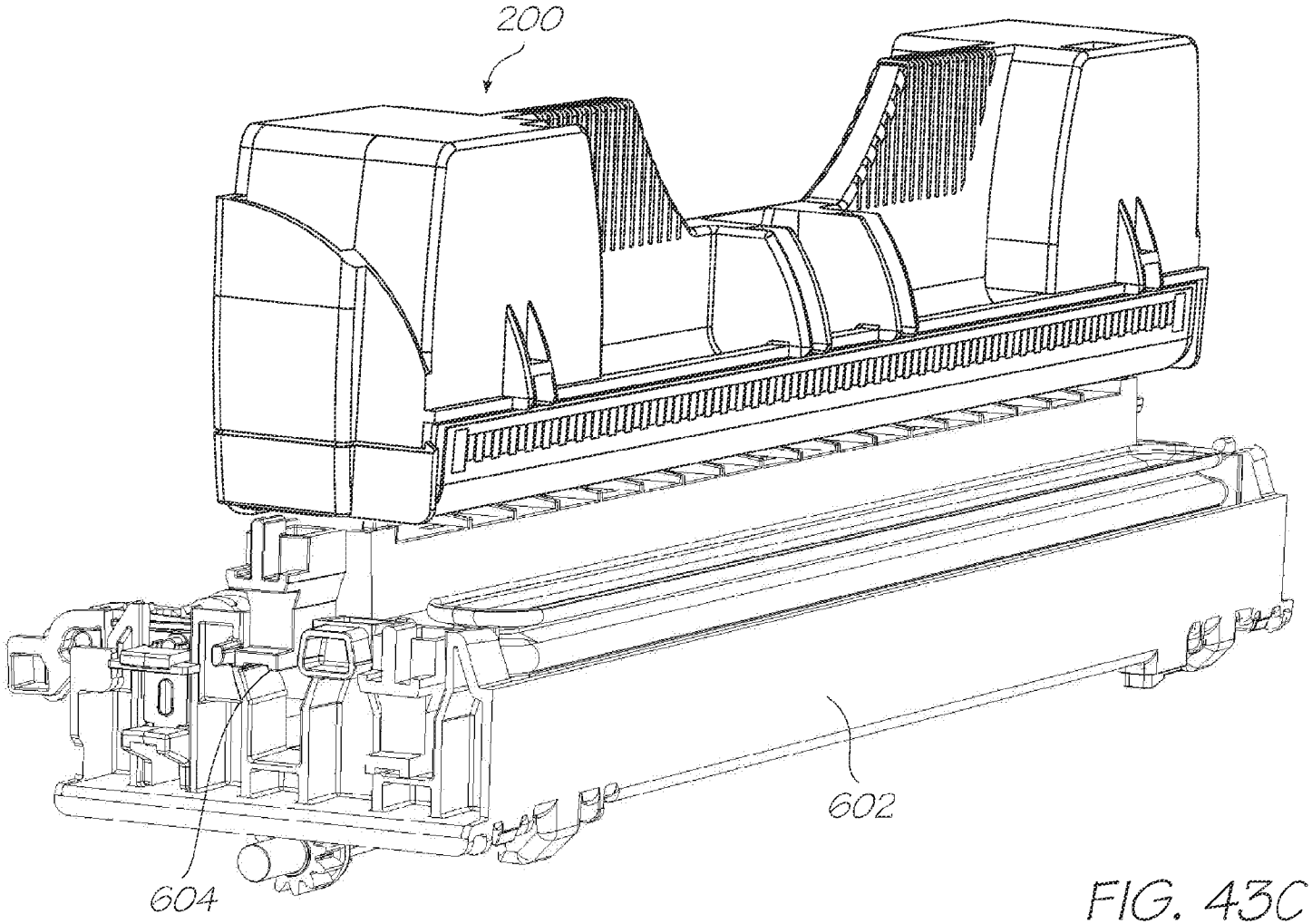
FIG. 43C illustrates the platen module in an operational position relative to the printhead.
Figure 44A:
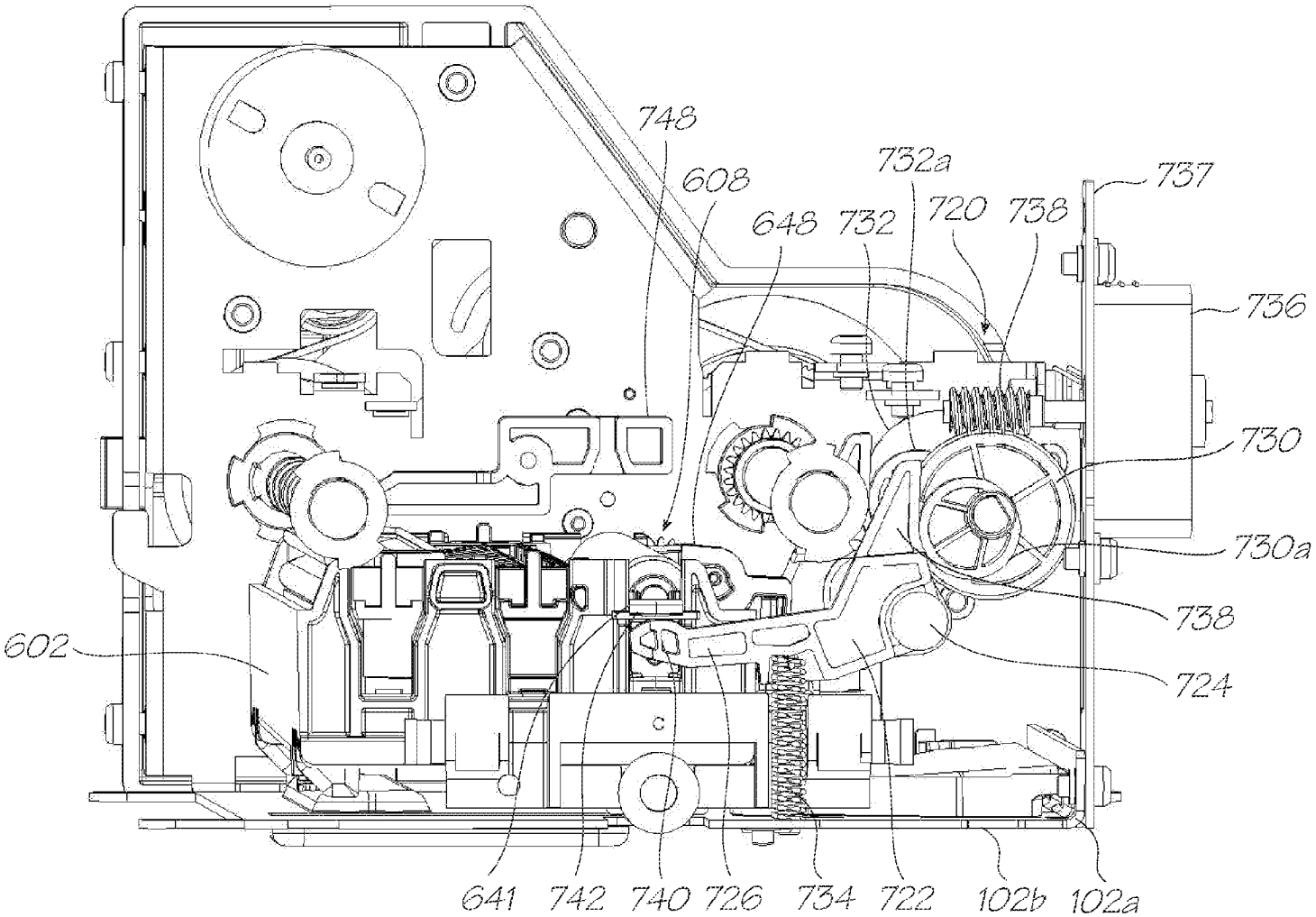
FIG. 44A is a cross-sectional view of the printer with most components omitted and illustrating the wiper module engaged with the lift mechanism in a non-lifted position.
Figure 44B:
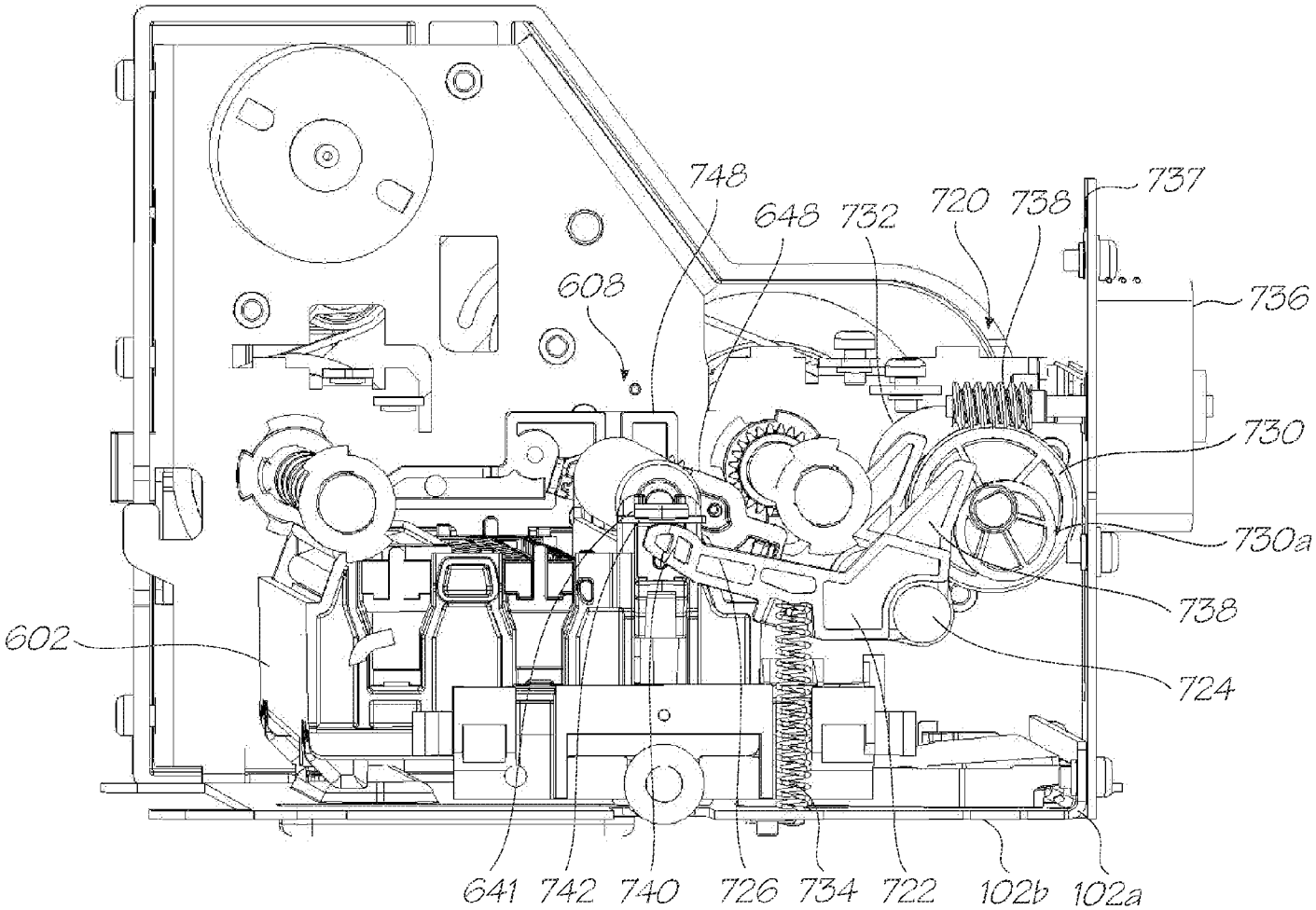
FIG. 44B illustrates the wiper module engaged with the lift mechanism in a lifted position.

This pivoting of the rocker arms 722 is constrained by the profile of the eccentric cam surfaces 730*a*,732*a* and by a spring 734 mounted between each rocker arm 722 and a base 102*b* of the printer housing 102. In the illustrated embodiment, the springs 734 are compression springs, such that when the rocker arms 722 are pivoted to their lowest orientation the springs 734 are compressed, as illustrated in FIGS. 42A, 43A and 44A, and when the rocker arms 722 are pivoted to their highest orientation the springs 734 are at their rest position, as illustrated in FIGS. 42B, 43B and 44B.

Figure 45:
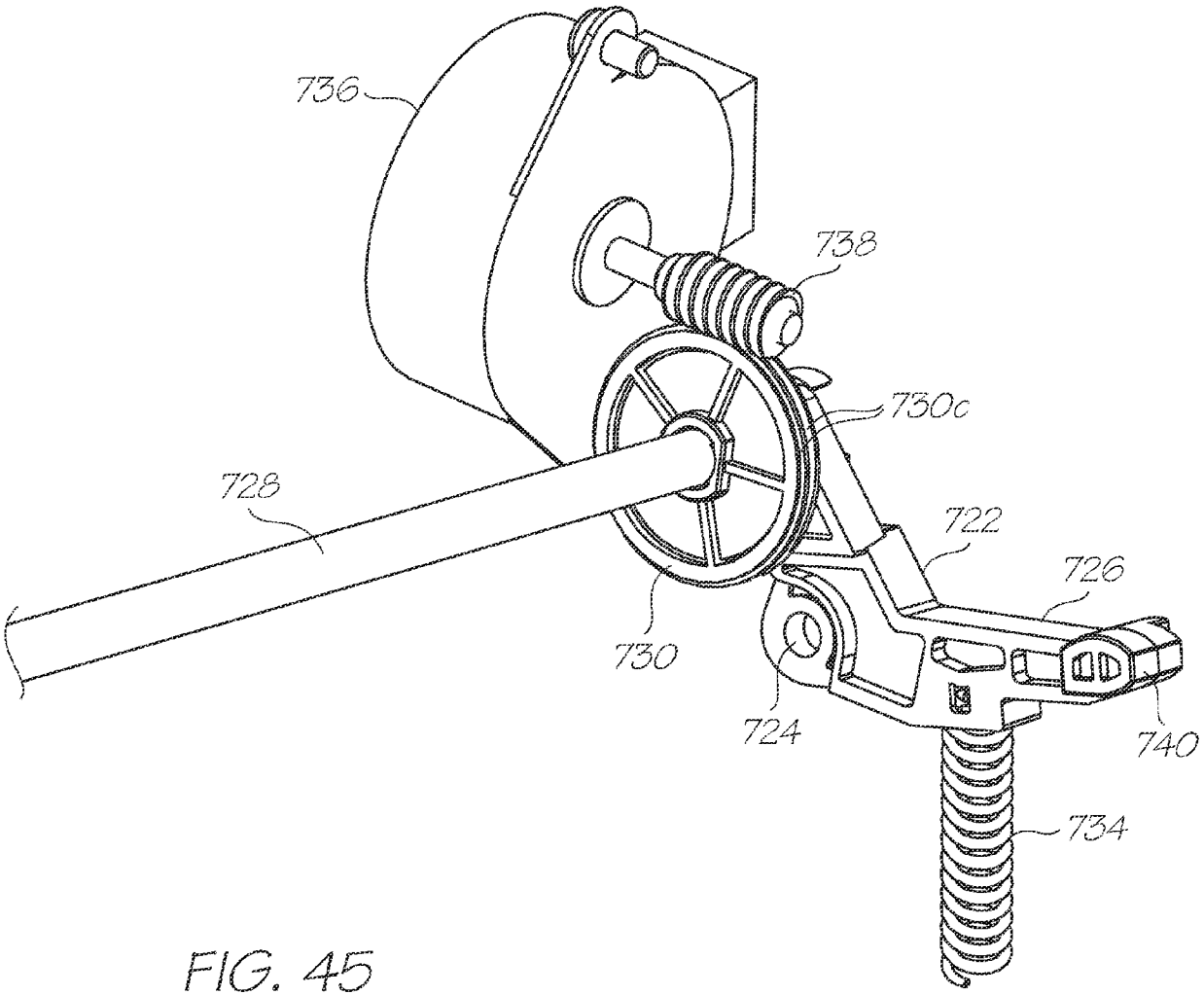
FIG. 45 is a close up view of one section of the lift mechanism.

Rotation of the cam shaft 728 is provided by a motor 736 which is mounted to the housing 102 of the printer 100. In particular, the motor 736 is mounted on a plate 737 which in turn is mounted to the printer housing 102 (or is an integral part thereof) so that a worm screw 738 of the motor 736 is parallel to the sidewalls 102*a* of the printer housing 102. The worm screw 738 contacts an outer circumferential surface 730*b* of the cam wheel 730, which acts as a worm gear, so that the thread of the worm screw 738 meshes with ridges 730*c* along the outer circumferential surface 730*b*, as illustrated in FIG. 45. The threads of the worm screw 738 are helical, preferably right-handed with a 5° orientation and an involute profile. Likewise, the ridges 730*c* are helical, preferably right-handed with a 5° orientation and an involute profile. Accordingly, rotation of the worm screw 738 through operation of the motor 736 under control of the control electronics 802 causes rotation of the cam wheel 730 which rotates the cam shaft 728.

Figure 46:
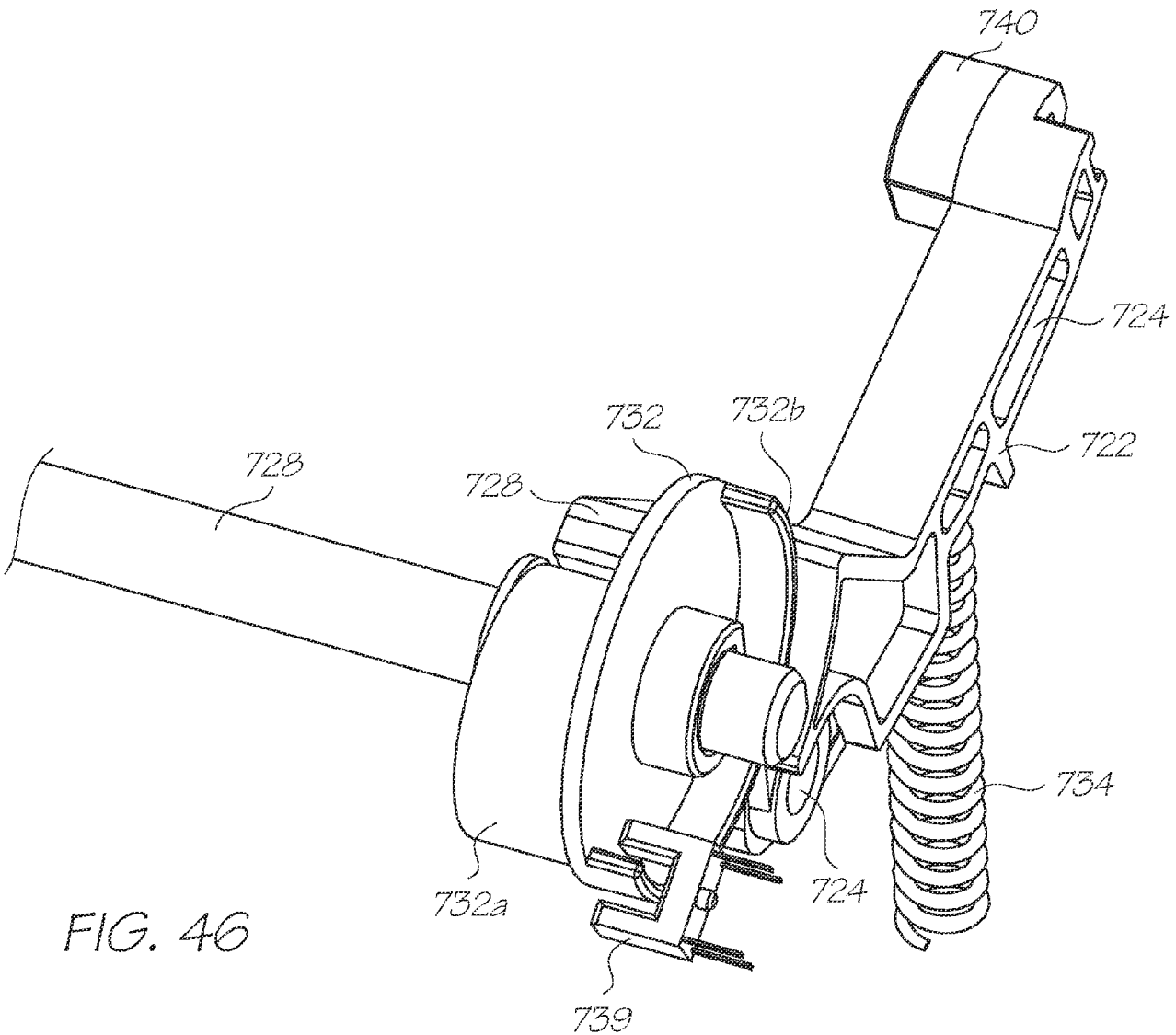
FIG. 46 is a close up view of another section of the lift mechanism.

The rotated position of the eccentric cam surfaces 730*a*, 732*a* is determined by an optical interrupt sensor 739 mounted on the sidewall 102*a* of the printer housing 102 adjacent the other cam wheel 732. The optical interrupt sensor 739 cooperates with a slotted outer circumferential surface 732*b* of the cam wheel 732, as illustrated in FIG. 46, in a manner well understood by one of ordinary skill in the art.

When the sled 602 is being translated by the displacement mechanism 700 to select one of the modules, the cams are controlled so that the rocker arms 722 are at their lowest position. In this lowest position, projections 740 of the arm portions 726 of the rocker arms 722, which project toward the sled 602, are able to pass through recesses in the retainer elements of the modules, such that displacement of the sled 602 is not inhibited. Once the selected module is in position, the cams are controlled so that the rocker arms 722 are moved to their highest position. During this transition of the rocker arms 722 from the lowest to the highest position, the projections 740 engage lift surfaces 742 of the retainer elements 622,639,641,686. This engagement causes the selected module to be lifted with the rocker arms 722. The lift surfaces 742 are parallel to the base 618 of the sled 602 and are substantially flat. That is, in the illustrated embodiment the flat lift surfaces are horizontal.

With respect to the platen and capper modules 604,608, as these modules are lifted higher, tabs 744 of the respective retainer elements 622,686, which project normally (e.g., vertically) from the lift surface 742, enter channels 746 of alignment blocks 748 mounted to the sidewalls 102*a* of the printer housing 102.

As illustrated, the channels 746 are oriented parallel with the tabs 744 and have a funneled open end 746*a*. In the illustrated embodiment, the funneled open end 746*a* is at an angle of about 20° from the rest of the corresponding channel 746. This funneled open end 746*a*, relative mounted positions of the alignment blocks 748 and the printhead 200, and the dimensions of the notches 620*a* in the sidewalls 620 of the sled frame 614, allow correction of misalignment of the lifted modules relative to the printhead by funneling the tabs 744 to the correct alignment. In order to maintain the platen and capper modules at the correct orientation (i.e., parallel to the printing face of the printhead) during this alignment correction, the projections 740 of the rocker arms 722 have a curved profile in contact with the substantially flat lift surfaces 742 of the retainer elements which allows smooth shifting of the modules relative to the rocker arms 722.

With respect to the wiper module 606, the retainer elements 639,641 are not provided with tabs since relative alignment of the wiper roller 640 and the printhead 200 is less important, for reasons discussed later. The retainer elements 639,641 do however have stiffening elements 749 at which the projections 740 of the rocker arms 722 contact the lift surfaces 742. The stiffening elements 749 provide increased rigidity to the retainer elements, and in particular the retainer element 639, which ensures effective swinging of the swing arm 648 throughout lifting and lowering of the wiper module 608.

At the highest position of the rocker arms 722, the springs 734 are configured to be fully expanded. At this full expansion of the springs 722 the cam followers 728 leave contact with the eccentric cam surfaces 730*a*,732*a*. That is, the rocker arms are biased to the lifted position and the cams are rotated to obstruct this bias to lower the rocker arms and to unobstruct this bias to allow the rocker arms to lift. In this way, the contact force applied by the modules to the printhead 200 is only dependent on the configuration of the springs 734. In the illustrated embodiment, the springs are configured to provide a contact force of about 20 Newtons, which facilitates the respective functions of the modules.

With respect to the platen module 604, at the highest position of the rocker arms 722, datums 750 on either longitudinal end of the body 610 of the platen module 604 are located so as to contact the printing face of the printhead 200 beyond the media width of the printing face, so that the media 104 is able to pass between the engaged printhead 200 and platen module 604. The dimensions of the datums 750 set the afore-described distance between the reference surface 624*b* of the ribs 626,628 and the printhead ICs 204. Accordingly, the media spacing between the platen and printhead is set by "datuming" the platen off the printhead.

With respect to the wiper module 606, at the highest position of the rocker arms 722, the wiper roller 640 is compressed against the printing face. With respect to the capper module 608, at the highest position of the rocker arms 722, the capper element 682 hermetically seals over the surface topography of the printing face whilst setting the afore-described distance between the wick element 684 and the printhead ICs 204.

In the illustrated exemplary embodiment, the springs 734 are compression springs mounted between the rocker arms and the base of the printer housing so that the rocker arms are biased to the lifted position. However, other arrangements are possible, such as mounting compression springs between the rocker arms and the sidewalls of the printer housing to provide similar bias, or using leaf or expansion springs to provide similar or different bias, so long as the amount of applied force on the printhead by the modules is within a tolerable range.

As mentioned earlier, accurate alignment of the wiper module with the printhead is not provided. This is because, displacement of the wiper module relative to the printhead during wiping is desired so as to maximize the amount of fluid and debris that can be wiped from the printhead. That is, a greater surface area of the printing face can be wiped by moving the wiper module and wiping in difficult areas to wipe due to the different topographical levels on the printing face provided by the different components can be achieved.

Figure 44C:
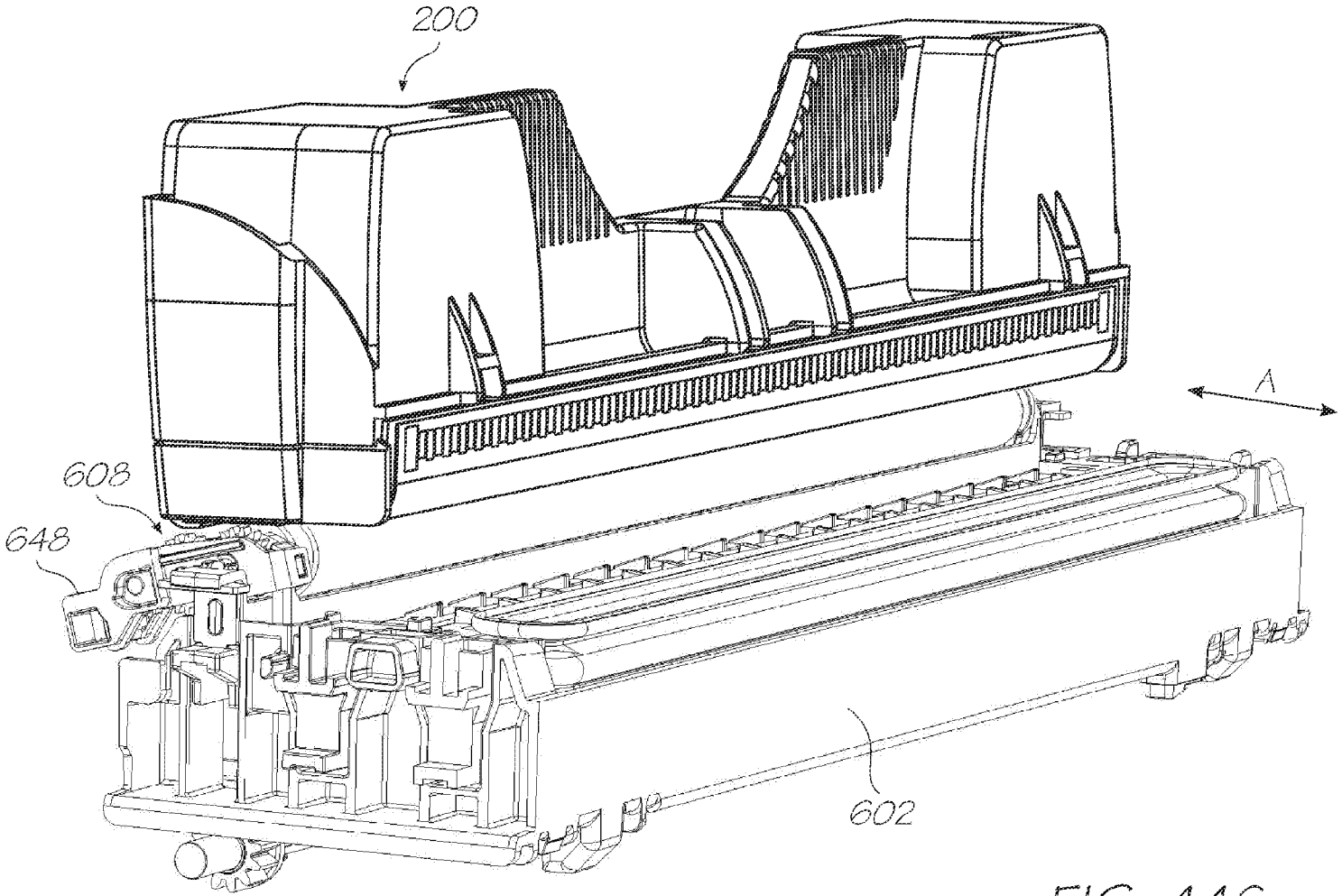
FIG. 44C illustrates the wiper module in an operational position relative to the printhead.

This translational wiping operation is achieved by operating the displacement mechanism 700 to displace the sled 602 whilst the wiper module 608 is in its wiping position with the wiper roller 640 contacting the printhead 200 and rotating under drive of the drive mechanism 644, as illustrated by the double-headed arrow A in FIG. 44C. As is illustrated in FIG. 44B, the notches 620*a* in the sidewalls 620 of the sled frame 614 are dimensioned so that, in the wiping position, the retainer elements 639 and 641 of the wiper module 606 do not leave the constraint of the notches 620*a*. Accordingly, as the sled 602 is displaced the wiper module is also displaced in the same manner.

The amount of displacement possible for translational wiping is dependent on the length and size of the gear train 646 of the swing arm 648, as contact with the gear 106*a* on the driven roller 106*b* must be maintained for wiping rotation. That is, as the wiper module 606 is moved in the media travel direction relative to the printhead 200, the swing arm 648 swings towards its horizontal orientation due to the bias of the spring 668. During this swinging, engagement of the driven end gear of the gear train 646, e.g., the second gear 656, with the gear 106*a* on the driven roller 106*b* is maintained, and therefore rotational wiping occurs, until the wiper module 606 is moved too far from the driven roller 106*b*. Therefore, the translational wiping is monitored, by suitable sensors as understood by one of ordinary skill in the art, under control of the control electronics 802 so that rotational wiping is never ceased during displacement of the wiper module 606 across the printhead 200.

Upon completion of a wiping procedure, the wiper module 606 is lowered from the printhead 200 and rotation of the wiper roller 640 is ceased before the wiper module 606 is brought to its non-wiping or home position in the sled 602 due to the de-coupling of the drive mechanism 644 from the input rollers 106 and the friction provided by the pressing contact of the scraper 676 and the wiper roller 640.

As discussed above, the fluid captured by the platen, wiper and capper modules drains into the sled. As illustrated in FIG. 47 the sled 602 has the drainage areas 632, 679 and 696 in the base 618. The drainage areas are defined in the base 618, such as by molding, to provide discrete paths to holes 752 and 754 in the base 618, from which the fluid in the drainage areas is able to leave the sled 602. For example, the sled 602 may be molded from a plastics material, such as a 10% glass fibre reinforced combination of polycarbonate and acrylonitrile butadiene styrene (PC/ABS). The discrete paths are defined by walls 618*a* which act as drainage ribs which constrain the fluid in the sled 602 from free movement during displacement of the sled 602. In the is way, the captured fluid is able to drain from the sled without being 'sloshed' around the sled which could cause the fluid to be 'splashed' onto the printhead.

The drainage area 632 receives fluid drained from the wick element 612 of the platen module 604, as illustrated in FIGS. 48A and 48B, and is configured such that its discrete path routes the received fluid to the hole 752 in the base 618. Similarly, the drainage area 696 receives fluid drained from the capper module 608 through the above-described engagement of the valve 698 and the projection 699, as illustrated in FIGS. 47 and 49, and is configured such that its discrete path routes the received fluid to the hole 752 in the base 618.

The drainage area 679 receives fluid drained from the wiper module 606, as illustrated in FIGS. 50A and 50B, and is configured such that its discrete path routes the received fluid to the hole 754 in the base 618. In order to assist drainage of the fluid absorbed by the wiper roller 640 of the wiper module 606, the drainage area 679 has a wick element 756 formed of a hydrophilic porous material which can be molded and has a porosity with a bead and void size which permits absorption of ink. For example, hydrophilic polyethylene is preferred, which can be used to make the wick element 756 by a process akin to sintering, being molded together into its final shape.

The wick element 756 has a number of towers or bars 758 projecting from a pad 760. The pad 760 is held in a channel 762 defined along the elongate length of the base 618 of the sled 602 coincident with the home position of the wiper module 606. The pad 760 has a wick 764 which projects from the pad 760 within a channel 766 in the base 618. The channel 766 is defined in the base 618 to be normal to the channel 762 across the width of the base 618 and to lead to the hole 754. The wick 764 has a bent end portion 764*a* which projects from the hole 754.

As illustrated most clearly in the cut-away partial detailed view of FIG. 50B, the towers 758 are arranged to project through windows 765 provided uniformly along the elongate length of the wiper module body 634 (see also FIGS. 23 and 24) when the wiper module 606 is at its home position in the sled 602. The towers 758 have sufficient height and rigidity to contact and compress the wiper roller 640 so that fluid held by the absorbent material 640*b* of the wiper roller 640 is wicked to the porous towers 758 into the porous pad 760 and then drained from the hole 754 of the sled 602 via the wick 764.

The amount of contact pressure provided by the towers on the wiper roller, the number of towers provided (for example, five towers are provided in the illustrated embodiment, however more or less towers can be provided depending on the media width and the capacity of the wiper roller), and porosity of the material of the sled wick element and the outer layers of the wiper roller are selected so that once three milliliters of fluid has been absorbed by the wiper roller (which occurs after about 20 wiping operations as discussed earlier) the fluid is able to wick to the sled wick element. This results in the wiper roller being kept from saturation at four to five milliliters (discussed earlier) which results in consistent and reliable wiping of the printhead.

Figure 51:
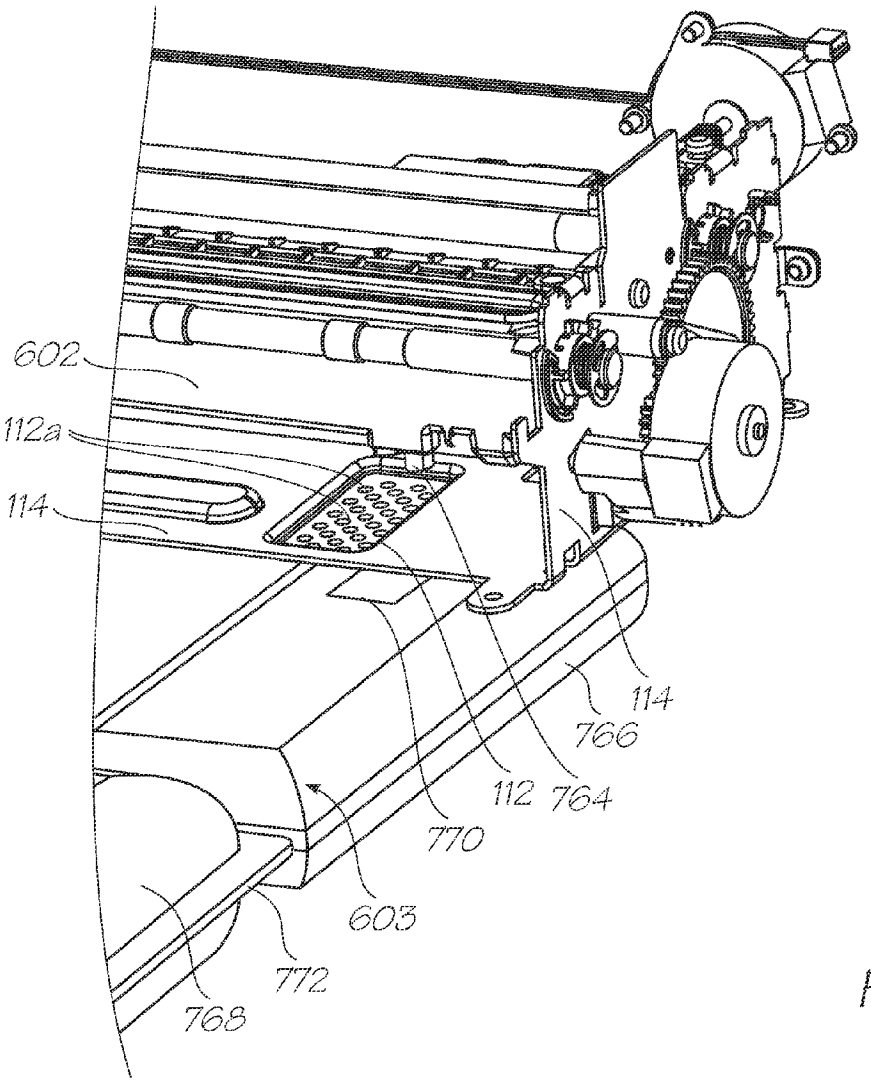
FIG. 51 illustrates alignment of drainage holes in the sled with a vent in a housing of the printer.
Figure 52:
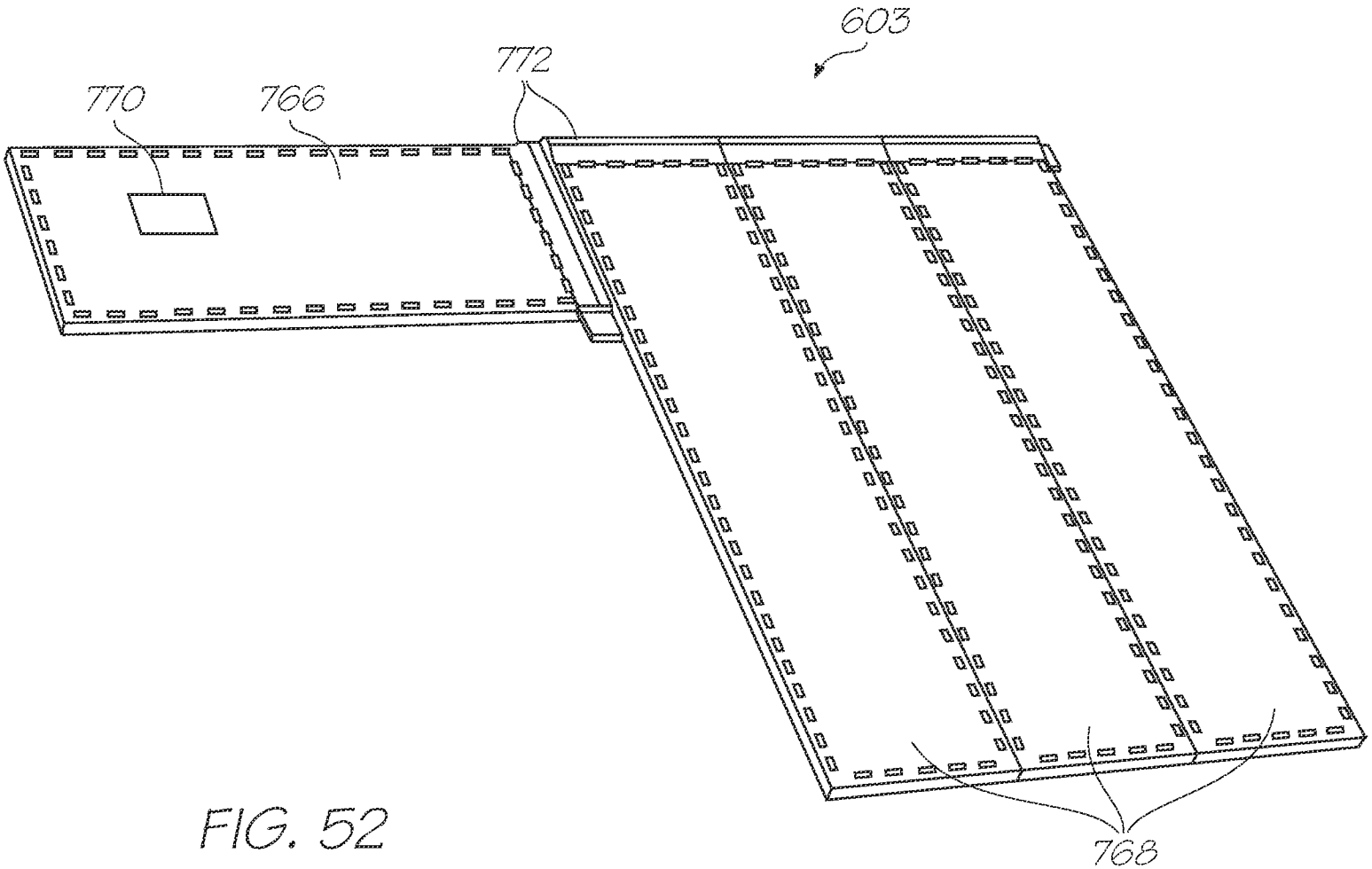
FIG. 52 illustrates a fluid collector of the maintenance system in isolation with fluid storage modules in a collapsed state.
Figure 53:
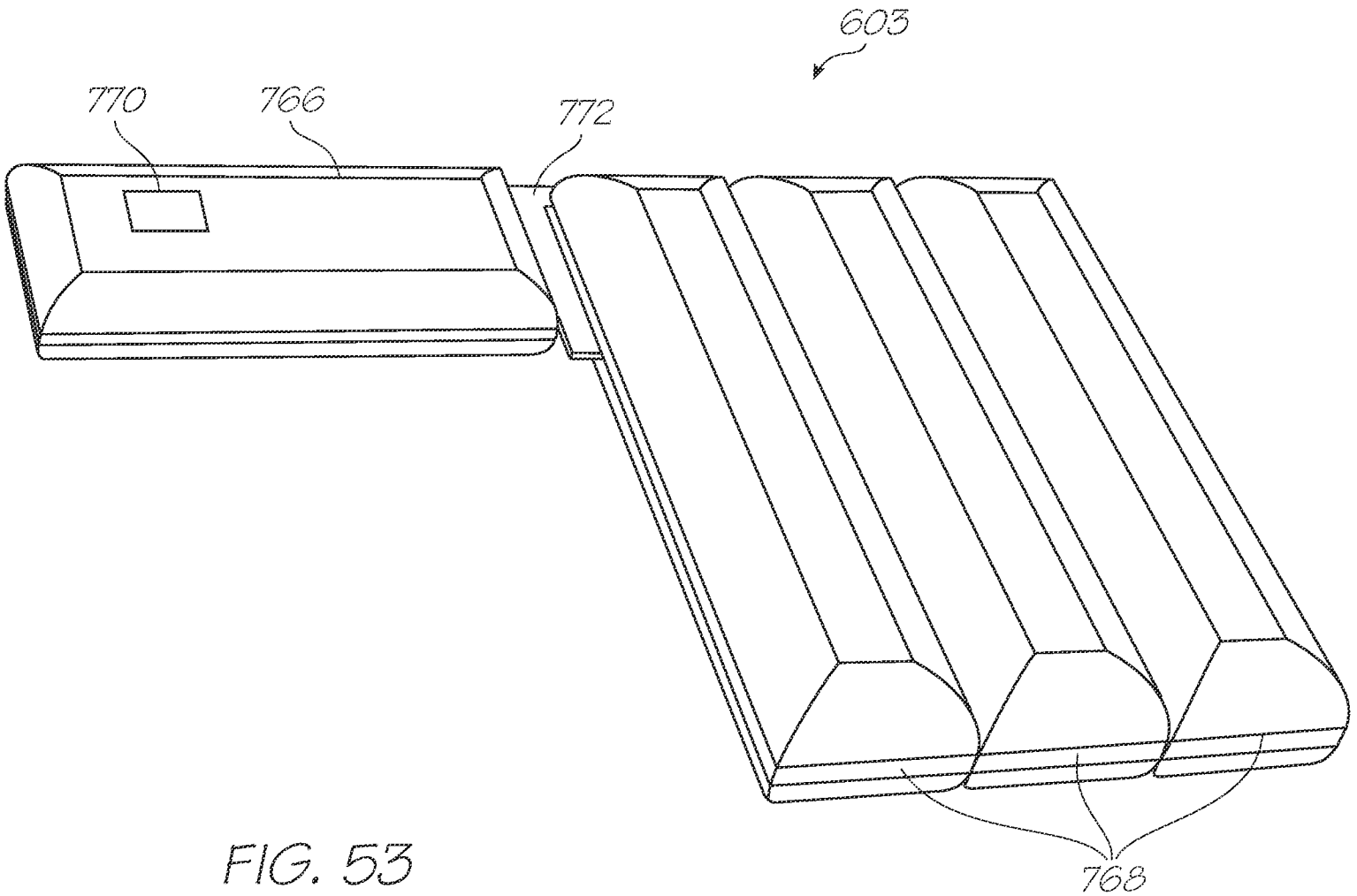
FIG. 53 illustrates the fluid collector with the fluid storage modules in an expanded state.

The holes 752 and 754 in the base 618 of the sled 602 are arranged to align with a vent 112 in the housing 102 of the printer 100, as illustrated in FIG. 51, at all translated positions of the sled 602 relative to the housing 102. The vent 112 is defined as a recess dimensioned to capture all fluid drained from the modules of the sled and has a plurality of vent holes 112*a* from which the captured fluid is able drain.

As illustrated in FIGS. 6, 7, 52 and 53, the fluid collector 603 of the maintenance system 600 is located relative to the vent 112 so as to collect the drained fluid for storage. In the illustrated embodiment, the fluid collector 603 is a modular assembly of fluid storage modules 766 and 768, and is removably positioned within a body 114 of the printer 100 between a media input area 116 and a printed media output area 118, however other arrangements are possible so long as the fluid from the sled is able to drain to the fluid collector and be stored for later removal.

In the exemplary embodiment, the storage modules 766, 768 are formed of flexible, collapsible material so as to define expandable bags which are substantially flat when empty of fluid and are expanded otherwise. The storage modules 766, 768 are filled with an absorbent material which absorbs fluid causing expansion of the material. For example, the absorbent material may be a polymer which is a powder when dry and a stiff gel when wet, such as superabsorbent polymer.

The storage module 766 has a port 770 located in registration with the vent 112 of the printer 100 into which the fluid from the vent 112 is able to drain. As the fluid enters the port 770 it contacts the internal absorbent material causing the absorbent material to wet and expand. The storage module 766 is linked to the other storage modules 768 by an internal wick element 772 which provides capillary wicking paths between the storage modules. As such, when the absorbent material in the storage module 766 is saturated with fluid, further fluid drained from the modular sled 602 wicks to the other storage modules 768 via the wick element 772 so as to be absorbed and stored by the absorbent material in the storage modules 768.

In the illustrated embodiment, the four storage modules 766,768 provide a storage capacity of about one liter of ink, etc, however more or less storage capacity provided by more or less modules is possible. Suitable sensing arrangements may be used to sense when the storage modules 766,768 have expanded to their full levels, or if rigid storage modules are alternatively used direct sensing of the fluid level within the storage modules may be provided. The sensing result is provided to the control electronics 802 which may provide an indication of the full state to a user of the printer 100 so that the storage modules 766,768 can be replaced or emptied. Alternatively, the modularity of the fluid collector 603 allows individual ones of the storage modules to be removed and replaced periodically prior to saturation of all of the storage modules. However, other arrangements are possible in which the fluid collector 603 has a single storage element.

The afore-described components of the maintenance system 600 provide a means of maintaining the printhead 200 and fluid distribution system 300 in operational condition by maintaining the printing environment about the printhead 200 free from unwanted wet and dried ink and debris. In particular, the linear translating sled with selectable maintenance modules provides a simple and compact manner of maintaining the stationary, full media width printhead. Providing the capper module with a fluid absorbing spittoon allows 'wet' capping of the printhead which prevents drying of the fragile ejection nozzles. Providing the platen module with a fluid absorbing spittoon also allows the printhead to remain 'wet' during printing and free from ink which is misdirected or misted in the vicinity of the printhead especially in borderless printing applications. Employing the drive motor of the printer to drive at least the wiper roller of the wiper module provides further compactness and simplicity. However, other wiper module arrangements are possible, such as that described in U.S. Provisional Patent Application No. 61/345,572.

Figure 54:
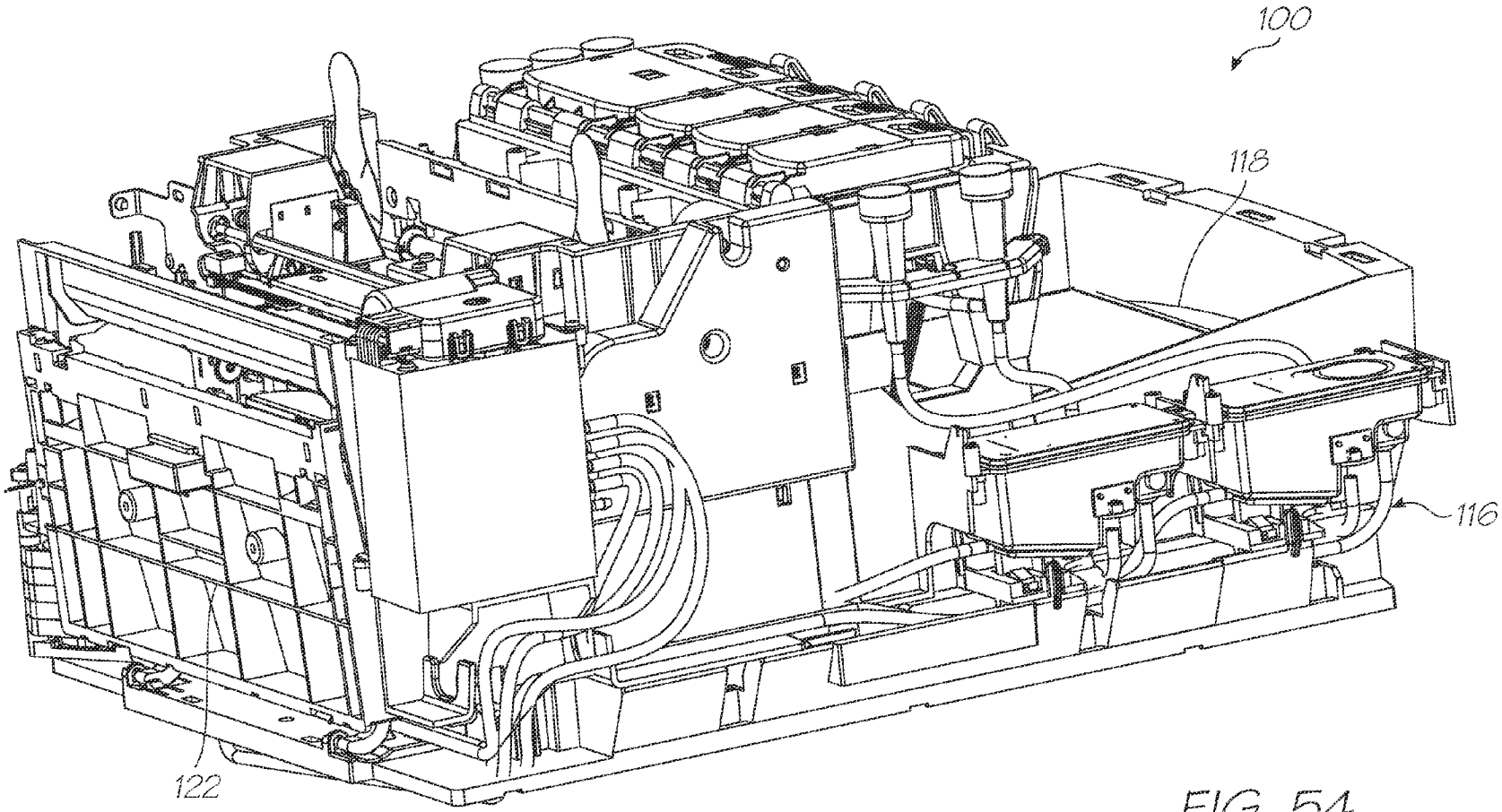
FIG. 54 is a perspective view of the printer with a casing of the printer removed to illustrate a media jam removal door.

Another aspect of the maintenance system 600 is maintenance of a path along which the media 104 is transported to the printhead 200 for printing, which is now discussed with respect to FIGS. 54-60B. Two media paths are provided in the exemplary embodiment. One of the media paths is from the media input area 116 to the printhead 200 and is defined by a curved media path 774, as illustrated in FIG. 54. Details of a suitable form of this curved path are described in U.S. patent application Ser. No. 12/397,274, the contents of which are hereby incorporated by reference. The other media path is from a manual feed media input area 120 to the printhead 200 and is defined as a substantially straight media path 776. The media paths 774,776 are separated by an elongate media diverter 778 which extends across the media width.

During printing, media jams may occur along the media paths, particularly the curved media path 774. In order to clear such jams, the body 114 of the printer 100 has a hinged door 122 which can be opened to expose the entire media width of the media path 774.

Figure 56:
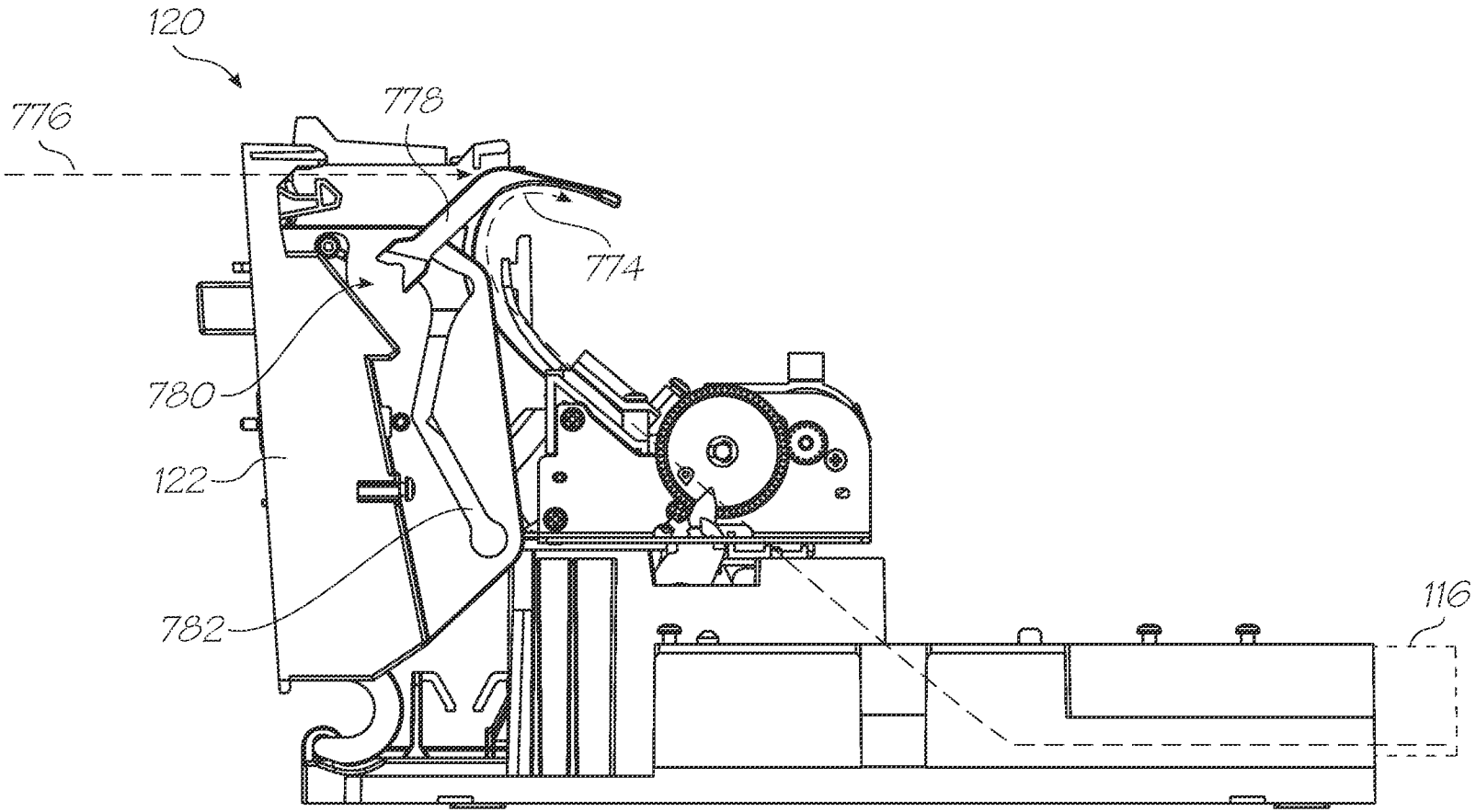
FIG. 56 illustrates a fully closed state of the media jam removal door.

The media diverter 778 is mounted to the door 122 such that when the door 122 is in its closed position the door 122 and the diverter 778 define guiding portions of both the media paths 774,776 (see FIG. 56). The diverter 778 is pivotally mounted to the door 122 so that the diverter 778 may pivot out of the way upon opening of the door 122 so that the diverter 778 does not hinder clearance of media jams. Whilst it is advantageous to have the diverter pivot automatically with the movement of the door, which omits the need for a user to manually move the diverter, the Applicant has found that upon re-closure of the door after jam clearance the diverter is likely to flip about its pivot thereby not allowing automatic repositioning of the diverter, which results in user intervention being need after all.

Figure 55:
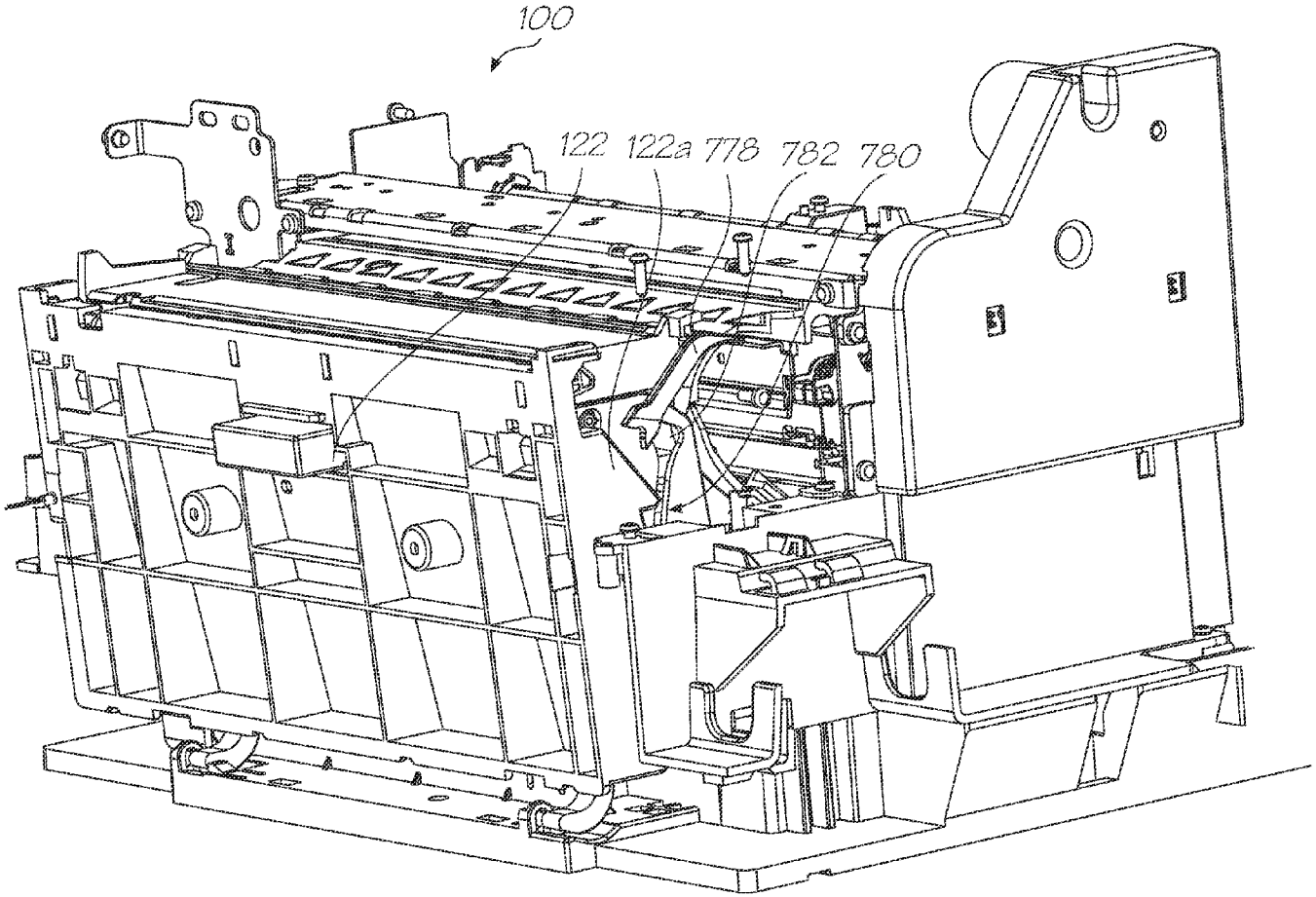
FIG. 55 illustrates the view of FIG. 54 with a portion of a body of the printer removed.

In order to prevent the occurrence of such flipping of the diverter, the maintenance system 600 provides a displacement mechanism 780 for the diverter 778 as illustrated in FIG. 55, which not only automatically retracts the diverter with the opening movement of the door 122 but also automatically repositions the diverter for media guiding with the closing movement of the door 122 without user intervention.

Figure 57B:
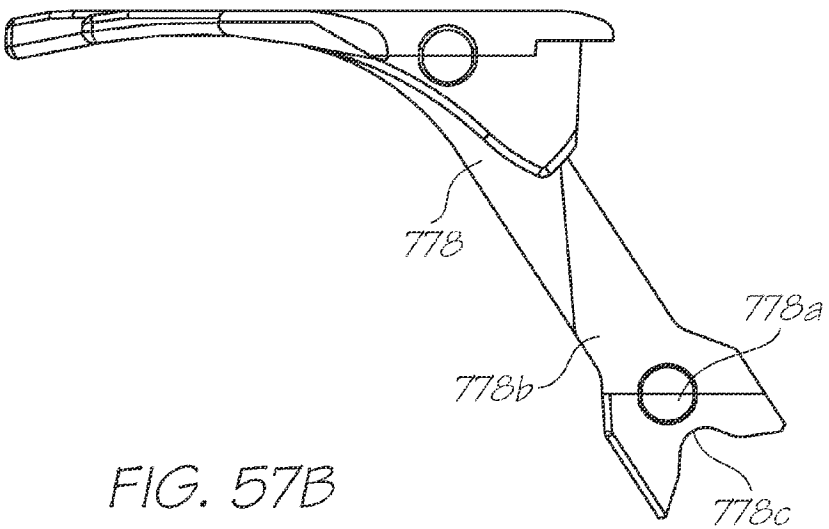
FIGS. 57A and 57B illustrate opposite views of a media diverter of the media jam removal door.
Figure 57A:
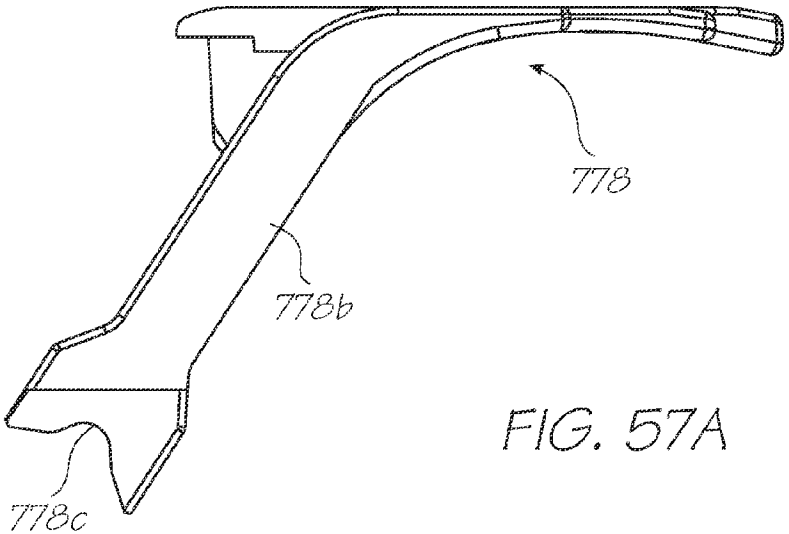

The diverter displacement mechanism 780 has slots 782 within the sidewalls 122*a* at either end of the door 122 and tracking pins 778*a* on arms 778*b* at either end of the diverter 778, as illustrated in FIGS. 57A and 57B. The slots 782 are of a serpentine form having two inflection points 782*a* and 782*b*, with the inflection point 782*a* which is directed towards the media path 774 being upstream of the inflection point 782*b* which is directed away from the media path 774 with respect to the media travel direction along the media path 774. In the illustrated embodiment, the serpentine form is a zigzag, however a curved form is possible.

The tracking pins 778*a* engage with the respective slots 782 which connects the diverter 778 to the door 122. The tracking pins 778*a* slide within the slots 782 and track along the serpentine form of the slots 782 as the door 122 is moved. This tracking allows the diverter 778 to pivot relative to the door 122. Pivot pins 784 project from each of the sidewalls 122*a* at the outer side of the downstream inflection points of each of the slots 782. The free end of each the arms 778*b* has a notch or yoke 778*c* which engages with the respective pivot pin 784 as the diverter 778 tracks along the slots 782. This engagement provided by the diverter displacement mechanism 780 acts as a yoke mechanism which prevents uncontrolled flipping of the diverter 778 as follows.

When the door 122 is in the closed position illustrated in FIG. 56, the tracking pins 778*a* are at the upstream inflection points 782*a* of the slots 782 such that the diverter 778 is in its home position and passively guides the media 104 coming from either the media input area 116 or the manual feed media input area 120. As the door 122 is partially opened in the direction of arrow B illustrated in FIG. 58A, the tracking pins 778*a* of the diverter 778 slide in the slots 782 causing movement of the diverter 778 away from the media path 774 to a partially retracted orientation.

Figure 58A:
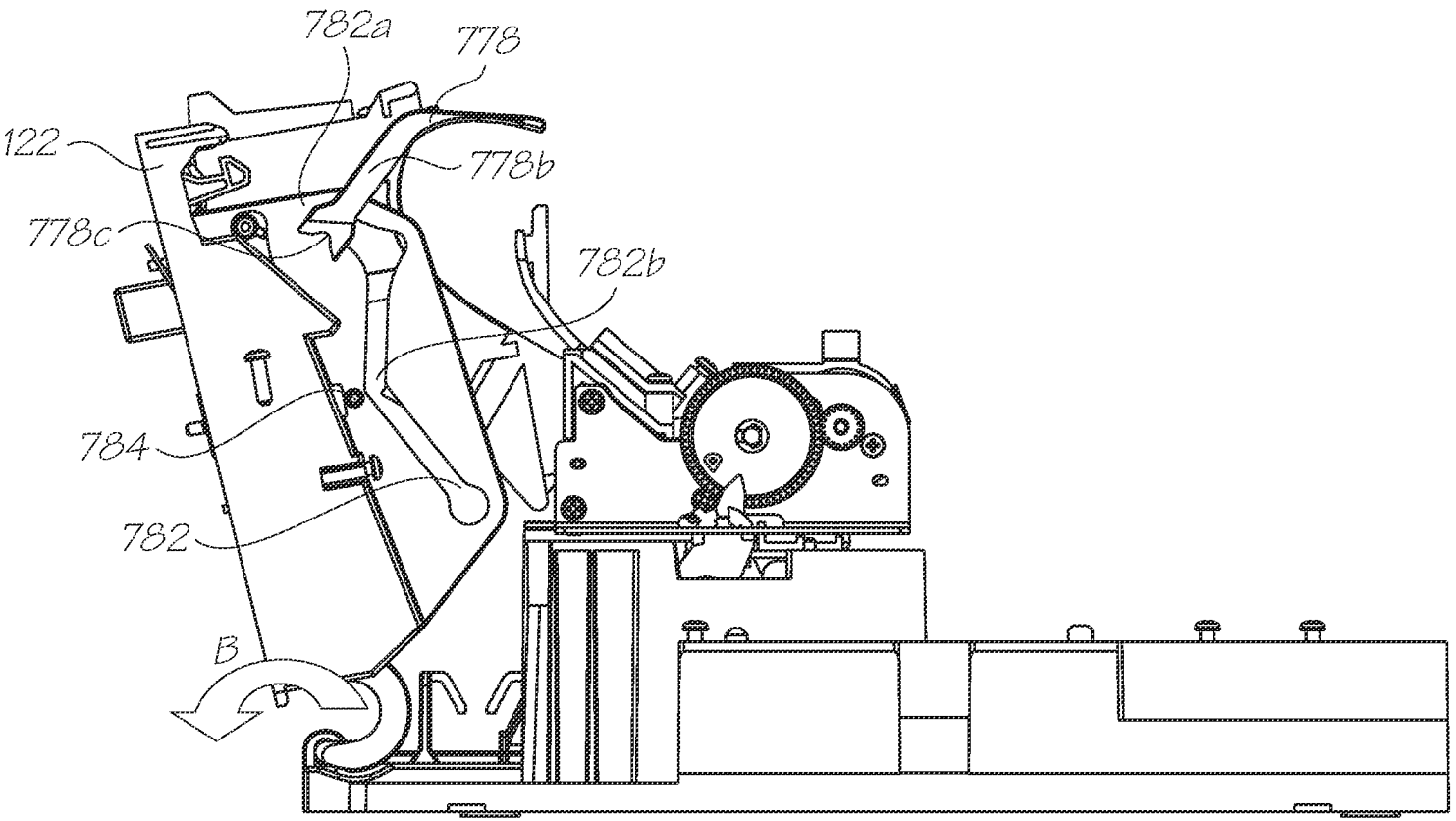
FIGS. 58A and 58B illustrate successive opened states of the media jam removal door.
Figure 58B:
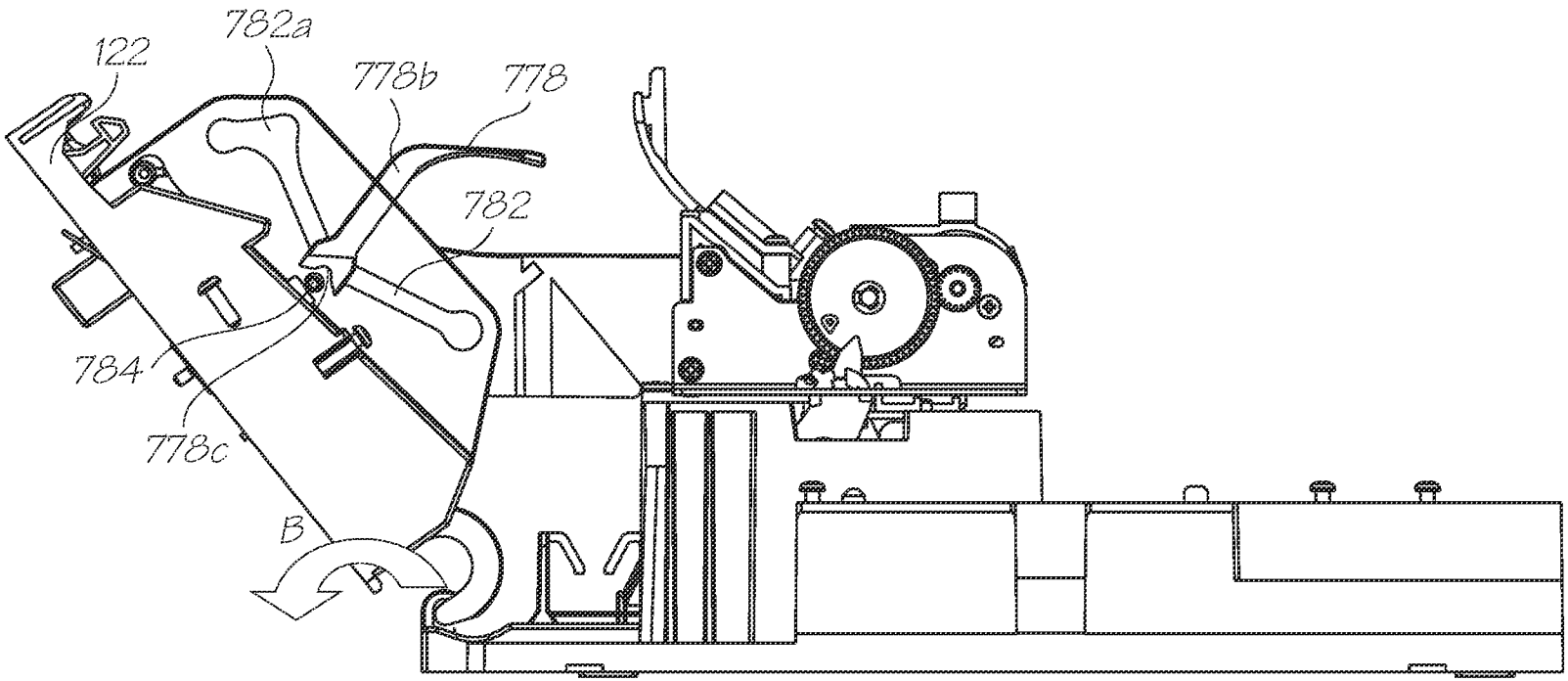
Figure 59:
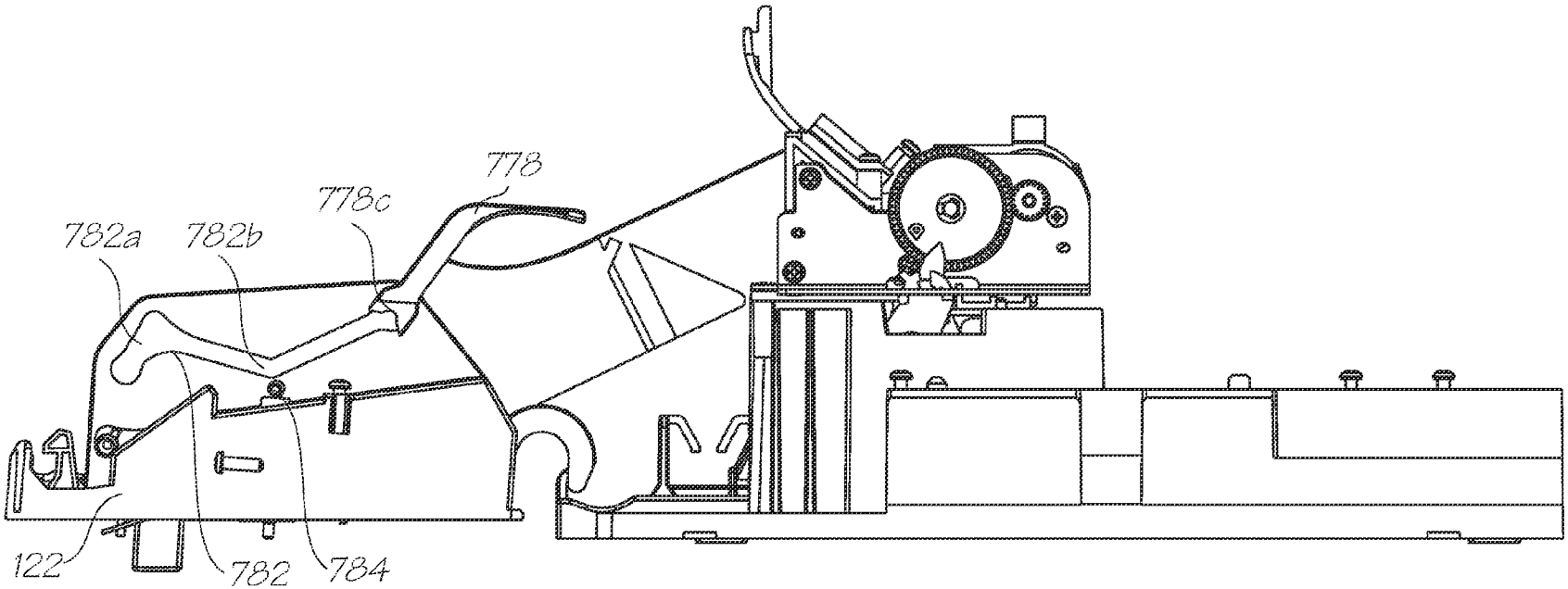
FIG. 59 illustrates a fully open state of the media jam removal door.

As the door 122 is opened further, as illustrated in FIG. 58B, the yokes 778*c* of the diverters 778 contact and pivot on the pivot pins 784, at which point the diverter 778 is at its fully retracted orientation. The engaged yokes 778*c* and pivot pins 784 prevent the diverter 778 from moving from the fully retracted orientation until the door 122 is fully open, at which point the tracking pins 778*a* of the diverter 778 slide past the downstream inflection points 782*b* of the slots 782 to the end of the slots 782, as illustrated in FIG. 59, retaining the diverter 778 in the fully retracted orientation.

Figure 60A:
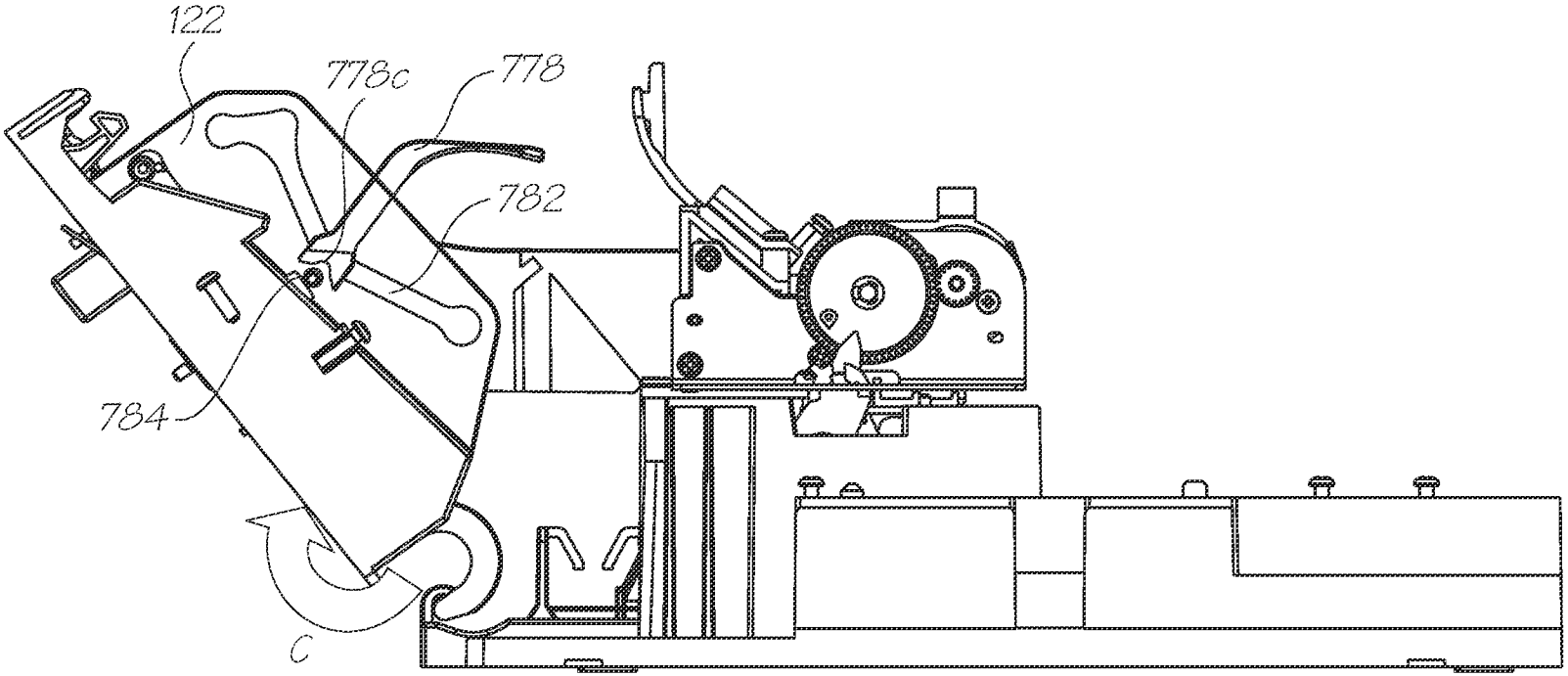
FIGS. 60A and 60B illustrate successive closed states of the media jam removal door.

When the door 122 is partially closed in the direction of arrow C illustrated in FIG. 60A, the tracking pins 778*a* of the diverter 778 slide back along the slots 782 and when the yokes 778*c* engages the pivot pins 784 the movement of the diverter 788 is controlled so that the diverter 788 remains in the fully retracted orientation, without flipping which would otherwise occur.

Figure 60B:
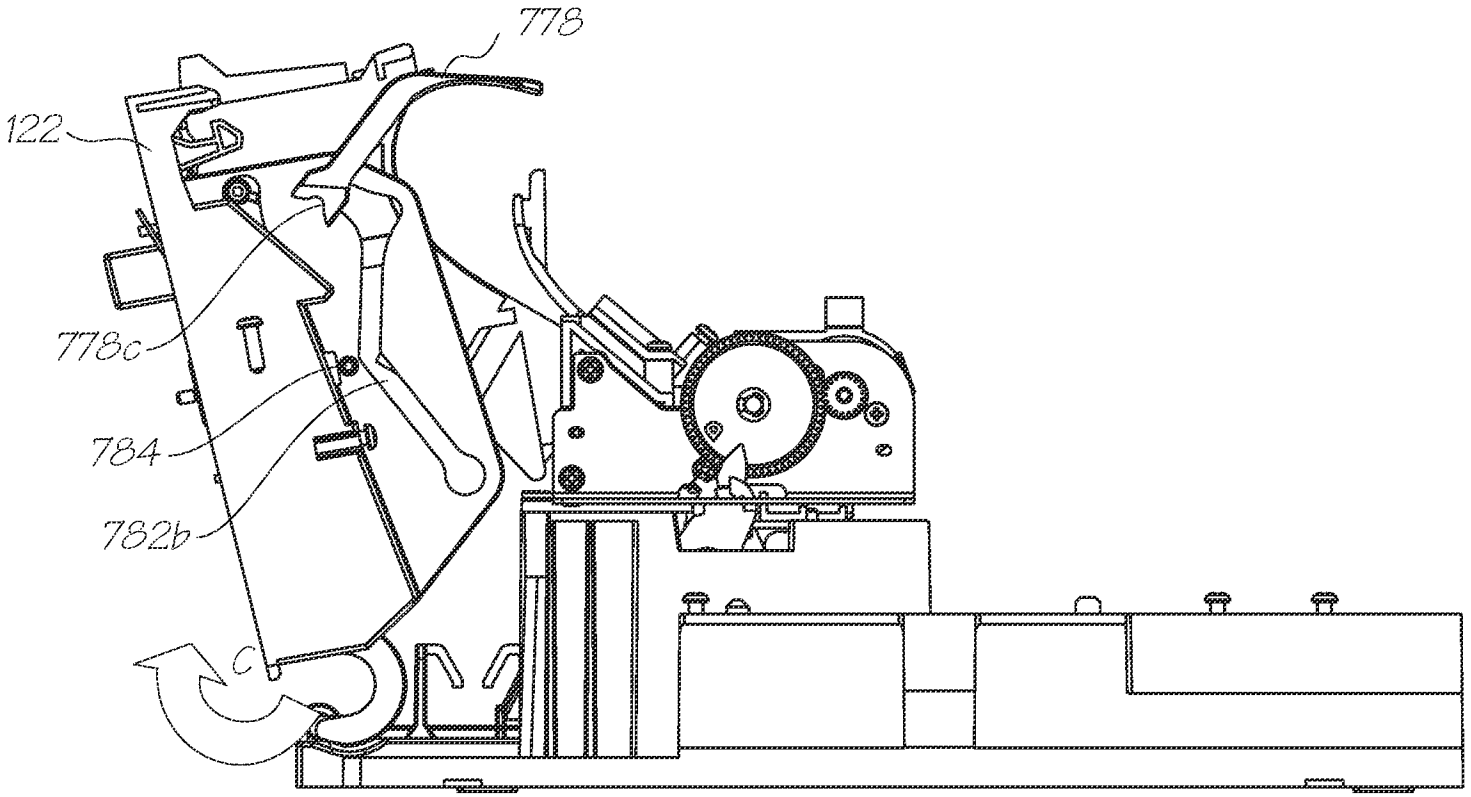

When the door 122 is further closed, as illustrated in FIG. 60B, the tracking pins 778*a* slide past the downstream inflection points 782*b* of the slots 782 toward the upstream inflection points 782*a* which causes the diverter 778 to return to the partially retracted orientation, so that as the door 122 is fully closed, as illustrated in FIG. 56, the diverter 778 is able to return to its home position within the media paths 774,776.

While the present invention has been illustrated and described with reference to exemplary embodiments thereof, various modifications will be apparent to and might readily be made by those skilled in the art without departing from the scope and spirit of the present invention. Accordingly, it is not intended that the scope of the claims appended hereto be limited to the description as set forth herein, but, rather, that the claims be broadly construed.

What is claimed is:

1. A system for guiding media past a media width printhead, the system comprising:

a media width printhead having a plurality of fluid ejection nozzles defining a media width print zone;

input rollers disposed relative to the printhead so as to transport media into the print zone at an angle to a plane parallel with the print zone;

output rollers disposed relative to the printhead so as to transport media out of the print zone at an angle to a plane parallel with the print zone; and an elongate platen for supporting and guiding the media as the media is transported through the print zone, the platen having a series of upstream ribs disposed upstream of the print zone with respect to the media transport direction and a series of downstream ribs disposed downstream of the print zone with respect to the media transport direction, wherein the ribs are configured for contacting the media and guiding the media through the print zone, and wherein the platen defines a slot having a longitudinal length along the media width, the upstream ribs being disposed on the upstream side of the slot and the downstream ribs being disposed on the downstream side of the slot, and wherein the platen comprises datum elements which contact the printhead so that the upstream and downstream ribs are spaced from the nozzles.

2. A system according to claim 1, wherein an outer surface of each of the upstream ribs is angled with respect to said parallel plane such that a portion of each of the upstream ribs closest to the slot is closer to the printhead than a portion of each of the upstream ribs furthest from the slot.

3. A system according to claim 1, wherein an outer surface of each of the downstream ribs is angled with respect to said parallel plane such that a portion of each of the downstream ribs closest to the slot is closer to the printhead than a portion of each of the downstream ribs furthest from the slot.

4. A system according to claim 1, wherein the input and output rollers are relatively disposed so that upstream and downstream angles to said parallel plane are about 10° to 12°.

5. A system according to claim 1, wherein the ribs are periodically positioned along the elongate length of the platen and are each aligned with the media transport direction along their respective length.

6. A system according to claim 1, wherein the platen is formed of a molded plastics material body and the ribs are integrally molded in the body.

7. A system for guiding media past a media width printhead, the system comprising:

a media width printhead having a plurality of fluid ejection nozzles defining a media width print zone;

input rollers disposed relative to the printhead so as to transport media into the print zone at an angle to a plane parallel with the print zone;

output rollers disposed relative to the printhead so as to transport media out of the print zone at an angle to a plane parallel with the print zone; and an elongate platen for supporting and guiding the media as the media is transported through the print zone, the platen having a series of upstream ribs disposed upstream of the print zone with respect to the media transport direction and a series of downstream ribs disposed downstream of the print zone with respect to the media transport direction, wherein the ribs are configured for contacting the media and guiding the media through the print zone, and wherein the platen comprises datum elements which contact the printhead so that the upstream and downstream ribs are spaced from the nozzles.

* * * * *